US010271611B2

(12) United States Patent
Adair et al.

(10) Patent No.: US 10,271,611 B2
(45) **Date of Patent: *Apr. 30, 2019**

(54) ATHLETIC POSITIONING APPARATUS AND APPLICATIONS THEREOF

(71) Applicant: Athalonz, LLC, Mesa, AZ (US)

(72) Inventors: Michael R. Adair, Woodruff, SC (US); Timothy W. Markison, Mesa, AZ (US)

(73) Assignee: ATHALONZ, LLC, Mesa, AZ (US)

( * ) Notice: Subject to any disclaimer, the term of this patent is extended or adjusted under 35 U.S.C. 154(b) by 509 days.

This patent is subject to a terminal disclaimer.

(21) Appl. No.: 14/563,135

(22) Filed: Dec. 8, 2014

(65) Prior Publication Data

US 2015/0082664 A1 Mar. 26, 2015

Related U.S. Application Data

(63) Continuation of application No. 13/355,778, filed on Jan. 23, 2012, now Pat. No. 8,938,893.

(Continued)

(51) Int. Cl.

| | |
|---|---|
| ***A43B 7/14*** | (2006.01) |
| ***A43B 13/12*** | (2006.01) |
| ***A43B 13/02*** | (2006.01) |
| ***A43B 13/14*** | (2006.01) |
| ***A43B 1/00*** | (2006.01) |
| ***A43B 7/24*** | (2006.01) |
| ***A43B 11/00*** | (2006.01) |

(Continued)

(52) U.S. Cl.

CPC ..... *A43B 7/14* (2013.01); *A43B 1/0081* (2013.01); *A43B 5/00* (2013.01); *A43B 7/141* (2013.01); *A43B 7/142* (2013.01); *A43B 7/143* (2013.01); *A43B 7/144* (2013.01); *A43B 7/1445* (2013.01); *A43B 7/1465* (2013.01); *A43B 7/24* (2013.01); *A43B 7/32* (2013.01); *A43B 11/00* (2013.01); *A43B 13/023* (2013.01); *A43B 13/12* (2013.01); *A43B 13/14* (2013.01); *A43B 13/143* (2013.01); *A43B 13/148* (2013.01); *A43B 13/18* (2013.01); *A43B 13/181* (2013.01); *A43B 13/189* (2013.01); *A43B 13/26* (2013.01); *A43C 1/00* (2013.01); *A43C 1/04* (2013.01); *A43C 11/1493* (2013.01); *A43C 15/162* (2013.01)

(58) Field of Classification Search

CPC ..... A43B 7/14; A43B 7/141; A43B 7/142; A43B 7/143; A43B 7/144; A43B 7/1445; A43B 7/1465; A43B 7/24; A43B 11/00; A43B 13/148; A43B 13/189; A43B 13/26; A43B 5/00; A43B 13/143; A43B 13/14

USPC ..... 36/142–144, 114, 25 R

See application file for complete search history.

(56) References Cited

U.S. PATENT DOCUMENTS 1,477,825 A * 12/1923 Heitler ..... A43B 7/142 36/162

2,909,854 A * 10/1959 Edelstein ..... A43B 7/1425 36/140

(Continued)

*Primary Examiner* — Marie D Bays

(74) *Attorney, Agent, or Firm* — Garlick & Markison; Timothy W. Markison

(57) ABSTRACT

An apparatus includes a heel section, a mid-foot section, and a toe section. The heel section, the mid-foot section, and the toe section collectively have a geometric shape having a first slope of a polarity along an inner edge of the apparatus from the toe section to the heel section and a second slope of the polarity along the inner edge of the apparatus to an outer edge of the apparatus at the toe section.

16 Claims, 92 Drawing Sheets

Related U.S. Application Data

(60) Provisional application No. 61/450,485, filed on Mar. 8, 2011.

(51) Int. Cl.

| | |
|---|---|
| ***A43B 13/18*** | (2006.01) |
| ***A43B 13/26*** | (2006.01) |
| ***A43C 1/00*** | (2006.01) |
| ***A43C 1/04*** | (2006.01) |
| ***A43C 11/14*** | (2006.01) |
| ***A43C 15/16*** | (2006.01) |
| ***A43B 5/00*** | (2006.01) |
| ***A43B 7/32*** | (2006.01) |

(56) References Cited

U.S. PATENT DOCUMENTS 4,620,376 A * 11/1986 Talarico, II ..... A43B 7/14 36/103
4,685,227 A * 8/1987 Simmons ..... A43B 17/02 36/127
4,862,605 A * 9/1989 Gardner ..... A43B 13/38 36/43
5,345,701 A * 9/1994 Smith ..... A61F 5/14 36/127
5,632,104 A * 5/1997 Zohar ..... A43B 7/14 36/103
6,604,301 B1 * 8/2003 Manoli, II ..... A43B 7/141 36/144
6,725,578 B2 * 4/2004 Kerrigan ..... A43B 7/142 36/144
7,299,568 B2 * 11/2007 Tager ..... A61F 5/14 36/140
7,464,428 B2 * 12/2008 Norton ..... A43B 13/04 12/142 R
8,387,277 B2 * 3/2013 Andriacchi ..... 36/142
8,631,592 B2 * 1/2014 Adair ..... A43B 1/0081 36/100
8,938,893 B2 * 1/2015 Adair ..... A43B 1/0081 36/142
2002/0005000 A1 * 1/2002 Choi ..... A43B 7/1435 36/144

* cited by examiner

Side Cross Section of Drive Leg Shoe

Front Cross Section of Drive Leg Shoe

Prior Art

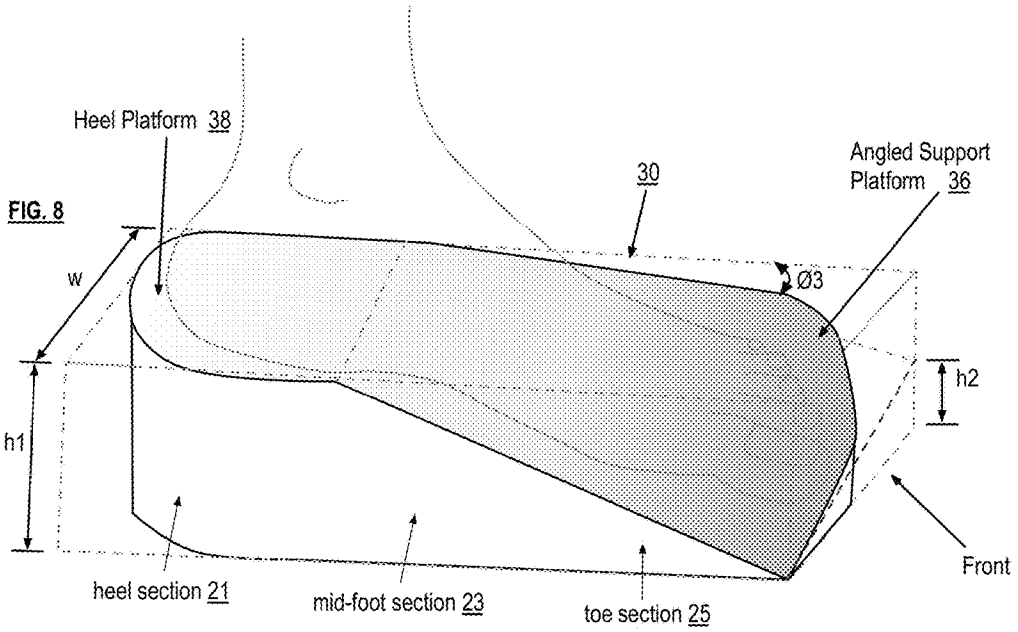
FIG. 8
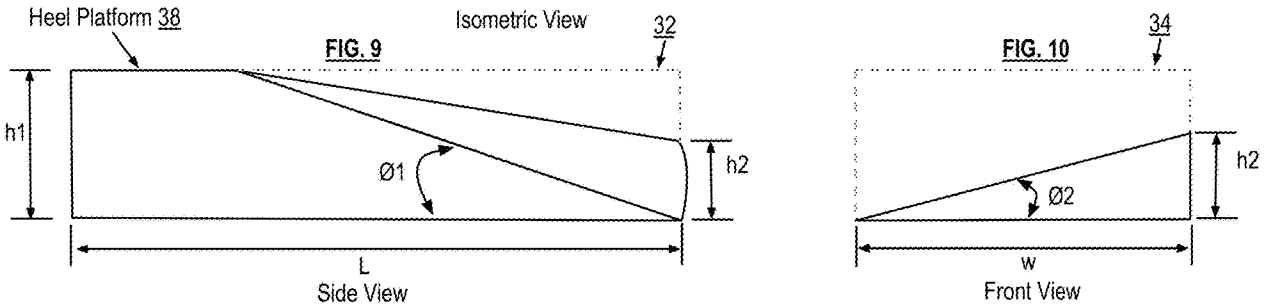
FIG. 10
FIG. 9

Layer 1

Layer 2

Layer 3

Layer 4

Layer 5

Layer 6

Layer 7

Layer 8

Layer 10

Layer 9

Insole Side View

Front View

Insole Side View

Front View

Isometric View of Sole

Isometric View of Sole

Front

Side

Can be other ratio than 50/50 could have more or less insole.

Top

Bottom

NOTE: Could have various rounding of corners, overall shape more like a sole or insole. Shown this way for slopes Front View Insole for Left Foot (prototype)

Top View

Inside View

Outside View

1/4
1/8
1/2
Front View

Sides
180
length and width for
an 11-1/2 shoe
sole for left
foot
(prototype)
Angled Support
Platform 36
Heel Platform
38
Inside View Top View Outside View Left Foot - Front View FIG. 66 rear view of left insole and/or sole Front View
adjust angle and/or height Inside View
adjust angle and/or height
adjustable ball of foot and arch area 232
Top View Adjustable Heel Area 230
Top View Adjust Height
Bottom View Outside View of Left Shoe Front View of Left Shoe keyhole receptacle 290
bottom view securing mechanism 268

Sole Front Cross Sectional View left foot - front view left foot - front view left foot - front view left foot - front view left foot - front view left foot - front view Front Bottom left foot - front view left foot - inside view Pitcher's Cleat Pattern
Plant Foot
(top view)

Bottom of Left Drive Shoe

Sole
Attachment
500

Topography of Sole Attachment

Pitching Training Aid

Pitching Training Aid

Pitching Rubber

Pitching Rubber

Anchored to Sole

ATHLETIC POSITIONING APPARATUS AND APPLICATIONS THEREOF

CROSS REFERENCE TO RELATED PATENTS

The present U.S. Utility patent application claims priority pursuant to 35 U.S.C. § 120 as a continuation of U.S. Utility application Ser. No. 13/355,778, entitled "ATHLETIC POSITIONING APPARATUS AND APPLICATIONS THEREOF", filed Jan. 23, 2012, which claims priority pursuant to 35 U.S.C. § 119(e) to U.S. Provisional Application No. 61/450,485, entitled "ATHLETIC POSITIONING FOOTWEAR," filed Mar. 8, 2011, all of which are hereby incorporated herein by reference in their entirety and made part of the present U.S. Utility patent application for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Technical Field of the Invention

This invention relates generally to footwear and more particularly to athletic positioning footwear.

Description of Related Art

As is known, a wide variety of shoes are available in today's market. The types, designs, and style of the shoes vary greatly depending on their use. For example, dress shoes have a particular design and style based on a more formal use. As another example, athletic shoes have a particular design and style based on their use while playing sports. For instance, each of tennis shoes, golf shoes, running shoes, cross training shoes, hiking shoes, basketball shoes, etcetera have a particular sole pattern, a sole design, an insole design, and upper shoe portion design. In addition, each type of athletic shoe may further include a lateral stability design, an arch support design, a pronation compensation design, and/or a supination compensation design.

As another specific example, FIGS. 1 and 2 illustrate a cross sectional front view and a cross-sectional side view of a pair of baseball spikes. As is shown, the baseball spikes include a sole, a padded insole, an upper shoe portion, and cleats (or spikes). The positioning of the cleats facilitates better traction in grass and/or dirt while playing baseball. In these figures, the sole and/or the padded insole provide a relatively flat platform for the foot within the baseball spikes. In some designs of baseball spikes, the heel portion of the shoe may be higher than the toe portion of the shoe from a side perspective.

BRIEF DESCRIPTION OF THE SEVERAL VIEWS OF THE DRAWING(S)

FIG. 8 illustrates an isometric diagram of another embodiment of an athletic positioning shape in accordance with the present invention;

FIG. 9 illustrates a cross-sectional side view diagram of another embodiment of an athletic positioning shape in accordance with the present invention;

FIG. 10 illustrates a cross-sectional front view diagram of another embodiment of an athletic positioning shape in accordance with the present invention;

DETAILED DESCRIPTION OF THE INVENTION

Figures 1, 2:
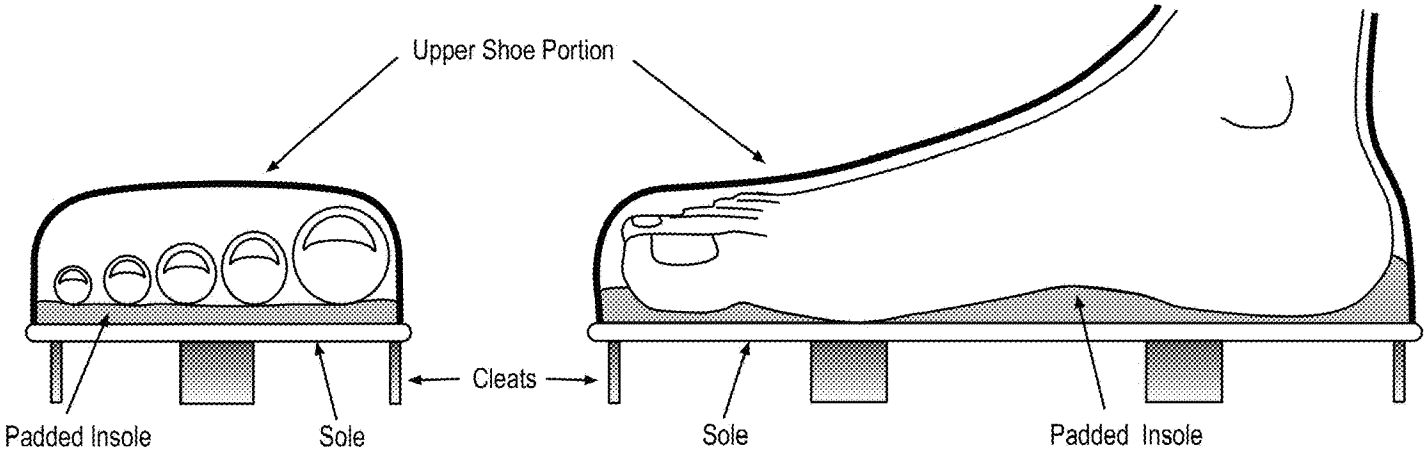
FIG. 1 illustrates a cross-sectional front view diagram of baseball spikes of the prior art.
FIG. 2 illustrates a cross-sectional side view diagram of baseball spikes of the prior art.
Figures 3, 4:
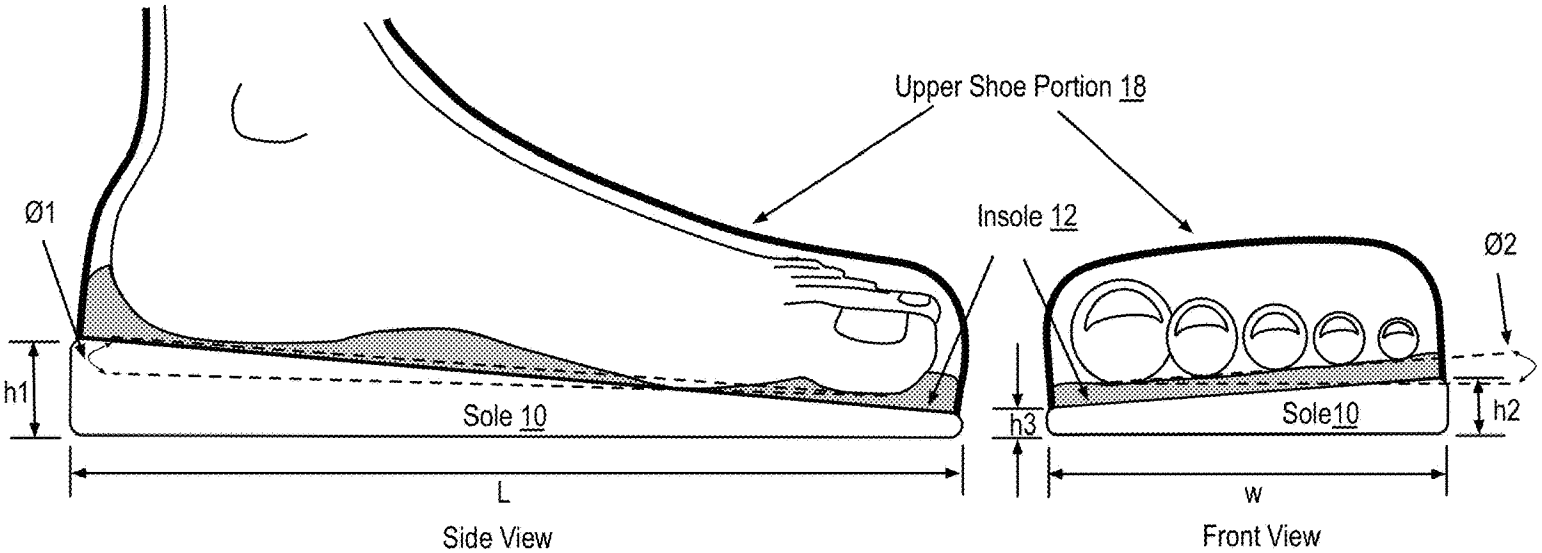
FIG. 3 illustrates a cross-sectional side view diagram of an embodiment of a shoe having an athletic positioning insole and/or sole in accordance with the present invention.
FIG. 4 illustrates a cross-sectional front view diagram of an embodiment of a shoe having an athletic positioning insole and/or sole in accordance with the present invention.

FIGS. 3 and 4 illustrate a cross-sectional side view and a cross-sectional front view, respectively, of an embodiment of footwear having an apparatus that facilitates athletic positioning via an insole and/or a sole of a shoe. The shoe includes an upper section 18, and insole section 12, and a sole section 10. The apparatus, which may be the insole section 12 and/or the sole section 10, of a shoe, has an athletic positioning shape as formed by a heel section 21, a mid-foot section 23, and/or a toe section 25. In general, the athletic positioning shape has the heel section 21 higher than the toe section by a particular angle (e.g., Ø1, which may range from a fraction of a degree to 10's of degrees) and the outside edge of the shoe higher than the inside edge of the shoe by another angle (e.g., Ø2, which may range from a fraction of a degree to 10's of degrees) at the ball of foot and/or toe section of the shoe.

When a person wears such a shoe, the athletic positioning shape of the insole and/or sole, places the person in an athletic position (e.g., knees slightly bent, weight more on the inside of the legs than the outside of the legs, knees position aligned with ankles and hips, and/or other athletic positioning characteristics). For example, when a pitcher wears a pair of baseball spikes that include the athletic positioning shape insole 12 and/or sole 10, the pitcher's toe and ball of foot are a primary contact point with the ground, which shifts the pitcher's weight to the inside of his/her legs and slightly bends the pitcher's knees. In this position, the pitcher's lower half is in a more optimal position for pitching.

As another example, a batter may wear a pair of baseball spikes that include the athletic positioning shape insole 12 and/or sole 10. When in the batter's box, the baseball spikes enable the batter to place more weight on his/her big toe and ball of foot than on the outer edge of the foot. In addition, the batter's knees are flexed and his/her weight is shifted to the inside portion of the leg as opposed to the outside portion of the leg, which promotes a better hitting stance.

The athletic positioning insole 12 and/or sole 10 may be used in any type of shoe (e.g., a dress shoe, a casual shoe, a sport specific shoe, a training shoe, and/or a combination thereof) For example, the athletic positioning insole 12 and/or sole 10 may be used in basketball shoes, tennis shoes, golf shoes, ski boots, ice skates, baseball cleats, football cleats, soccer shoes, running shoes, track shoes, cross fitness shoes, etc. For each of these sport specific shoes, the athletic positioning insole 12 and/or sole 10 are coupled to a specific bottom and a corresponding upper shoe section to promote a better athletic position for an athlete. The specific bottom may comprise one or more of a cleat pattern bottom, a baseball spike bottom, a basketball bottom, a tennis bottom, a golf bottom, an ice skate bottom, a ski boot bottom, a cross-trainer bottom, a running shoe bottom, a walking shoe bottom, a dress shoe bottom and a snowboard boot bottom. The upper section of a shoe may also have a sandal structure that includes one or more straps for securing the shoe to a foot.

Figure 5:
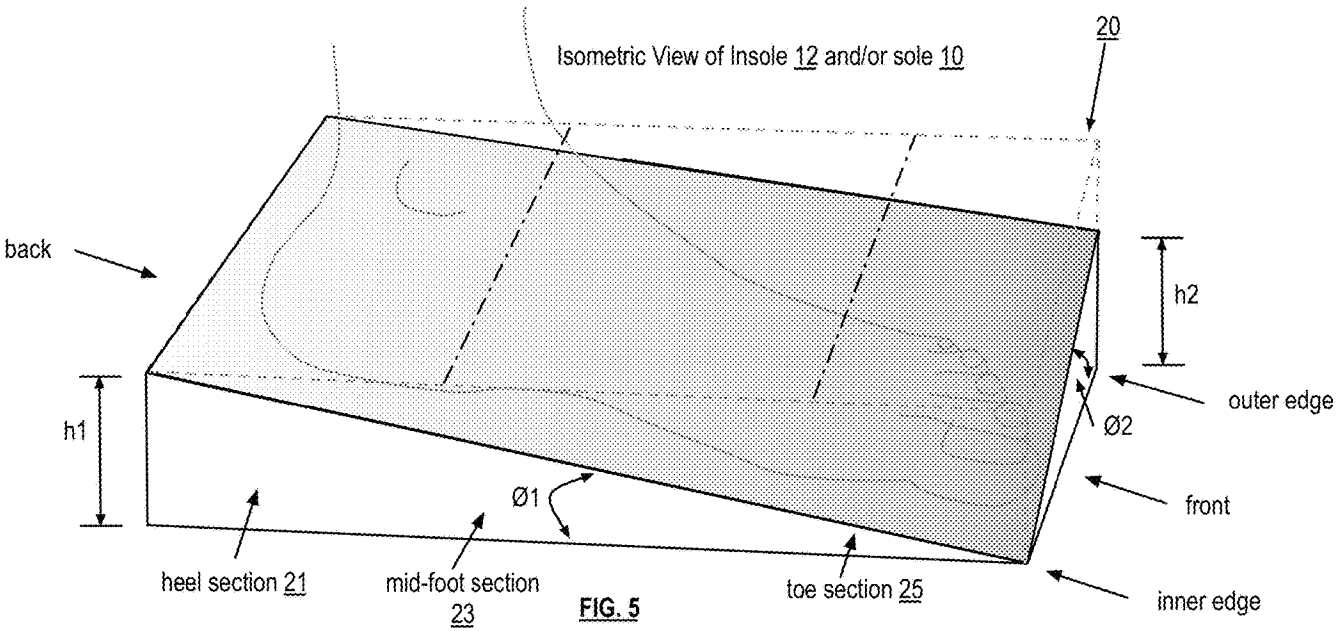
FIG. 5 illustrates an isometric diagram of an embodiment of an athletic positioning shape in accordance with the present invention.
Figure 7:
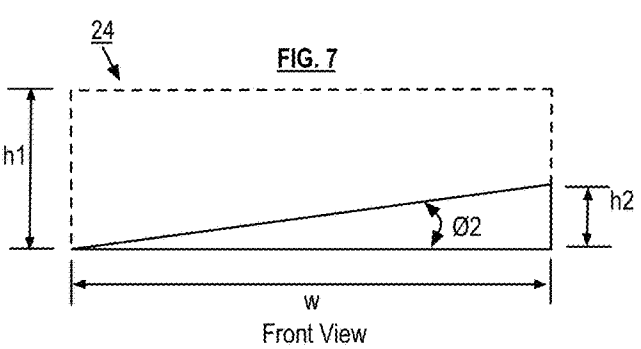
FIG. 7 illustrates a cross-sectional front view diagram of an embodiment of an athletic positioning shape in accordance with the present invention.
Figure 6:
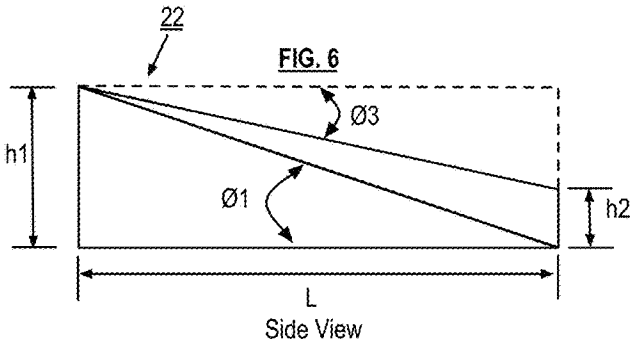
FIG. 6 illustrates a cross-sectional side view diagram of an embodiment of an athletic positioning shape in accordance with the present invention.

FIGS. 5-7 illustrate an isometric diagram 20, a cross-sectional side view diagram 22, and a cross-sectional front view diagram 24 of an embodiment of an athletic positioning shape, which may be used in an insole 12 and/or sole 10 of a shoe. The athletic positioning shape includes a heel section 21, a mid-foot section 23, and a toe section that collectively have an overall geometric shape that corresponds to the shape of a shoe, but is shown in block form for ease of illustration. The heel section 21, mid-foot section 23, and toe section 25 may each be separate pieces, a uniform piece, and/or two of the sections may be a uniform piece while the other is a separate piece.

The heel section 21 has a first dimension that is substantially uniform from the outer edge to the inner edge along a back edge of the apparatus and from the back edge of the apparatus to a front portion of the heel section 21. The toe section 25 has a second dimension at the front outer edge of the apparatus and a third dimension at the front inner edge of the apparatus. The first dimension has a magnitude that is greater than or equal to a magnitude of the second dimension and the magnitude of the second dimension is greater than a magnitude of the third dimension.

As shown, the heel section 21 of the shoe has a particular height (e.g., h1, which may be 1 to 10's of mm) that has a first slope (e.g., corresponding to Ø1) of the polarity through the mid-foot section 23 to the toe section 25 on the inside edge of the shoe. The inside edge of the shoe at the toe section may have a height of zero to a few millimeters.

As also shown, the athletic positioning shape includes a second height (e.g., h2) at the outer edge of the shoe at the toe section 25, which has a second slope (e.g., corresponding to Ø2) of the polarity to the inside edge of the shoe. Accordingly, a third angle exists from the heel to the toe section 25 on the outer edge of the shoe.

The heel section 21 may also include a first structure corresponding to a first portion of the geometric shape, while the mid-foot section 23 may include a second structure corresponding to a second portion of the geometric shape, and the toe section 25 may include a third structure corresponding to a third portion of the geometric shape, wherein the heel section 21 is juxtaposed to the mid-foot section 23, which is juxtaposed to the toe section 25. For example, the heal section may be mechanically coupled to the mid-foot section 23 and the mid-foot section 23 may be mechanically coupled to the toe section 25, wherein spacing between the sections maybe near zero to several centimeters. The apparatus may also include a cushioning layer on a first surface covering at least a portion of the heel, mid-foot and/or toe sections.

While the surface on which the foot lies, the angles, and the perimeter lines are shown as straight lines and/or flat surfaces, they may be contoured lines and/or angles, contoured surfaces, contour slopes, concave and/or convex slopes and/or surfaces, and/or a combination thereof to provide a more comfortable and/or custom fit.

FIGS. 8-10 illustrate an isometric diagram 30, a cross-sectional side view diagram 32, and a cross-sectional front view diagram 34 of an embodiment of an athletic positioning shape, which may be used in an insole 12 and/or sole 10 of a shoe. The athletic positioning shape includes an overall geometric shape that corresponds to the shape of a shoe, but is shown in block form for ease of illustration. The athletic positioning shape further includes a heel platform 38 and an angled support platform 36. The heel platform includes a height (h1) and width (w).

The angled support platform 36 includes a length (L—heel platform length), the width (w), a first height (h1), a second height (h2), an inner toe section height (e.g., 0 to a few mm), a first angle (e.g., Ø1) from the heel platform 38 to the toe on the inside edge of the shoe, a second angle (e.g., Ø2) from the outer edge of the shoe to the inside edge of the shoe, and a third angle (e.g., Ø3) from the heel platform 38 to the toe section 25 on the outer edge of the shoe.

In an example, the toe section 25 and the mid-foot section 23 collectively have a geometric shape having a first dimension along an abutment edge of the heel platform section 38 and the mid-foot section 23, a second dimension at front outer edge of the apparatus, and a third dimension at front inner edge of the apparatus. The first dimension is substantially uniformly throughout the heel platform section 38 and has a magnitude that is greater than or equal to a magnitude of the second dimension. The magnitude of the second dimension is greater than a magnitude of the third dimension.

Figure 11:
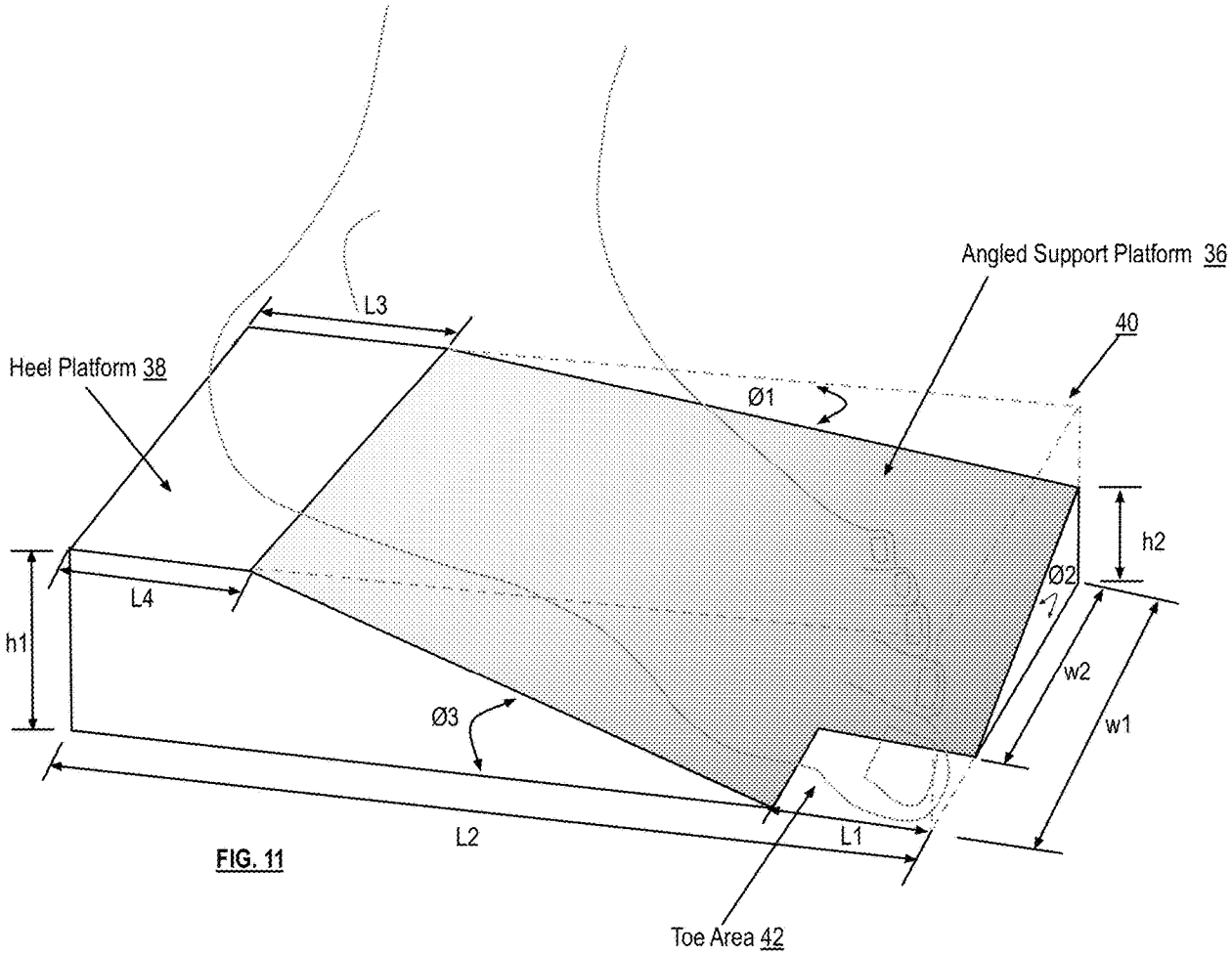
FIG. 11 illustrates an isometric diagram of another embodiment of an athletic positioning shape in accordance with the present invention.

FIG. 11 illustrates an isometric diagram of another embodiment of an athletic positioning shape 40, which may be used in an insole 12 and/or sole 10 of a shoe. The athletic positioning shape includes an overall geometric shape that corresponds to the shape of a shoe, but is shown in block form for ease of illustration. The athletic positioning shape further includes a heel platform 38, an angled support platform 36, and a toe area 42. The heel platform 38 includes a height (h1), a width (w), a first length (L4) and a second length (L3), where L3 is greater than L4.

The angled support platform 36 includes a length (L-L3 and L-L4), a first width (w1), a second width corresponding to the toe area 42 (w1-w2), a first height (h1), a second height (h2), a first angle (e.g., Ø1) from the heel platform to the toe on the outside edge of the shoe, a second angle (e.g., Ø2) from the outer edge of the shoe to the edge of the toe area 42, and a third angle (e.g., Ø3) from the heel platform 38 to the toe area 42 on the inner edge of the shoe.

Figure 12:
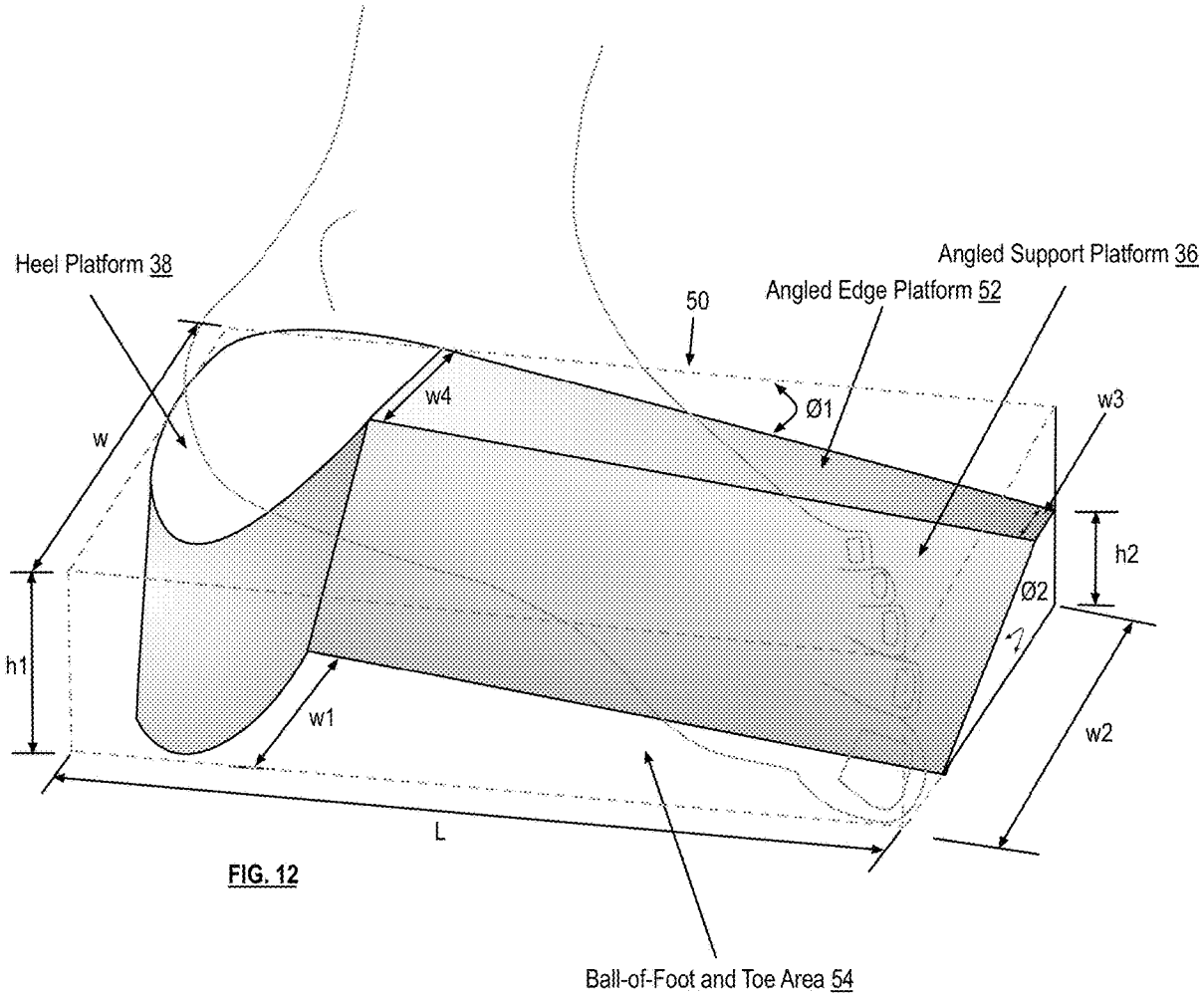
FIG. 12 illustrates an isometric diagram of another embodiment of an athletic positioning shape in accordance with the present invention.

FIG. 12 illustrates an isometric diagram 50 of another embodiment of an athletic positioning shape, which may be used in an insole 12 and/or sole 10 of a shoe. The athletic positioning shape includes an overall geometric shape that corresponds to the shape of a shoe, but is shown in block form for ease of illustration. The athletic positioning shape further includes a heel platform 38, an angled support platform 36, an angled edge platform 52, and a ball-of-foot/toe area 54. The heel platform 38 includes a height (h1), a width (w), and a length.

The angled support platform 36 includes a length (L—heel length), a first width (w2-w1) at heel platform 38, a second width (w2-w1) at toe area, a first height (h1), a second height (h2), a first angle (e.g., Ø1) from the heel platform 38 to the toe on the outside edge of the shoe, and a second angle (e.g., Ø2) from the outer edge of the shoe to the edge of the toe area. The angled edge platform 52 includes a length (L—heel length), a first width (w4) at heel platform 38, a second width (w2) at toe area, a first height (h1), a second height (h2), and a first angle (e.g., Ø1) from the heel platform 38 to the toe on the outside edge of the shoe.

Figure 13:
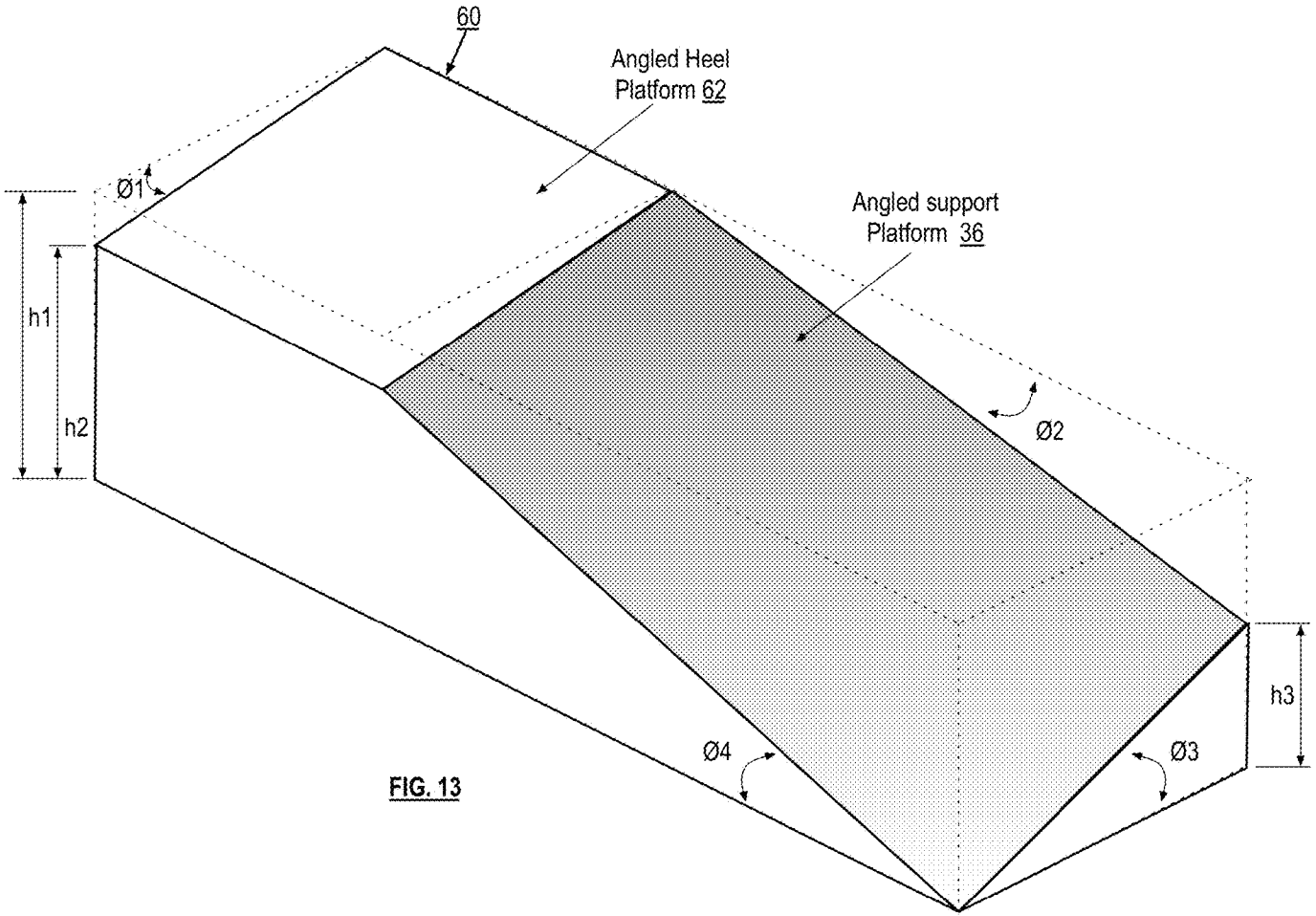
FIG. 13 illustrates an isometric diagram of another embodiment of an athletic positioning shape in accordance with the present invention.

FIG. 13 illustrates an isometric diagram 60 of another embodiment of an athletic positioning shape, which may be used in an insole 12 and/or sole 10 of a shoe. The athletic positioning shape includes an overall geometric shape that corresponds to the shape of a shoe, but is shown in block form for ease of illustration. The athletic positioning shape further includes an angled heel platform 62 and an angled support platform 36. The angled heel platform 62 includes a first height (h1), a second height (h2), a length, a width (w), and an angle (Ø1), which may be in the range of −10 to 10 degrees. As shown, the angle (Ø1) is shown to be a positive angle such that the heel platform 62 is slightly angled from the outer edge of the shoe to the inner edge, which may be to facilitate the athletic position and/or to adjust for supination. While not shown, if the angle (Ø1) is negative, the heel platform 62 is slightly angled from the inner edge of the shoe to the outer edge, which may be to facilitate the athletic position and/or to adjust for pronation.

The angled support platform 36 includes a length (L—heel platform length), the width (w), a first height (h1), a second height (h2), an inner toe section height (e.g., 0 to a few mm), a first angle (e.g., Ø4) from the heel platform to the toe on the inside edge of the shoe, a second angle (e.g., Ø3) from the outer edge of the shoe to the inside edge of the shoe, and a third angle (e.g., Ø2) from the angled heel platform 62 to the toe section 25 on the outer edge of the shoe.

Figure 14:
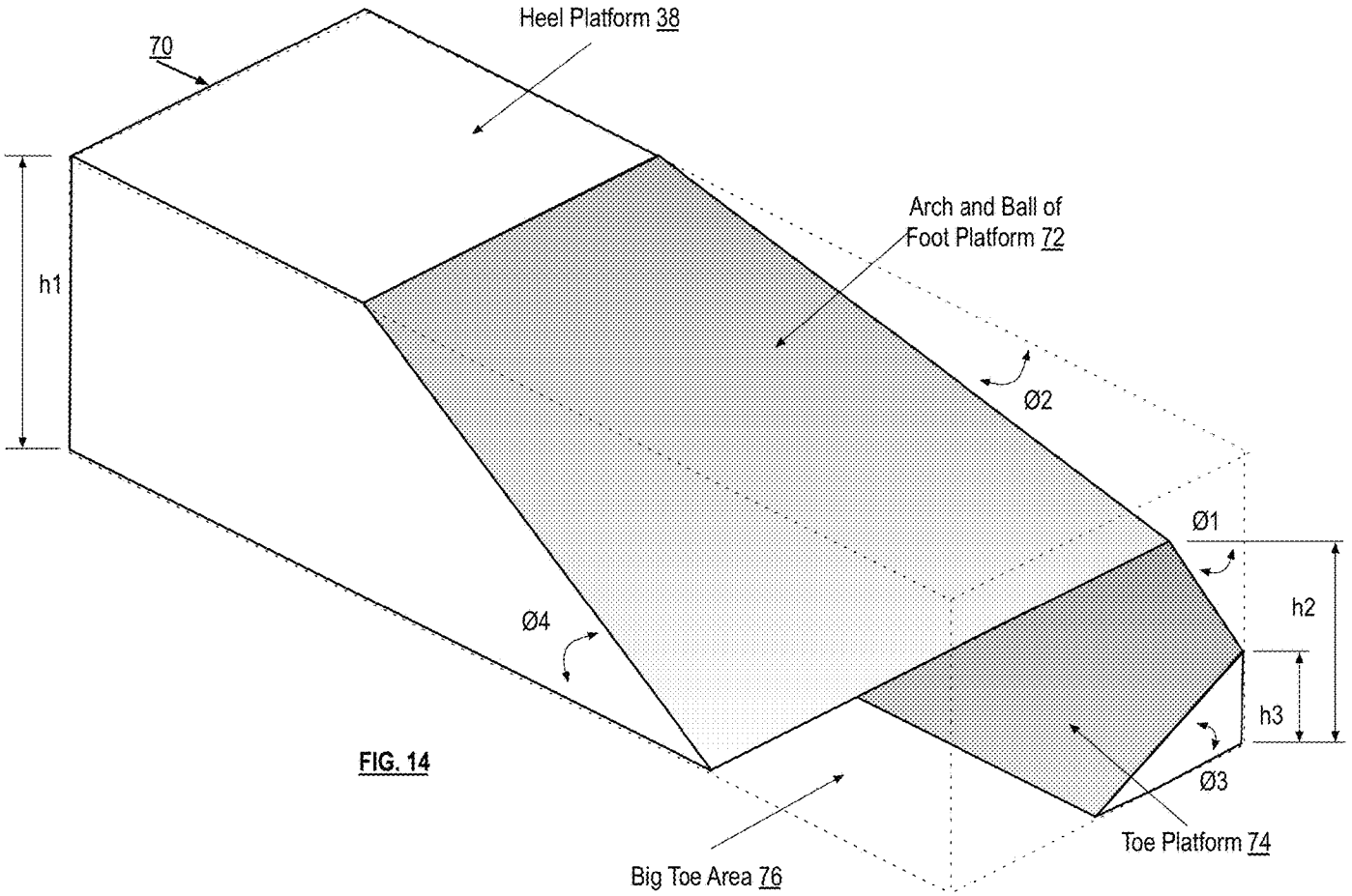
FIG. 14 illustrates an isometric diagram of another embodiment of an athletic positioning shape in accordance with the present invention.

FIG. 14 illustrates an isometric diagram of another embodiment of an athletic positioning shape 70, which may be used in an insole 12 and/or sole 10 of a shoe. The athletic positioning shape includes an overall geometric shape that corresponds to the shape of a shoe, but is shown in block form for ease of illustration. The athletic positioning shape further includes a heel platform 38, an angled arch support platform 72, an angled toe platform 74, and a big toe area 76. Note that the inside portion of the ball of foot may be in the big toe area and the rest of the ball of foot may be in the angle arch support platform.

The heel platform includes a height (h1), a width, and a length. The angled arch support platform includes a length (L—heel length and the big toe area length), a width, a first height (h1), a second height (h2), a first angle (e.g., Ø2) from the heel platform to the toe on the outside edge of the toe platform, and a second angle (e.g., Ø2) from the outer edge of the shoe to the edge of the big toe area. The toe platform includes a length (L—heel length and the length of the arch platform), a width, a first height (h2), a second height (h3), and a first angle (e.g., Ø1) from the arch platform 72 to the toe platform 74 and a second angle (e.g., Ø3) from the outside edge of the shoe to the big toe area. In this embodiment, Ø1 is greater than Ø2 such that the angle of the toes is greater than the angle of the arch platform and allows for more flexing of the toes.

Figure 15:
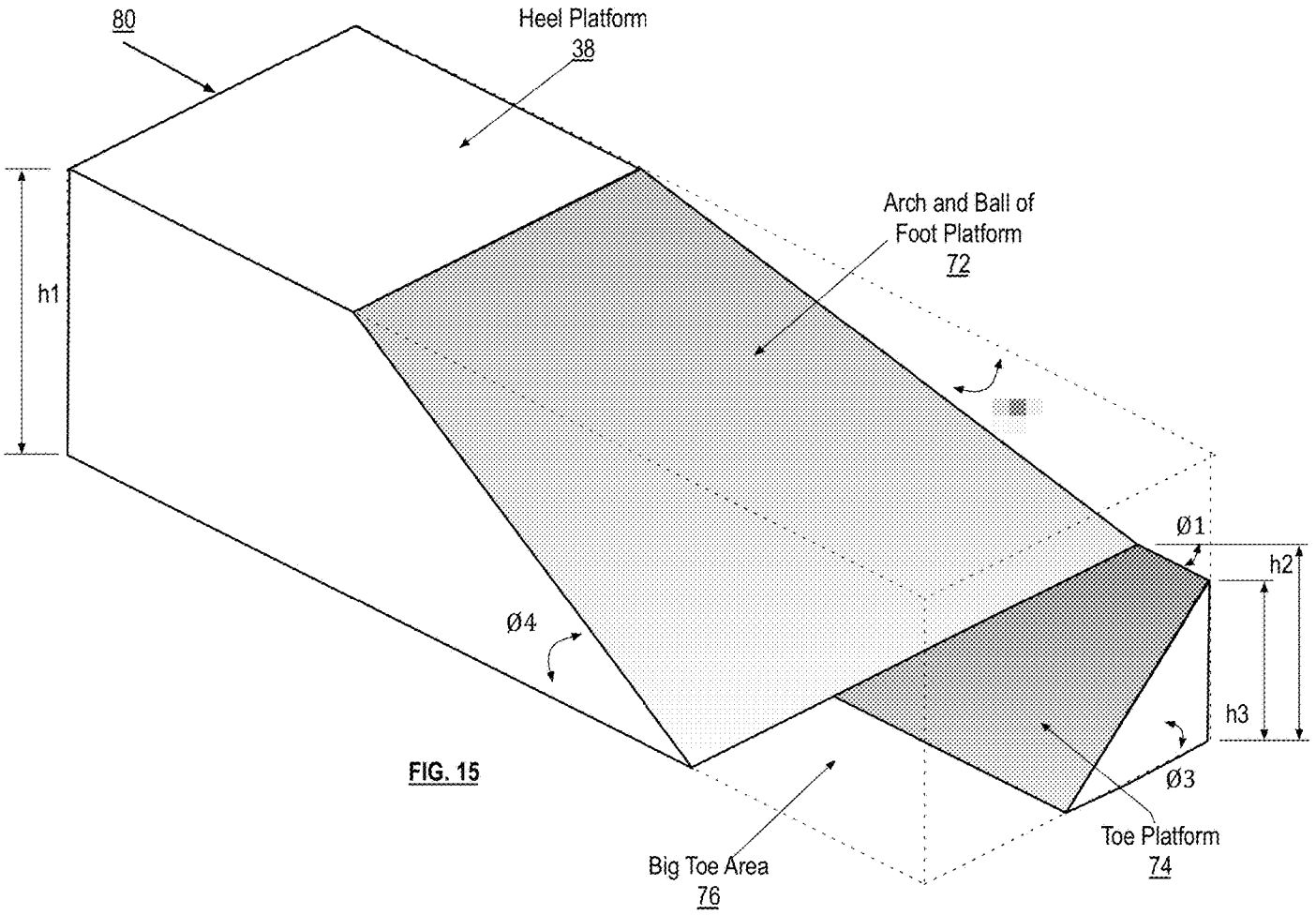
FIG. 15 illustrates an isometric diagram of another embodiment of an athletic positioning shape in accordance with the present invention.

FIG. 15 illustrates an isometric diagram 80 of another embodiment of an athletic positioning shape, which may be used in an insole 12 and/or sole 10 of a shoe. The athletic positioning shape includes an overall geometric shape that corresponds to the shape of a shoe, but is shown in block form for ease of illustration. The athletic positioning shape further includes a heel platform 38, an angled arch support platform 72, an angled toe platform 74, and a big toe area 76. Note that the inside portion of the ball of foot may be in the big toe area and the rest of the ball of foot may be in the angle arch support platform.

The heel platform includes a height (h1), a width, and a length. The angled arch support platform includes a length (L—heel length and the big toe area length), a width, a first height (h1), a second height (h2), a first angle (e.g., Ø2) from the heel platform to the toe on the outside edge of the toe platform, and a second angle (e.g., Ø2) from the outer edge of the shoe to the edge of the big toe area. The toe platform includes a length (L—heel length and the length of the arch platform), a width, a first height (h2), a second height (h3), and a first angle (e.g., Ø1) from the arch platform to the toe platform and a second angle (e.g., Ø3) from the outside edge of the shoe to the big toe area. In this embodiment, Ø2 is greater than Ø1 such that the angle of the toes is less than the angle of the arch platform, which allows for less flexing of the toes.

While the surfaces on which the foot and toes lie, the angles, and the perimeter lines are shown as straight lines and/or flat surfaces in each of the embodiments of FIGS. 5-15, they may be contoured lines and/or angles, contoured surfaces, contour slopes, concave and/or convex slopes and/or surfaces, and/or a combination thereof to provide a more comfortable and/or custom fit. Note that the shoe may further include arch support as a separate layer of the insole or integrated into the insole. Further note that the present athletic positioning shape may be used in a standalone athletic positioning insole product, in a standalone athletic positioning sole attachment, in a training shoe, and/or a sock. Still further note that with the combination of height and angles of the embodiments of FIGS. 5-15, the wearer of a shoe that incorporates an athletic positioning insole and/or sole having one of the athletic positioning shapes is placed in an athletic position, which may promote better athletic performance and/or which may promote better biomechanical body functioning.

Figure 16:
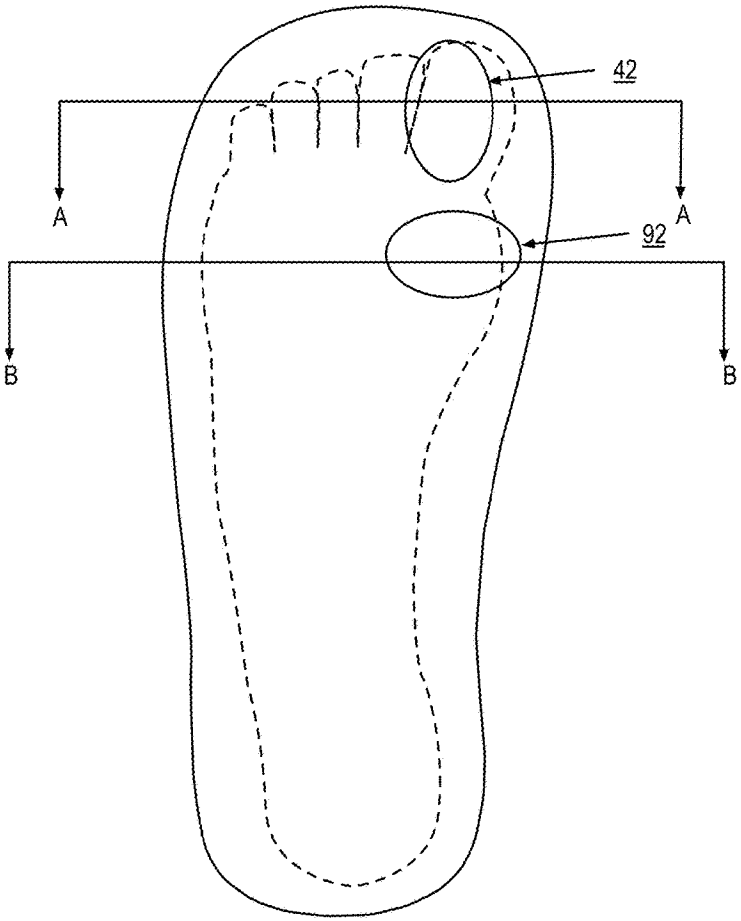
FIG. 16 illustrates a top view diagram of an embodiment of an athletic positioning insole and/or sole having one or more cups in accordance with the present invention.

FIG. 16 illustrates a top view diagram of an embodiment of an athletic positioning insole 12 and/or sole 10 having one or more positioning and/or stabilizing cups. The athletic positioning insole 12 and/or sole 10 may include one or more of the athletic positioning shapes of the previous figures and/or of the subsequent figures. In this example embodiment, the athletic positioning insole 12 and/or sole 10 includes a big toe stabilizing and/or positioning cup 90 and an inner-ball of foot stabilizing and/or positioning cup 92. The cup helps with positioning the foot on the athletic positioning insole and/or sole and may further help with stabilizing the foot in its position on the athletic positioning insole and/or sole during athletic activities. Each of the cups may be a few millimeters in depth, have sloped sides, may be of a different material then the insole and/or sole, and/or a combination thereof.

Figure 17:
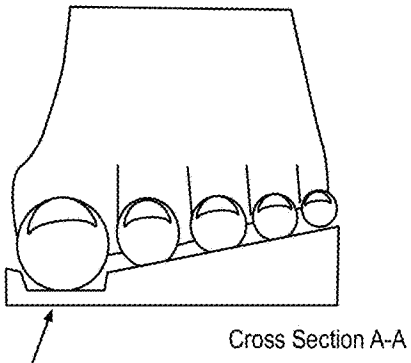
FIG. 17 illustrates a cross-sectional front view diagram of an embodiment of an athletic positioning insole and/or sole having a toe cup in accordance with the present invention.

FIG. 17 illustrates a cross-sectional front view diagram of an embodiment of an athletic positioning insole and/or sole having a toe cup. As shown, the big toe fits within the toe cup 42 to provide positioning and/or stabilization of the foot within the insole 12 and/or sole 10.

Figure 18:
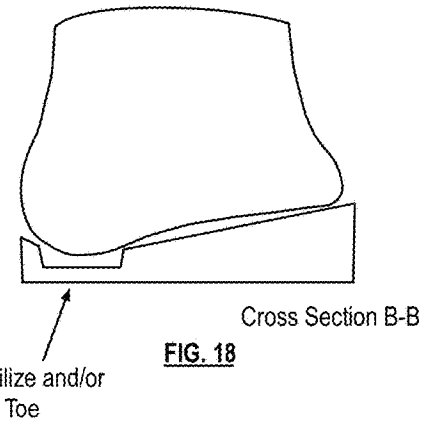
FIG. 18 illustrates a cross-sectional front view diagram of an embodiment of an athletic positioning insole and/or sole having a ball of foot cup in accordance with the present invention.

FIG. 18 illustrates a cross-sectional front view diagram of an embodiment of an athletic positioning insole 12 and/or sole 10 having a ball of foot cup. As shown, the inner portion of the ball of the foot fits within the ball of foot cup 92 to provide positioning and/or stabilization of the foot within the insole 12 and/or sole 10.

Figure 19:
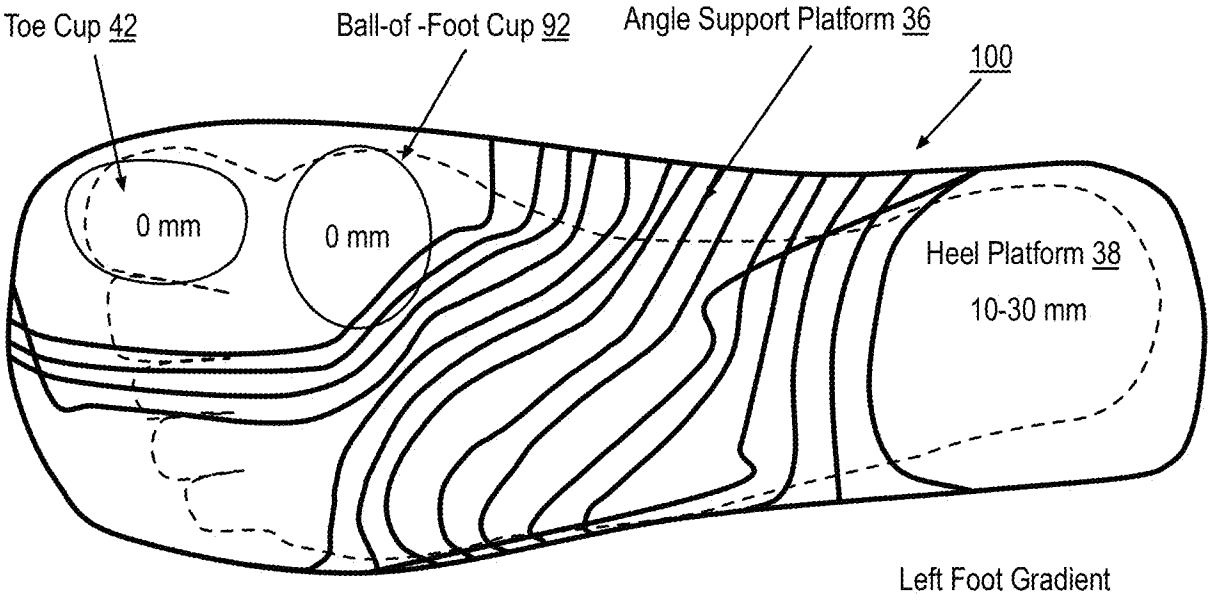
FIG. 19 illustrates a topographical diagram of another embodiment of an athletic positioning shape in accordance with the present invention.

FIG. 19 illustrates a topographical diagram 100 of another embodiment of an athletic positioning shape, which may be used in an insole 12 and/or sole 10 of a shoe. The athletic positioning shape further includes a heel platform 38, an angled support platform 36, a toe cup 42, and a ball-of-foot cup 92. With respect to the toe cup and/or the ball of foot cup, the heel platform may be 10 to 30 mm higher and may have a shape corresponding to the heel of a shoe.

The angle support platform includes a contoured shape that angles from the outer edge of the foot to the inner edge of the foot with a greater slope in the ball of foot area than in the toe area. The gradient at which the angled support platform angles may vary depending on the desired athletic positioning. In alternate implementations of this embodiment, the athletic positioning shape may omit one or both of the cups.

Figure 20:
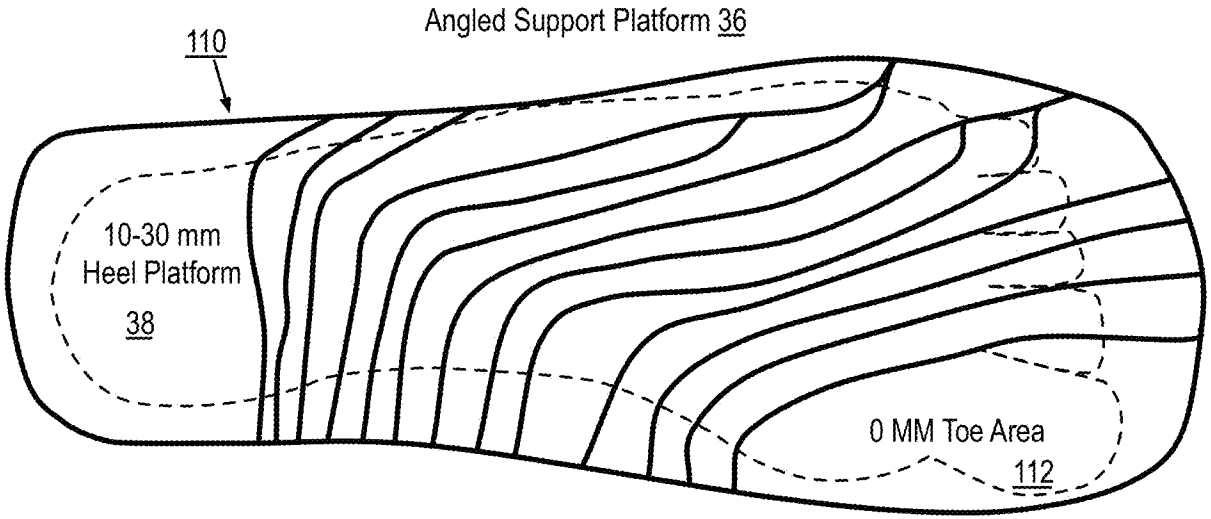
FIG. 20 illustrates a topographical diagram of another embodiment of an athletic positioning shape in accordance with the present invention.

FIG. 20 illustrates a topographical diagram 110 of another embodiment of an athletic positioning shape, which may be used in an insole 12 and/or sole 10 of a shoe. The athletic positioning shape further includes a heel platform 38, an angled support platform 36, and a toe area 112. With respect to the toe area 112, the heel platform 38 may be 10 to 30 mm higher and may have a shape corresponding to the heel of a shoe.

The angle support platform 36 includes a contoured shape that angles from the outer edge of the foot to the inner edge of the foot with a lesser slope along the outer edge of the shape than along the inner edge of the shape. The gradient at which the angled support platform angles may vary depending on the desired athletic positioning.

Figure 21:
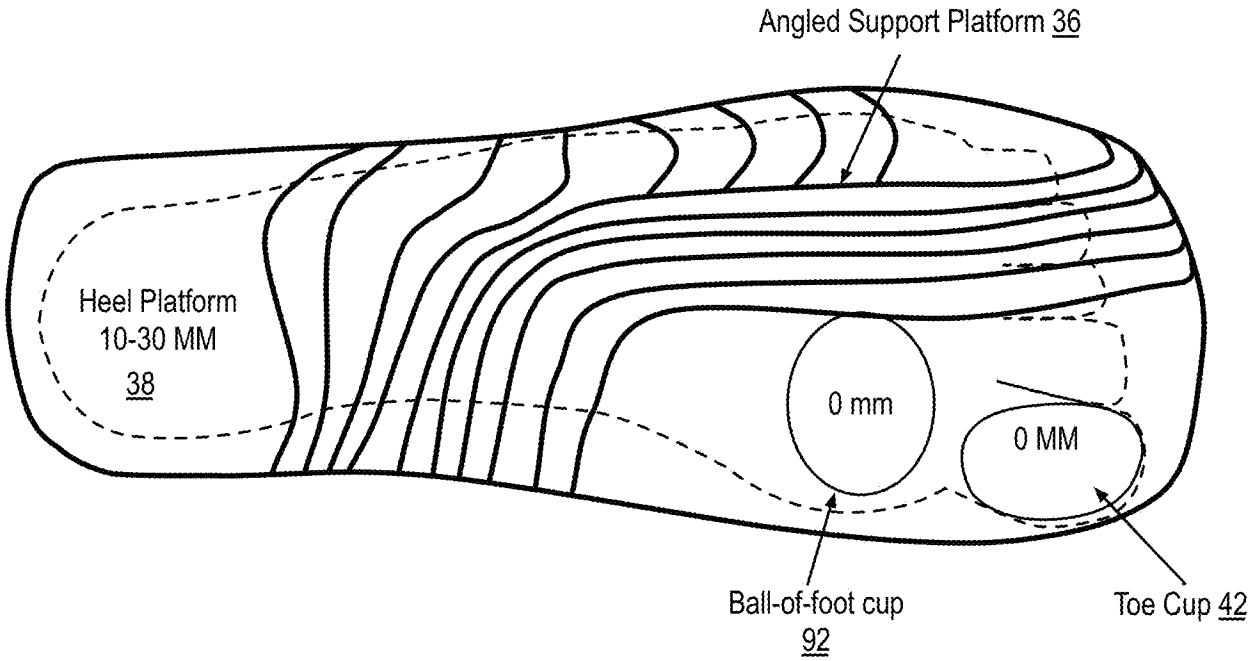
FIG. 21 illustrates a topographical diagram of another embodiment of an athletic positioning shape in accordance with the present invention.

FIG. 21 illustrates a topographical diagram of another embodiment of an athletic positioning shape, which may be used in an insole 12 and/or sole 10 of a shoe. The athletic positioning shape further includes a heel platform 38, an angled support platform 36, a toe cup 42, and/or a ball-of-foot cup 92. With respect to the toe cup and/or the ball-of-foot cup, the heel platform may be 10 to 30 mm higher and may have a shape corresponding to the heel of a shoe.

The angle support platform 36 includes a contoured shape that includes two angled sections. The first angled section is along the outer edge of the shape and slopes from the heel to the toe. The second angled section is from the first angled section to the inner edge of the shape and angles from the heel to the toe and from the outer edge to the inner edge. The gradient at which each of the angled section angles may vary depending on the desired athletic positioning.

Figure 22:
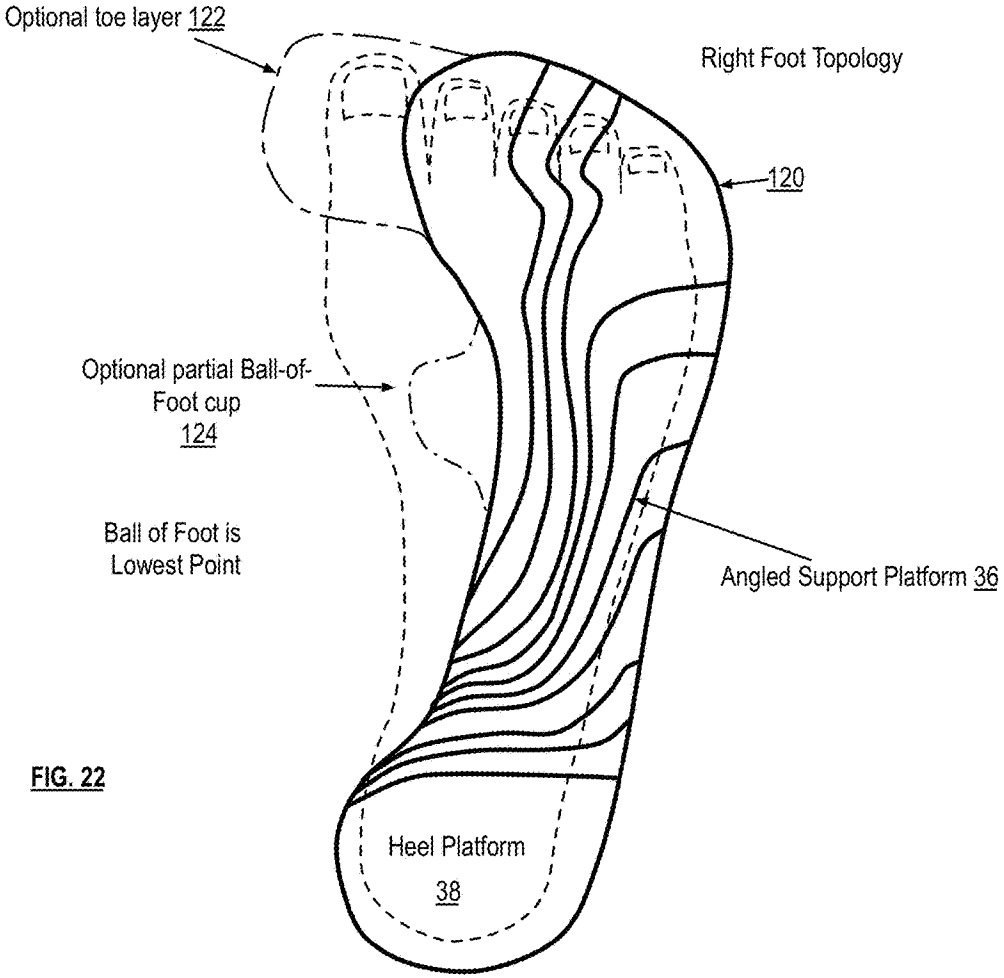
FIG. 22 illustrates a topographical diagram of another embodiment of an athletic positioning shape in accordance with the present invention.

FIG. 22 illustrates a topographical diagram 120 of another embodiment of an athletic positioning shape, which may be used in an insole 12 and/or sole 10 of a shoe. The athletic positioning shape further includes a heel platform 38 and an angled support platform 36. The athletic positioning shape may further include a toe layer 122 and/or a partial ball-of-foot cup layer 124. With respect to the big toe and/or ball of foot, the heel platform may be 10 to 30 mm higher and may have a shape corresponding to the heel of a shoe.

The angle support platform 36 includes a contoured shape that angles from the outer edge of the foot to the inner edge of the foot with a lesser slope along the outer edge of the shape than along the inner edge of the shape. The gradient at which the angled support platform angles may vary depending on the desired athletic positioning.

Figure 23:
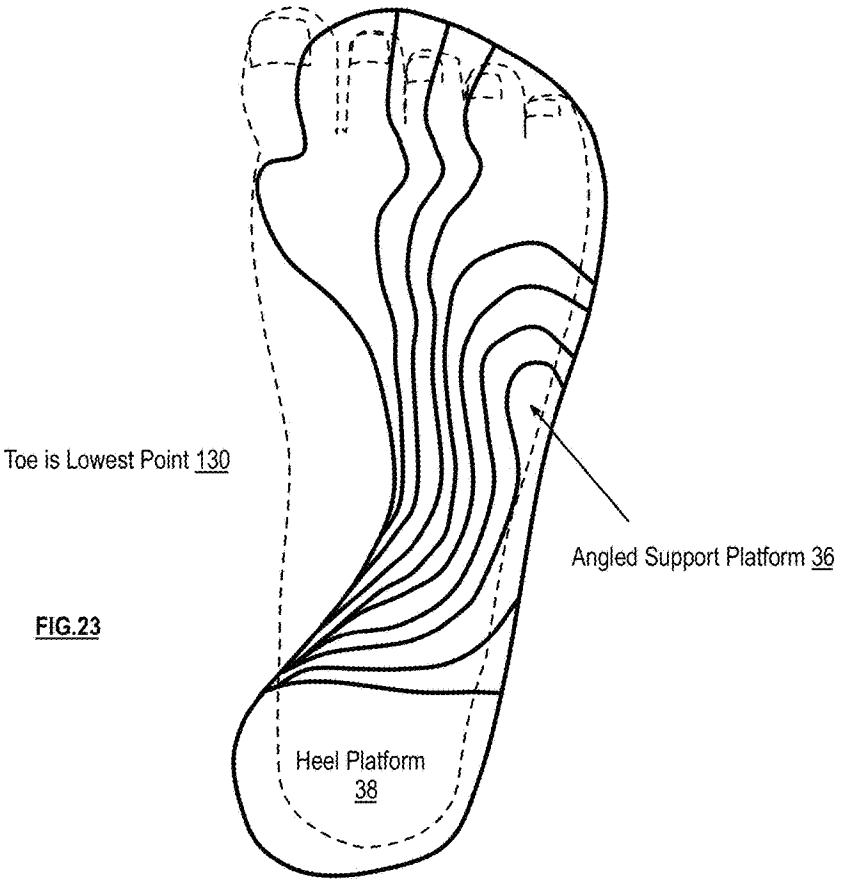
FIG. 23 illustrates a topographical diagram of another embodiment of an athletic positioning shape in accordance with the present invention.
Figure 24:
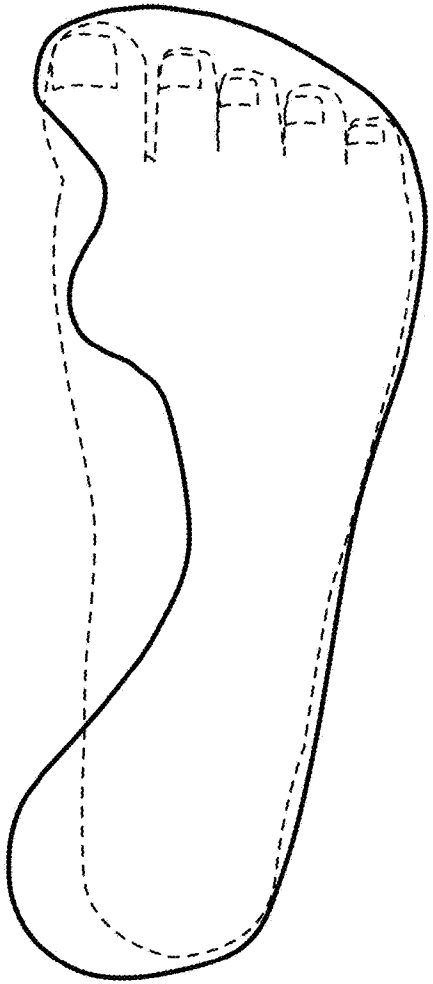
FIGS. 24-33 illustrate layers of another embodiment of an athletic positioning shape in accordance with the present invention.
Figure 25:
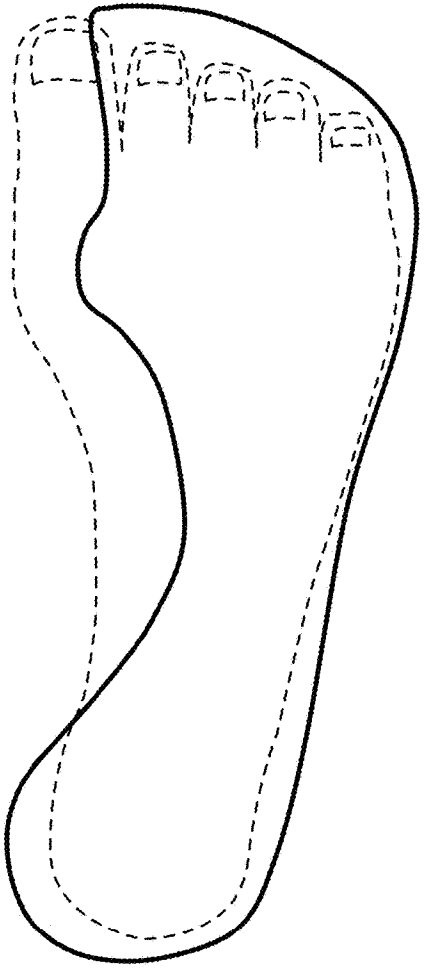
Figure 26:
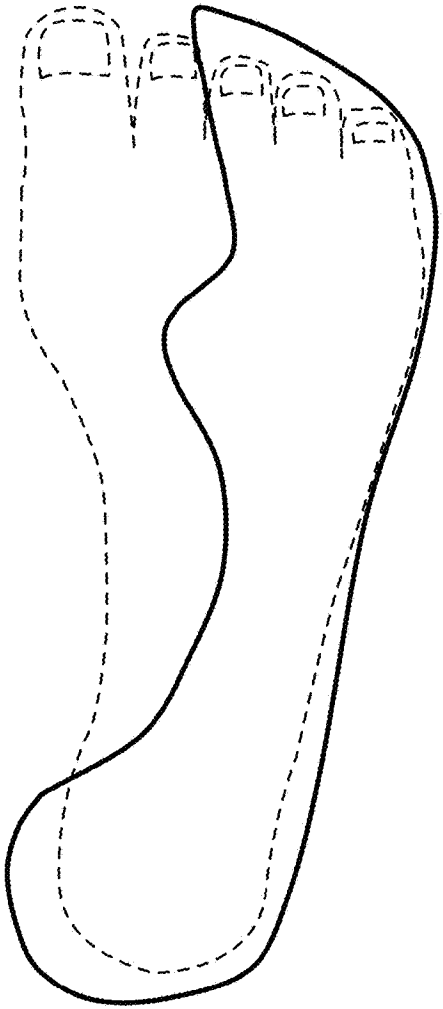
Figure 27:
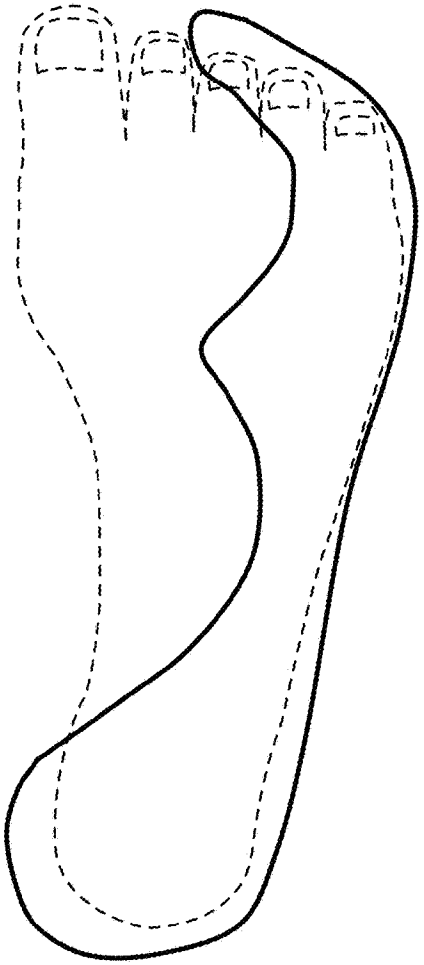
Figure 28:
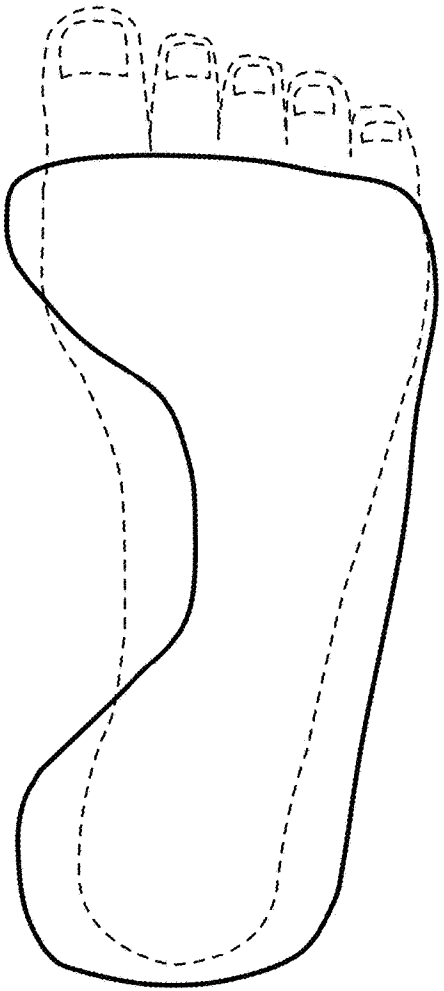
Figure 29:
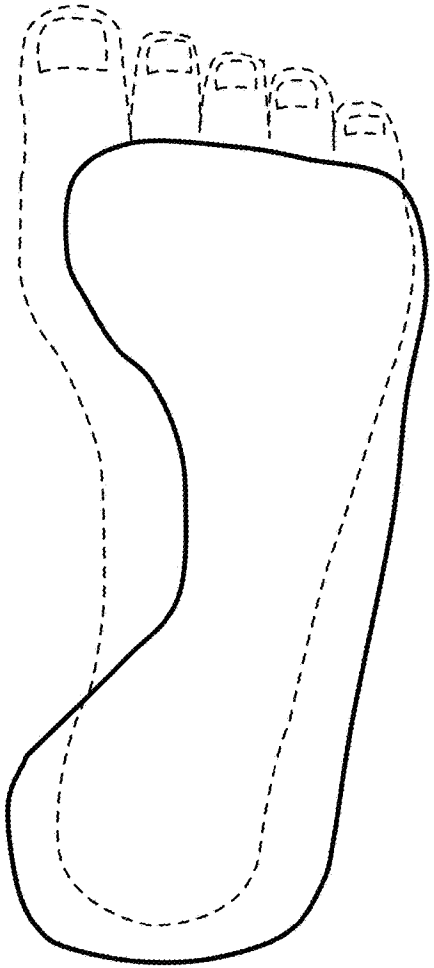
Figure 30:
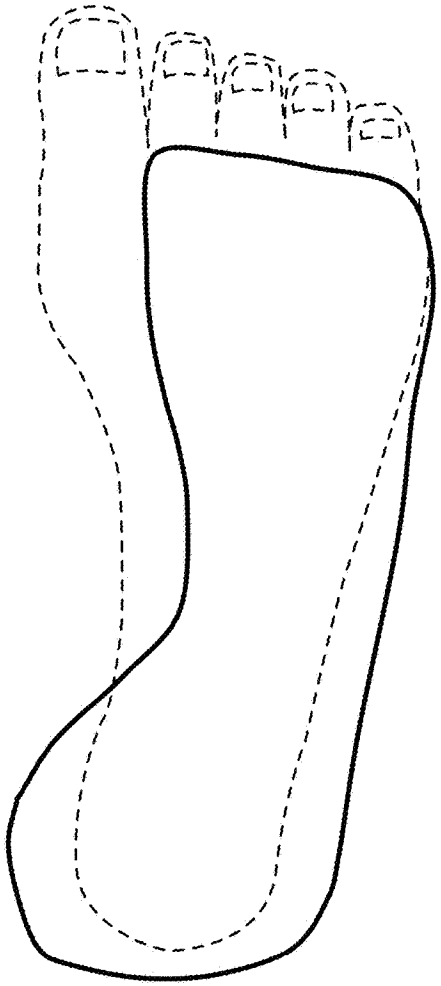
Figure 31:
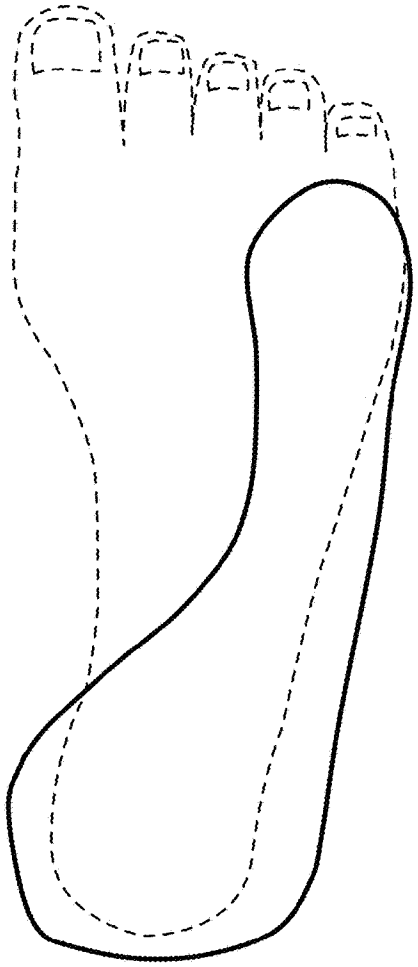
Figure 33:
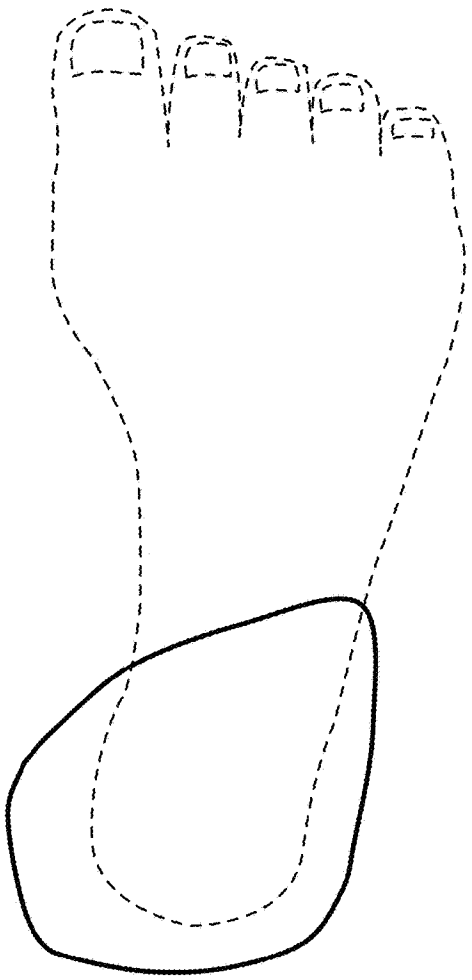
Figure 32:
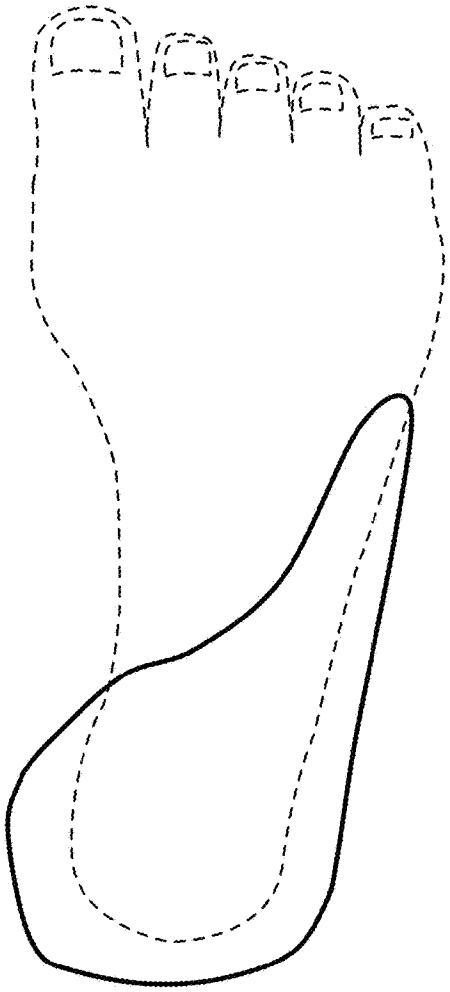

FIG. 23 illustrates a topographical diagram of another embodiment of an athletic positioning shape, which may be used in an insole 12 and/or sole 10 of a shoe. The athletic positioning shape further includes a heel platform 38 and an angled support platform 36 where the big toe is the lowest point 130. Alternatively, the athletic positioning shape may further include a toe layer and omit the layer under the inside ball-of-foot to allow the inside ball-of-foot to be the lowest point. With respect to the big toe and/or ball of foot, the heel platform 38 may be 10 to 30 mm higher and may have a shape corresponding to the heel of a shoe.

The angle support platform 36 includes a contoured shape that angles from the outer edge of the foot to the inner edge of the foot with a lesser slope along the outer edge of the shape than along the inner edge of the shape. The gradient at which the angled support platform angles may vary depending on the desired athletic positioning.

With the combination of heights and angles of the embodiments of FIGS. 19-23, the wearer of a shoe that incorporates an athletic positioning insole and/or sole having one of the athletic positioning shapes is placed in an athletic position, which may promote better athletic performance and/or which may promote better biomechanical body functioning. Note that a shoe, which incorporates one of the athletic positioning shapes of FIGS. 19-23, may further include arch support as a separate layer of the insole and/or integrated into the insole. Further note that one or more of the athletic positioning shapes may be used in a standalone athletic positioning insole product, in a standalone athletic positioning sole attachment, in a training shoe, and/or a sock.

FIGS. 24-33 illustrate layers of another embodiment of an athletic positioning shape for an insole 12 and/or a sole 10. Each layer may be of the same material (e.g., leather, rubber, foam, etc.), of a different material, or a combination thereof. For example, layers 1-4 may be of a rigid material (e.g., rubber, leather, plastic, carbon fiber, etc.) while layers 5-10 may be of a compressible material (e.g., foam, liquid material such as water, gel, etc.).

Figure 34:
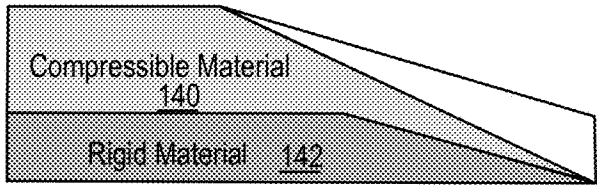
FIG. 34 illustrates a cross-sectional side view diagram of another embodiment of an athletic positioning sole and/or insole in accordance with the present invention.
Figure 35:
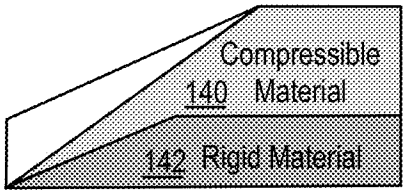
FIG. 35 illustrates a cross-sectional front view diagram of another embodiment of an athletic positioning sole and/or insole in accordance with the present invention.

FIGS. 34 and 35 illustrate a cross-sectional side view diagram and a cross-sectional front view diagram of another embodiment of an athletic positioning sole 10 and/or insole 12 that includes a compressible material section 140 and a rigid material section 142. In this embodiment, the compressible material section 140 is on top of the rigid material section 142 (i.e., closer to the foot). The compressible material section 140 includes one or more of the athletic positioning shapes and comprises a compressible material (e.g., foam, a soft rubber, memory foam, compressible housing that holds a liquid material (e.g., water, gel, etc.), and/or any other material that compresses under pressure and substantially returns to its uncompressed shape when the pressure is removed).

The rigid section 142 includes one or more the athletic positioning shapes, which may be the same one as used in the compressible material section 140 or different, and comprises a rigid material. The rigid material has minimal compression under pressure but allows for a desired level of flexion of the foot during use of the shoe. For example, the rigid material may be a rubber, a carbon fiber, leather, plastic, Polyurethane, any material that provides a rigid structure for the shoe, and/or a combination thereof.

Figure 36:
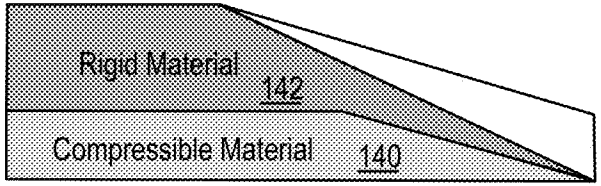
FIG. 36 illustrates a cross-sectional side view diagram of another embodiment of an athletic positioning sole and/or insole in accordance with the present invention.
Figure 37:
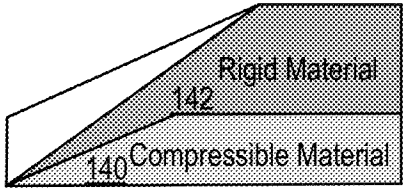
FIG. 37 illustrates a cross-sectional front view diagram of another embodiment of an athletic positioning sole and/or insole in accordance with the present invention.

FIGS. 36 and 37 illustrate a cross-sectional side view diagram and a cross-sectional front view diagram of another embodiment of an athletic positioning sole 10 and/or insole 12 that includes a compressible material section and a rigid material section. In this embodiment, the compressible material section 140 is under the rigid material section 142 (i.e., farther from the foot). The compressible material section 140 includes one or more of the athletic positioning shapes and comprises a compressible material (examples previously provided). The rigid section 142 includes one or more the athletic positioning shapes, which may be the same one as used in the compressible material section 140 or different, and comprises a rigid material. The rigid material has minimal compression under pressure but allows for a desired level of flexion of the foot during use of the shoe (examples previously provided).

Figure 38:
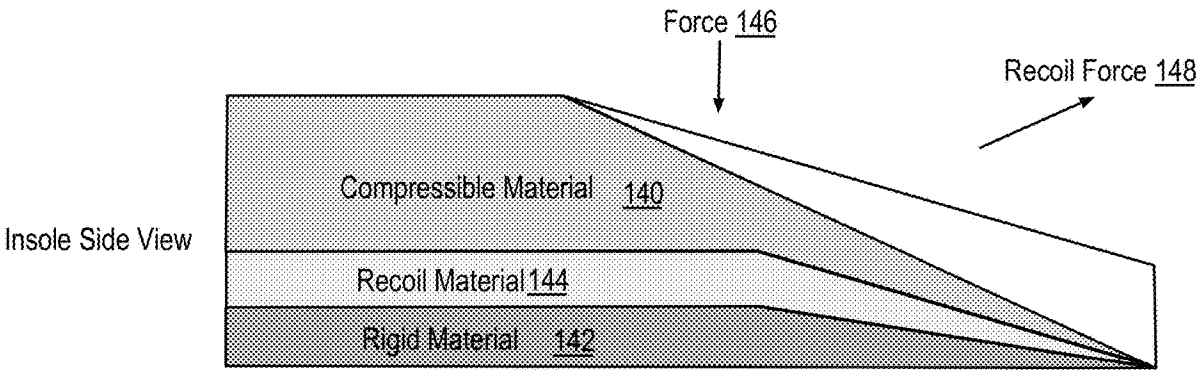
FIG. 38 illustrates a cross-sectional side view diagram of another embodiment of an athletic positioning sole and/or insole in accordance with the present invention.

FIG. 38 illustrates a cross-sectional side view diagram of another embodiment of an athletic positioning sole 10 and/or insole 12 that includes a compressible material section 140, a rigid material section 142, and a recoil material section 144. In this embodiment, the compressible material section is layered on top of the recoil material section 144, which is layered on top of the rigid material section 142. The compressible material section 140 includes one or more of the athletic positioning shapes and comprises a compressible material (examples previously provided). The rigid section includes one or more the athletic positioning shapes, which may be the same one as used in the compressible material section or different, and comprises a rigid material. The rigid material has minimal compression under pressure but allows for a desired level of flexion of the foot during use of the shoe (examples previously provided).

The recoil section 144 includes one or more the athletic positioning shapes, which may be the same as one of the ones used in the compressible material section 140 and/or on the rigid material section 142, or a different shape. The recoil section 144 comprises a recoil material that, when placed under a force 146, converts the force into a potential energy and, when the force is released, converts the potential energy into kinetic energy 148. In this manner, the force that is generated by pushing off in the shoe is used to propel the foot in a desired direction when the force is released. For example, when a pitcher loads his/her drive leg, a force is applied to the shoe. When the pitcher begins his/her motion and pushes off the rubber, the force is released and the recoil material section 144 applies a force to the foot in a direction toward home plate.

The recoil material 144 may be a series of springs embedded in the recoil material layer, may be a resilient rubber material, some other material that provides a recoil effect, and/or a combination thereof. In addition, the recoil material may be imbalanced such that the direction of the recoil force is between perpendicular and parallel to the foot force. For example, if the recoil material includes a series of springs, the springs along the outer edge of the shoe may have a greater recoil force than those on the inner edge of the shoe. As such, when the foot force is released, the springs on the outer edge of the shoe "push" harder than the springs on the inner edge of the shoe, thus creating a more horizontal force.

Figure 39:
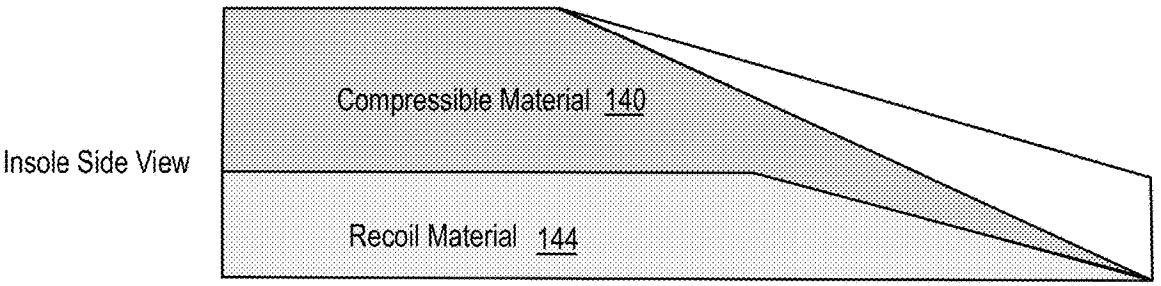
FIG. 39 illustrates a cross-sectional side view diagram of another embodiment of an athletic positioning sole and/or insole in accordance with the present invention.

FIG. 39 illustrates a cross-sectional side view diagram of another embodiment of an athletic positioning sole and/or insole that includes a compressible material section and a recoil material section. In this embodiment, the compressible material section is layered on top of the recoil material section. The compressible material section includes one or more of the athletic positioning shapes and comprises a compressible material (examples previously provided).

The recoil section includes one or more the athletic positioning shapes, which may be the same as the one used in the compressible material section or a different shape. The recoil section comprises a recoil material that, when placed under a force, converts the force into a potential energy and, when the force is released, converts the potential energy into kinetic energy.

Figure 40:
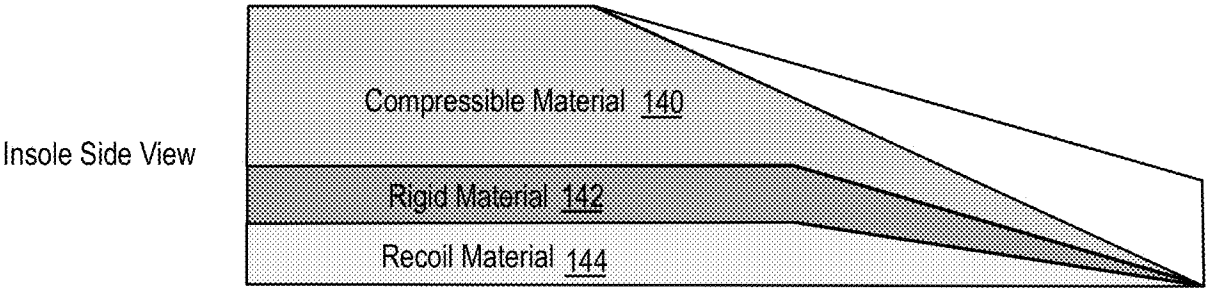
FIG. 40 illustrates a cross-sectional side view diagram of another embodiment of an athletic positioning sole and/or insole in accordance with the present invention.

FIG. 40 illustrates a cross-sectional side view diagram of another embodiment of an athletic positioning sole 10 and/or insole 12 that includes a compressible material section 140, a rigid material section 142, and a recoil material section 144. In this embodiment, the compressible material section 140 is layered on top of the rigid material section 142, which is layered on top of the recoil material section 144. The compressible material section 140 includes one or more of the athletic positioning shapes and comprises a compressible material (examples previously provided). The rigid section 142 includes one or more the athletic positioning shapes, which may be the same one as used in the compressible material section 140 or different, and comprises a rigid material. The rigid material 142 has minimal compression under pressure but allows for a desired level of flexion of the foot during use of the shoe (examples previously provided).

The recoil section 144 includes one or more the athletic positioning shapes, which may be the same as one of the ones used in the compressible material section 140 and/or on the rigid material section 142, or a different shape. The recoil section 144 comprises a recoil material that, when placed under a force, converts the force into a potential energy and, when the force is released, converts the potential energy into kinetic energy.

Figure 41:
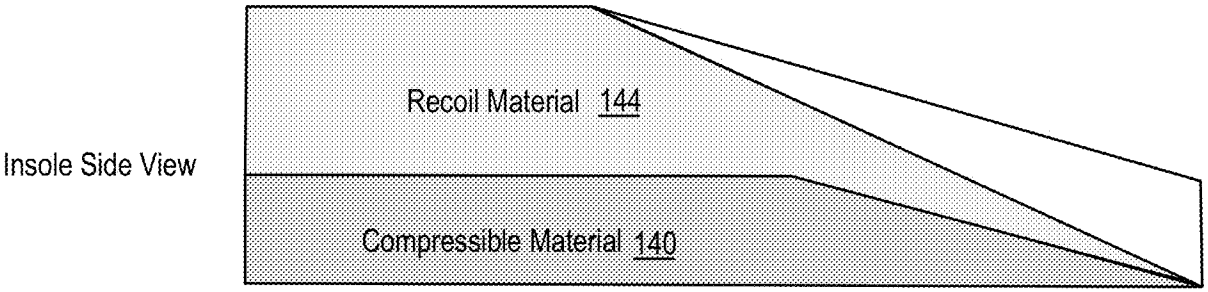
FIG. 41 illustrates a cross-sectional side view diagram of another embodiment of an athletic positioning sole and/or insole in accordance with the present invention.

FIG. 41 illustrates a cross-sectional side view diagram of another embodiment of an athletic positioning sole 10 and/or insole 12 that includes a compressible material section 140 and a recoil material section 144. In this embodiment, the compressible material section 140 is layered below the recoil material section 144. The compressible material section 140 includes one or more of the athletic positioning shapes and comprises a compressible material (examples previously provided).

The recoil section 144 includes one or more the athletic positioning shapes, which may be the same as the one used in the compressible material section 140 or a different shape. The recoil section 144 comprises a recoil material that, when placed under a force, converts the force into a potential energy and, when the force is released, converts the potential energy into kinetic energy.

Figure 42:
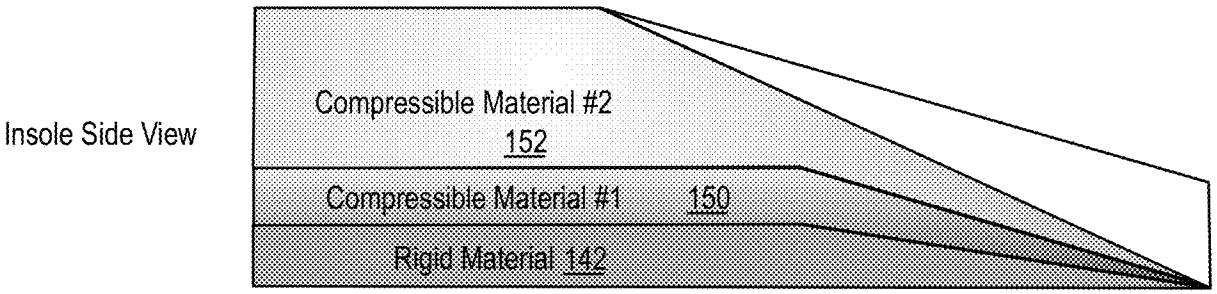
FIG. 42 illustrates a cross-sectional side view diagram of another embodiment of an athletic positioning sole and/or insole in accordance with the present invention.

FIG. 42 illustrates a cross-sectional side view diagram of another embodiment of an athletic positioning sole 10 and/or insole 12 that includes a first compressible material section 150, a second compressible material section 152, and a rigid material section 142. In this embodiment, the second compressible material section 152 is layered above the first compressible material section 150, which is layered above the rigid material section 142. The first compressible material section 150 includes one or more of the athletic positioning shapes and comprises a first compressible material. The second compressible material section 152 includes one or more of the athletic positioning shapes and comprises a second compressible material. For example, the first compressible material may comprise a flexible housing containing a gel and the second compressible material may comprise a memory foam.

The rigid section 142 includes one or more the athletic positioning shapes, which may be the same as one of the ones used in the first or second compressible material sections or different. The rigid section 142 comprises a rigid material, which has minimal compression under pressure but allows for a desired level of flexion of the foot during use of the shoe.

Figure 43:
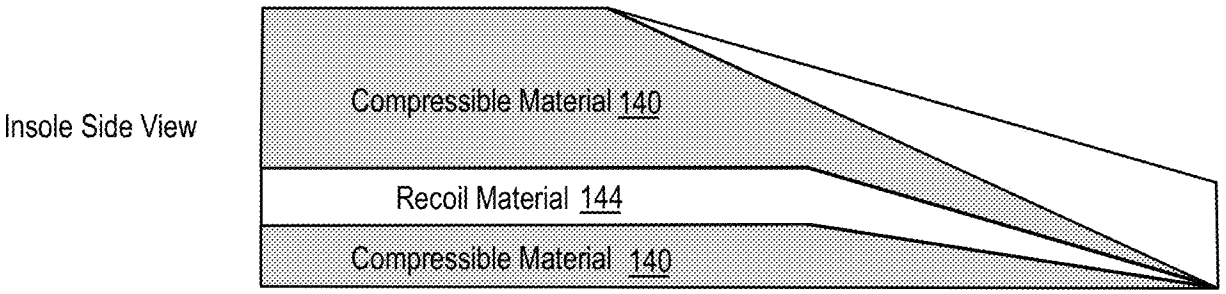
FIG. 43 illustrates a cross-sectional side view diagram of another embodiment of an athletic positioning sole and/or insole in accordance with the present invention.

FIG. 43 illustrates a cross-sectional side view diagram of another embodiment of an athletic positioning sole 10 and/or insole 12 that includes a first compressible material section 150, a second compressible material section 152, and a recoil material section 144. In this embodiment, the first compressible material section 150 is layered above the recoil material section 144, which is layered above the second compressible material section 152. The first compressible material section 150 includes one or more of the athletic positioning shapes and comprises a first compressible material. The second compressible material section 152 includes one or more of the athletic positioning shapes and comprises a second compressible material. For example, the first compressible material may be more compressible material than that of the second compressible material.

The recoil section 144 includes one or more the athletic positioning shapes, which may be the same as the one of the ones used in the first or second compressible material sections or different. The recoil section 144 comprises a recoil material that, when placed under a force, converts the force into a potential energy and, when the force is released, converts the potential energy into kinetic energy.

Figure 44:
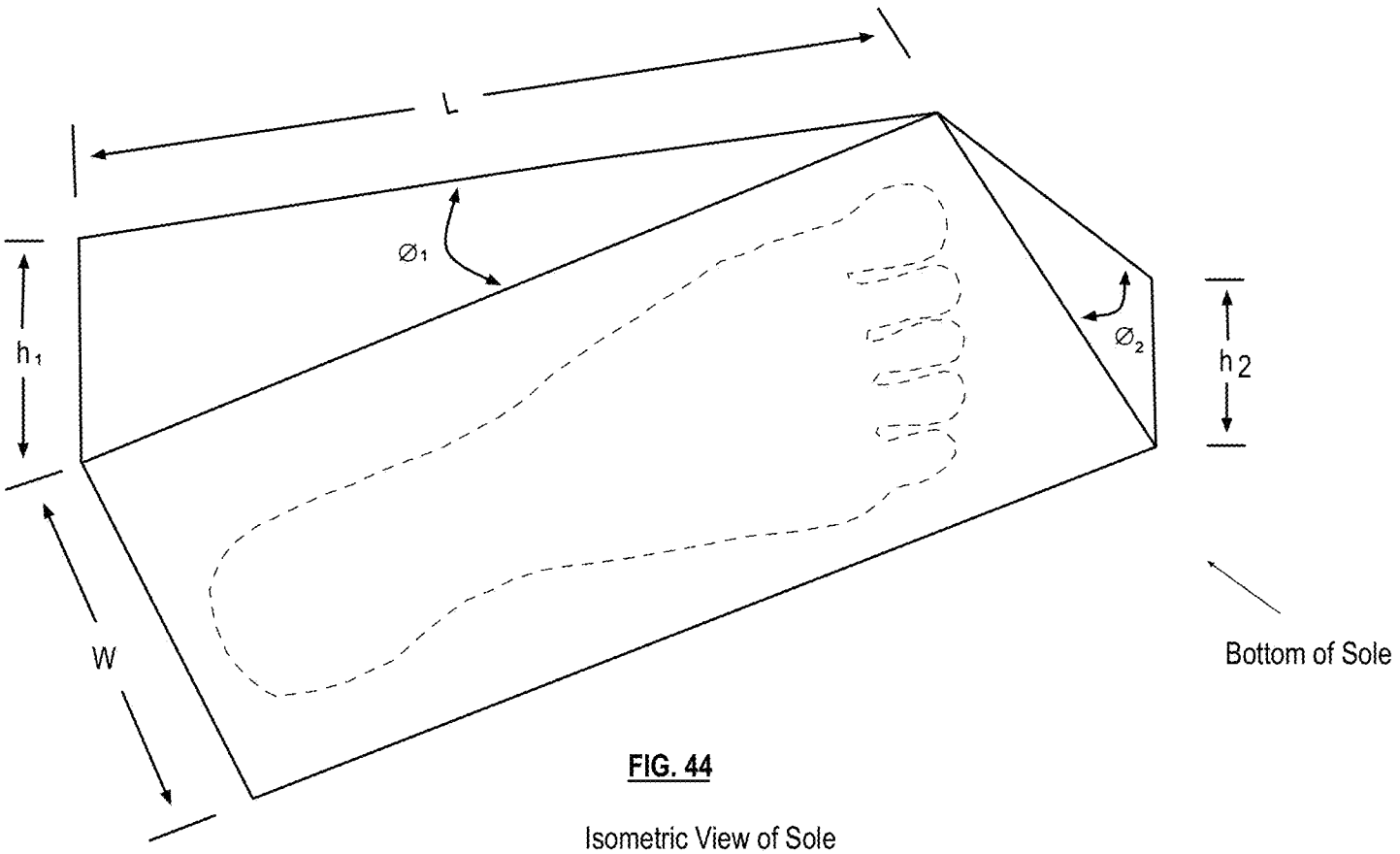
FIG. 44 illustrates an isometric diagram of an embodiment of an athletic positioning sole in accordance with the present invention.

FIG. 44 illustrates an isometric diagram of an embodiment of an athletic positioning sole that includes an overall geometric shape that corresponds to the shape of a shoe, but is shown in block form for ease of illustration. As shown, the heel of the sole has a particular height (e.g., h1, which may be 1's to 10's of mm) that slopes at an angle (e.g., Ø1) to the toe on the inside edge of the sole. The inside edge of the sole at the toe section 25 may have a height of zero to a few millimeters with respect to the insole of the shoe.

As also shown, the athletic positioning sole includes a second height (e.g., h2) at the outer edge of the sole at the toe section, which tapers at an angle (e.g., Ø2) to the inside edge of the sole. Accordingly, a third angle exists from the heel to the toe section 25 on the outer edge of the sole.

Figure 45:
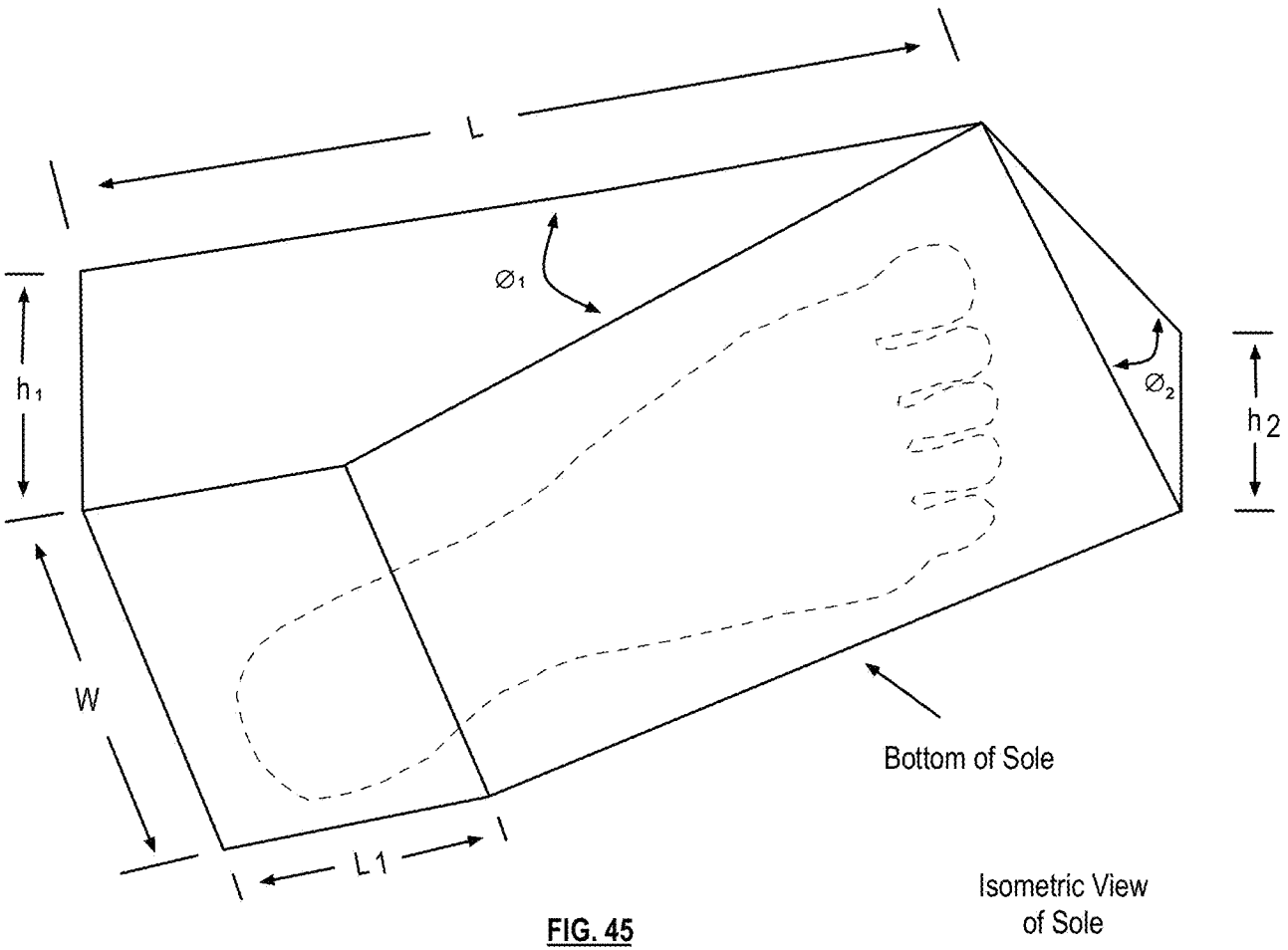
FIG. 45 illustrates an isometric diagram of another embodiment of an athletic positioning sole in accordance with the present invention.

FIG. 45 illustrates an isometric diagram of another embodiment of an athletic positioning sole that includes an overall geometric shape that corresponds to the shape of a shoe, but is shown in block form for ease of illustration. The athletic positioning sole further includes a heel platform and an angled support platform. The heel platform includes a height (h1), a length (L1), and a width (w).

The angled support platform includes a length (L—heel platform length), the width (w), a first height (h1), a second height (h2), an inner toe section height (e.g., 0 to a few mm), a first angle (e.g., Ø1) from the heel platform to the toe on the inside edge of the shoe, a second angle (e.g., Ø2) from the outer edge of the shoe to the inside edge of the shoe, and a third angle from the heel platform 38 to the toe section 25 on the outer edge of the shoe.

Figure 46:
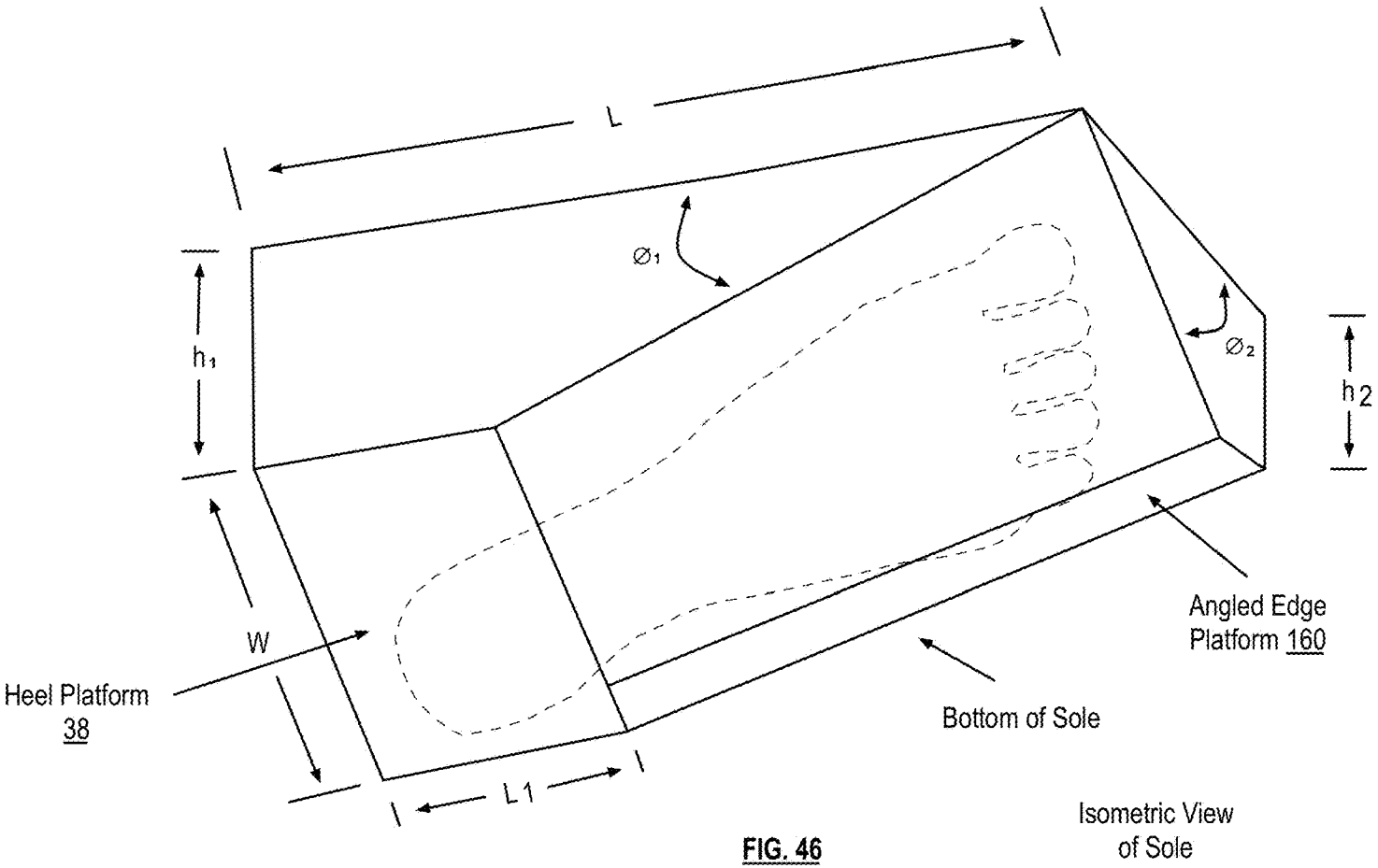
FIG. 46 illustrates an isometric diagram of another embodiment of an athletic positioning sole in accordance with the present invention.

FIG. 46 illustrates an isometric diagram of another embodiment of an athletic positioning sole that includes an overall geometric shape that corresponds to the shape of a shoe, but is shown in block form for ease of illustration. The athletic positioning sole further includes a heel platform 38, an angled support platform 36, and an angled edge platform 160. The heel platform includes a height (h1), a width (w), and a length.

The angled support platform 36 includes a length (L—heel length), a first width (w—width of the angled edge platform), a first height (h1), a second height (h2), a first angle (e.g., Ø1) from the heel platform 38 to the toe on the outside edge of the shoe, and a second angle (e.g., Ø2) from the outer edge of the shoe to the edge of the toe area. The angled edge platform includes a length (L—heel length), a first width (w—width of the angled support platform), a first height (h1), a second height (h2), and a first angle (e.g., Ø1) from the heel platform to the toe on the outside edge of the shoe.

Figure 47:
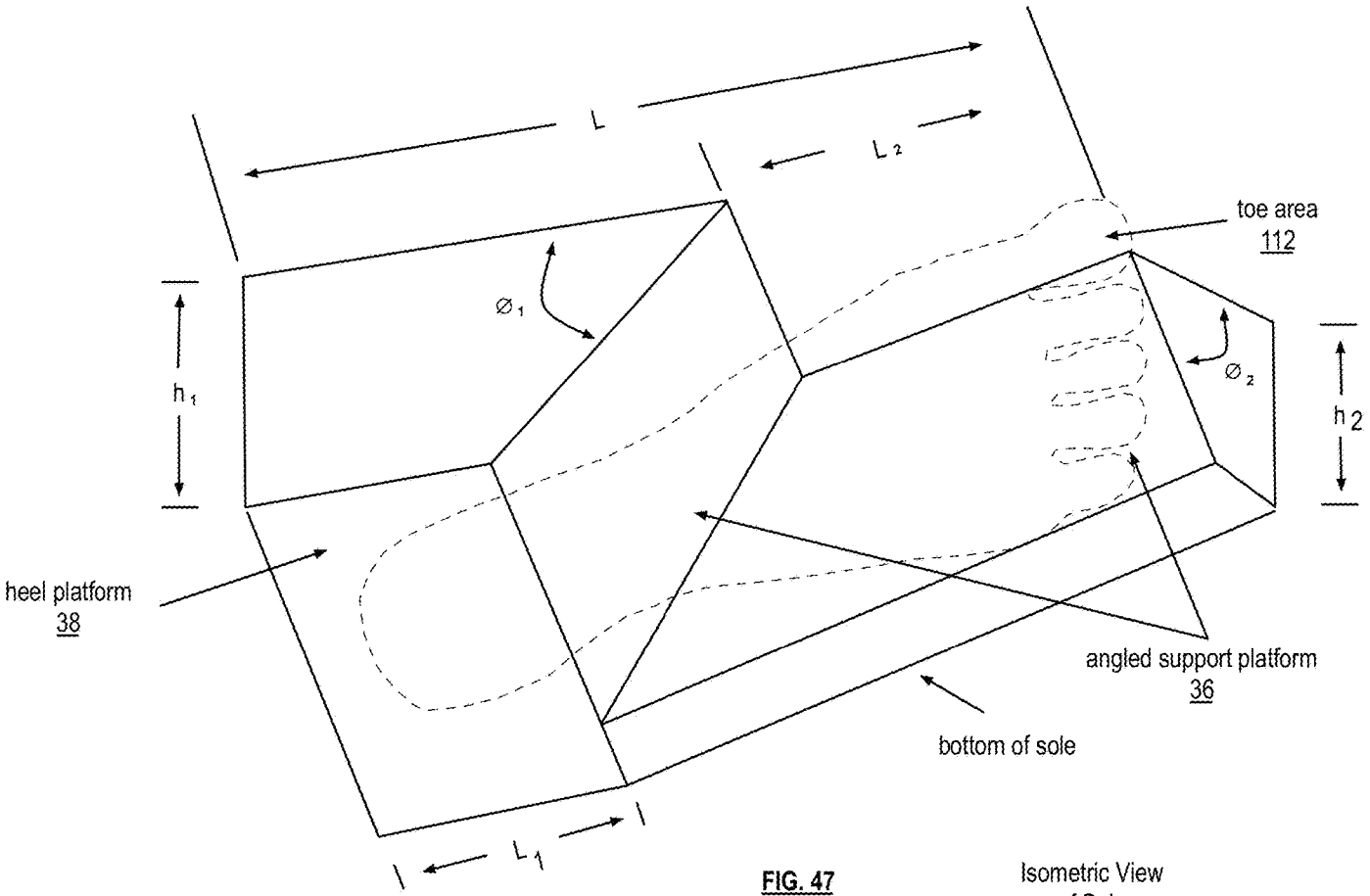
FIG. 47 illustrates an isometric diagram of another embodiment of an athletic positioning sole in accordance with the present invention.
Figure 51:
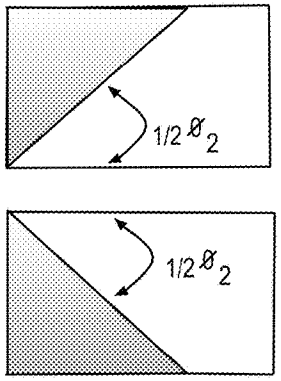
FIG. 51 illustrates a cross-sectional front view diagram of an embodiment of an athletic positioning sole and an athletic positioning insole in accordance with the present invention.
Figure 48:
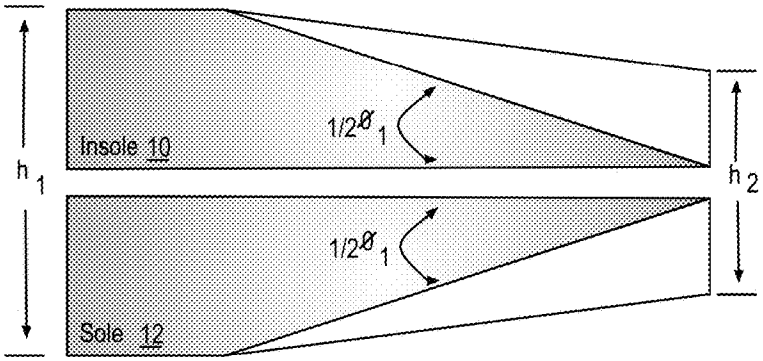
FIG. 48 illustrates a cross-sectional side view diagram of an embodiment of an athletic positioning sole and an athletic positioning insole in accordance with the present invention.
Figure 49:
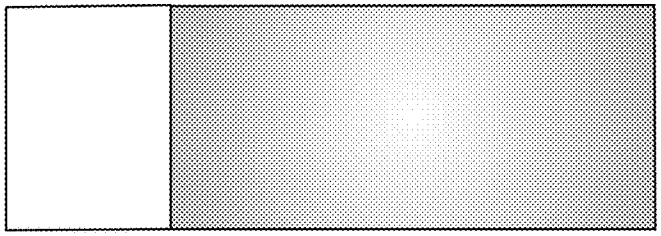
FIG. 49 illustrates a top view diagram of an embodiment of an athletic positioning sole and an athletic positioning insole in accordance with the present invention.
Figure 50:
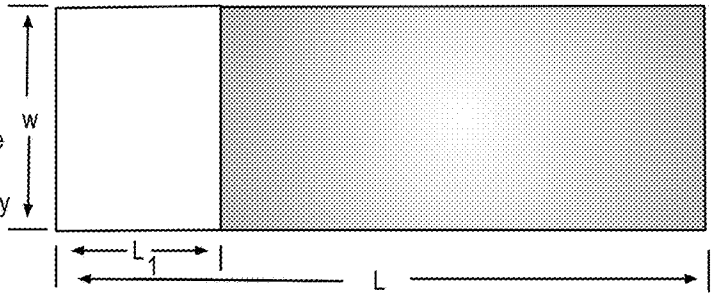
FIG. 50 illustrates a bottom view diagram of an embodiment of an athletic positioning sole and an athletic positioning insole in accordance with the present invention.

FIG. 47 illustrates an isometric diagram of another embodiment of an athletic positioning sole that includes an overall geometric shape that corresponds to the shape of a shoe, but is shown in block form for ease of illustration. The athletic positioning sole further includes a heel platform 38, an angled support platform 36, and a ball-of-foot/toe area 112. The heel platform 38 includes a height (h1), a width (w), and a length (L1).

The angled support platform 36 includes a length (L-L1), a first width (w), a second width corresponding to the toe area (w-width of toe area), a first height (h1), a second height (h2), a first angle (e.g., Ø1) from the heel platform 38 to the toe on the outside edge of the shoe, a second angle (e.g., Ø2) from the outer edge of the shoe to the edge of the toe area, and a third angle (e.g., Ø3) from the heel platform 38 to the toe area 112 on the inner edge of the shoe. For each of the athletic positioning soles of FIGS. 44-47, the surface on which the specific sole pattern lies, the angles, and the perimeter lines are shown as straight lines and/or flat surfaces; however, they may be contoured lines and/or angles, contoured surfaces, contour slopes, concave and/or convex slopes and/or surfaces, and/or a combination thereof to provide a more comfortable and/or custom fit. In addition, each of the athletic positioning soles of FIGS. 44-47 may be flipped such that the angled surface is coupled to the shoe and the other side is coupled to a specific sole pattern (e.g., basketball, tennis, baseball, football, dress shoe, casual shoe, cross-training, etc.). In either implementation of coupling the athletic positioning sole to the remainder of the shoe, the wearer of the shoe is placed in an athletic position that may promote better athletic performance.

FIGS. 48-51 illustrates a cross-sectional side view diagram, a top view diagram, a bottom view diagram, and a cross-sectional front view diagram of an embodiment of an athletic positioning sole 10 and an athletic positioning insole 12. The athletic positioning insole may have one of the athletic positioning shapes and may be comprised of a compressible material 140, a recoil material 144, and/or a rigid material 142. Similarly, the athletic positioning sole may have one of the athletic positioning shapes and may be comprised of a compressible material, a recoil material, and/or a rigid material.

In this embodiment, the combination of the sole and the insole provide the overall athletic positioning shape for a shoe. For example, the heel height of the combined insole and sole is h1, which may be 10-30 mm or more, and the outer edge toe height of the combined insole and sole is h2, which may be 5-15 mm. In the present example, the sole and the insole contribute equally to the heights (h1 and h2); however the ratio of may range from 50/50 to 90/10 to 10/90 (insole/sole).

The heel-to-toe angles (e.g., Ø1 for inner edge and Ø3 for outer edge) are provided by a combination of the heel to toe angles of each of the insole and the sole. In the present example, the sole 10 and the insole 12 contribute equally to the heel-to-toe angles (Ø1 and Ø3); however the ratio of may range from 50/50 to 90/10 to 10/90 (insole/sole). Similarly, the insole 12 and sole 10 are shown to equally contribute to the outer edge to inner edge angle (e.g., Ø2), however the ratio of may range from 50/50 to 90/10 to 10/90 (insole/sole).

Figure 52:
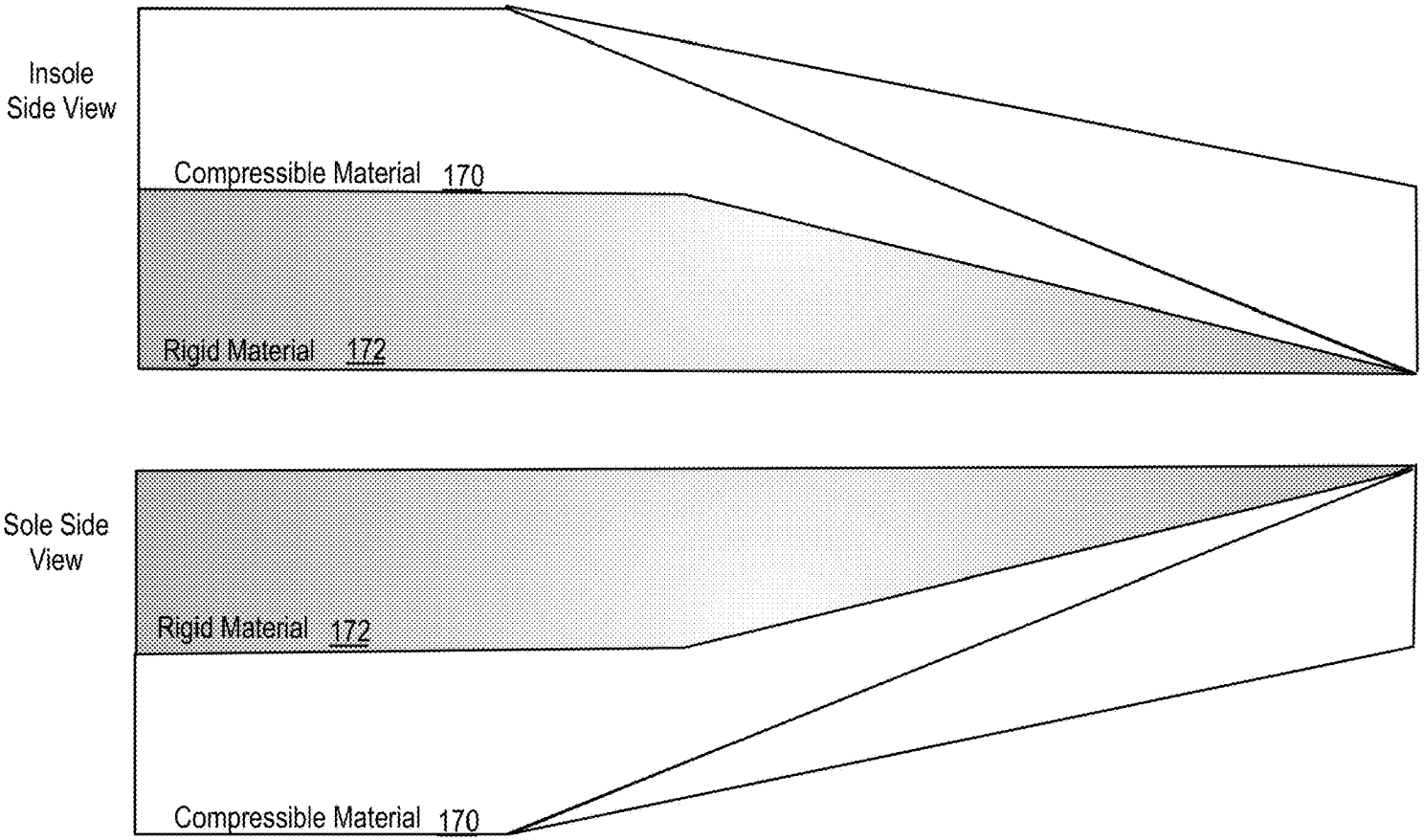
FIG. 52 illustrates a cross-sectional side view diagram of another embodiment of an athletic positioning sole and an athletic positioning insole in accordance with the present invention.

FIG. 52 illustrates a cross-sectional side view diagram of another embodiment of an athletic positioning sole and an athletic positioning insole. The athletic positioning insole may have one of the athletic positioning shapes and may be comprised of one or more compressible materials 170 and/or of one or more rigid materials 172. The athletic positioning sole may have one of the athletic positioning shapes and may be comprised of one or more compressible materials 170 and/or of one or more rigid materials 172. For example, the rigid material 172 may be a rubber, carbon fiber, and/or plastic that is/are traditionally used for athletic shoe soles and the compressible material 170 may be memory foam, foam, and/or a gel that is/are traditionally used for athletic shoe insoles.

Figure 53:
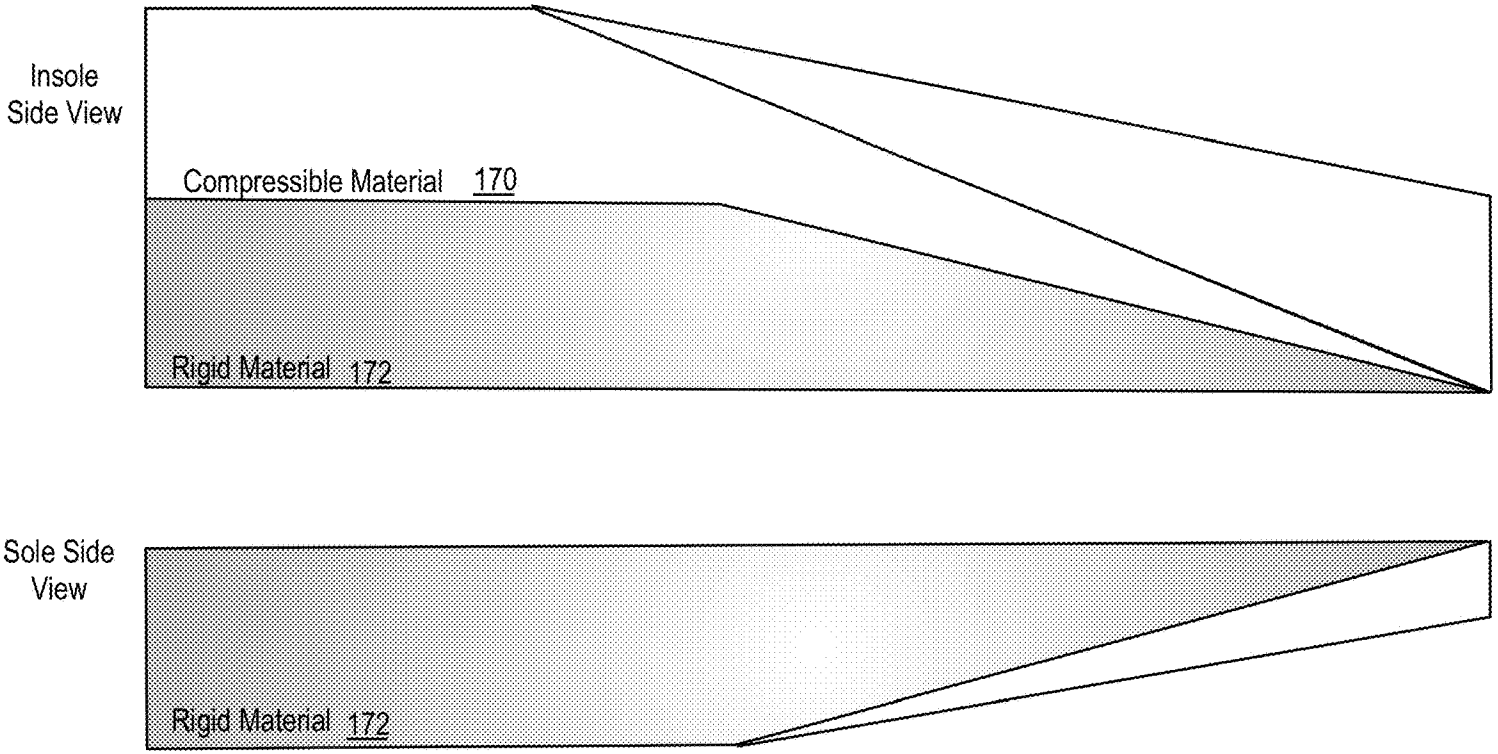
FIG. 53 illustrates a cross-sectional side view diagram of another embodiment of an athletic positioning sole and an athletic positioning insole in accordance with the present invention.

FIG. 53 illustrates a cross-sectional side view diagram of another embodiment of an athletic positioning sole and an athletic positioning insole. The athletic positioning insole may have one of the athletic positioning shapes and may be comprised of one or more compressible materials 170 and/or of one or more rigid materials 172. The athletic positioning sole may have one of the athletic positioning shapes and may be comprised of one or more rigid materials 172.

Figure 54:
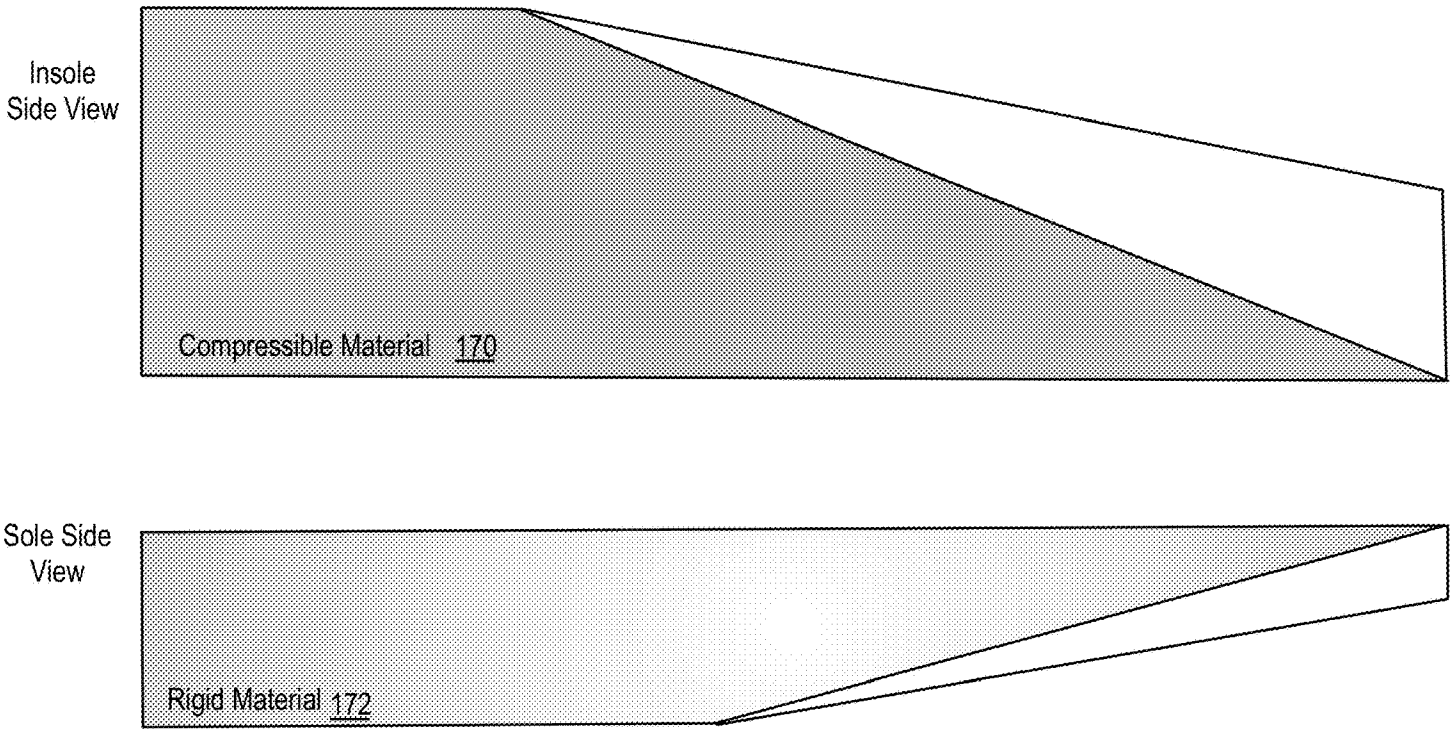
FIG. 54 illustrates a cross-sectional side view diagram of another embodiment of an athletic positioning sole and an athletic positioning insole in accordance with the present invention.
Figure 58:
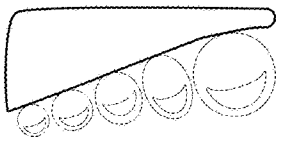
FIG. 58 illustrates a cross-sectional front view diagram of another embodiment of an athletic positioning insole in accordance with the present invention.
Figure 56:
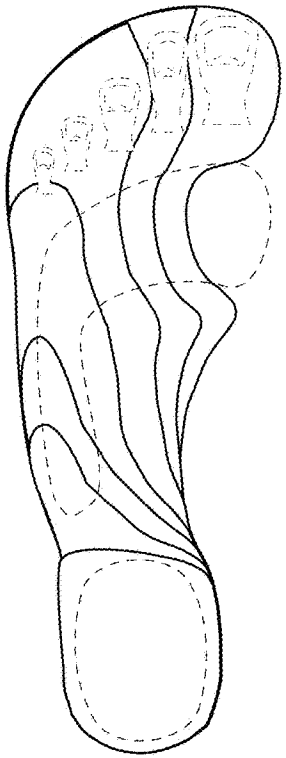
FIG. 56 illustrates a top view diagram of another embodiment of an athletic positioning insole in accordance with the present invention.
Figure 57:
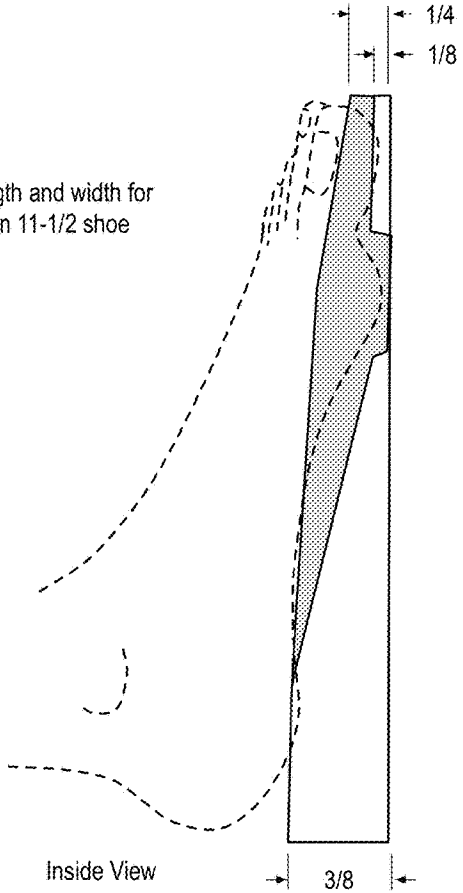
FIG. 57 illustrates a cross-sectional inside view diagram of another embodiment of an athletic positioning insole in accordance with the present invention.
Figure 55:
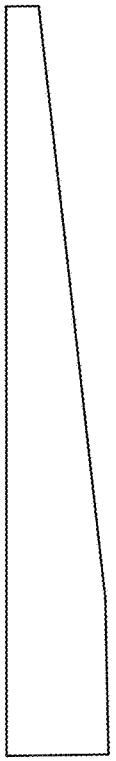
FIG. 55 illustrates a cross-sectional outside view diagram of another embodiment of an athletic positioning insole in accordance with the present invention.
Figures 59, 60, 61, 62:
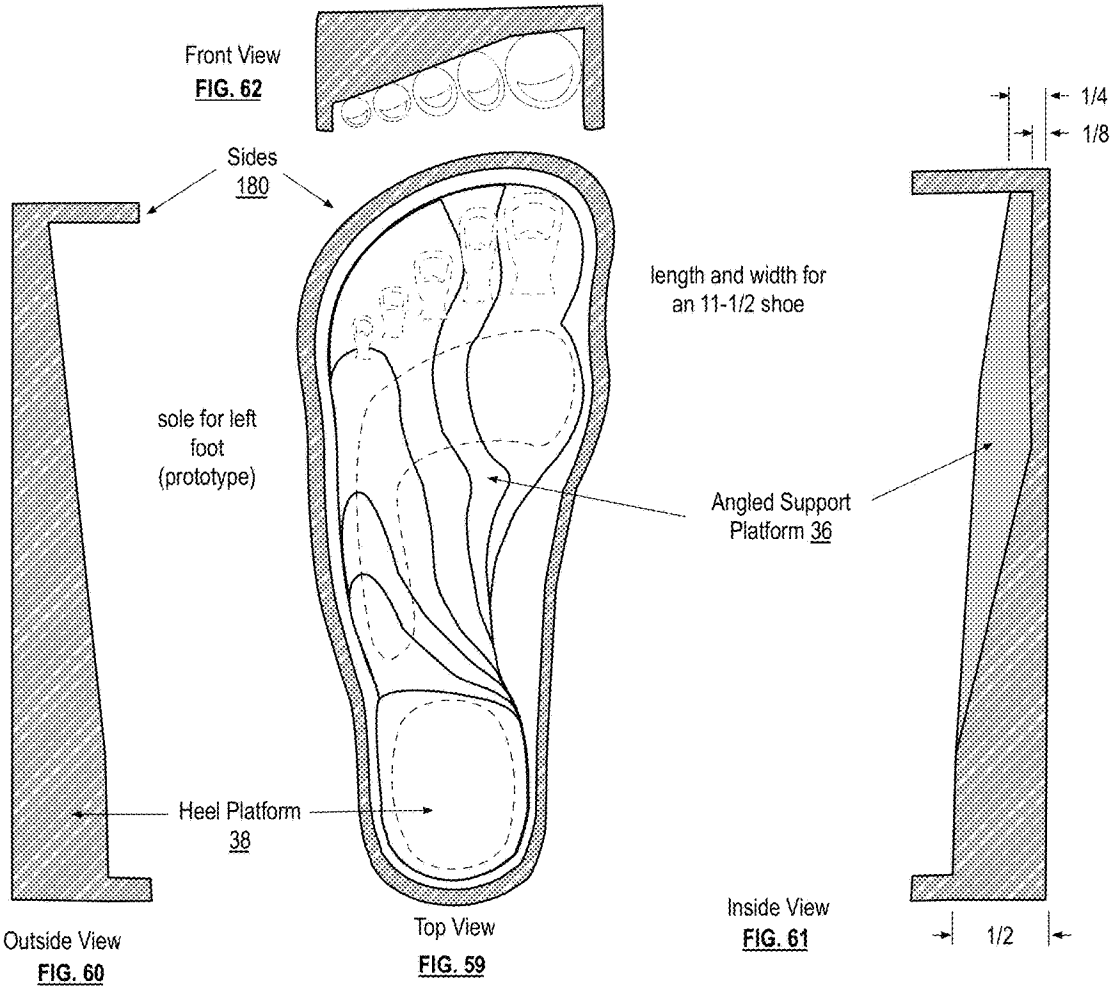
FIG. 59 illustrates a top view diagram of another embodiment of an athletic positioning sole in accordance with the present invention.
FIG. 60 illustrates a cross-sectional outside view diagram of another embodiment of an athletic positioning sole in accordance with the present invention.
FIG. 61 illustrates a cross-sectional inside view diagram of another embodiment of an athletic positioning sole in accordance with the present invention.
FIG. 62 illustrates a cross-sectional front view diagram of another embodiment of an athletic positioning sole in accordance with the present invention.

FIG. 54 illustrates a cross-sectional side view diagram of another embodiment of an athletic positioning sole and an athletic positioning insole. The athletic positioning insole may have one of the athletic positioning shapes and may be comprised of one or more compressible materials 170. The athletic positioning sole may have one of the athletic positioning shapes and may be comprised of one or more rigid materials 172. For example, the sole may be comprised of a rubber, carbon fiber, and/or plastic that is/are traditionally used for athletic shoe soles and the insole may be comprised of memory foam, foam, and/or a gel that is/are traditionally used for athletic shoe insoles.

For each of the athletic positioning soles of FIGS. 48-54, the angled surfaces of the sole and/or insole, the angles, and the perimeter lines are shown as straight lines and/or flat surfaces; however, they may be contoured lines and/or angles, contoured surfaces, contour slopes, concave and/or convex slopes and/or surfaces, and/or a combination thereof to provide a more comfortable and/or custom fit. In addition, the athletic positioning soles of FIGS. 48-54 may be flipped such that the angled surface is coupled to the shoe and the other side is coupled to a specific sole pattern (e.g., basketball, tennis, baseball, football, dress shoe, casual shoe, cross-training, etc.). In either implementation of coupling the athletic positioning sole to the remainder of the shoe, the wearer of the shoe is placed in an athletic position that may promote better athletic performance.

FIGS. 55-58 illustrate a cross-sectional outside view diagram, a top view diagram, a cross-sectional inside view diagram, and a cross-sectional front view diagram of a specific embodiment of an athletic positioning insole. The insole includes a heel platform, an angled support platform, and a partial ball-of-foot cup. The insole may have one of the athletic positioning shapes and is comprised of one or more compressible materials. For a given athletic positioning shape, the height of the heel section 21 is ⅜ inch and the length and width of the insole correspond to an 11½ size man's shoe (which can be adjusted for any shoe size). The big toe section is ⅛ inch thick and the little toe section is ¼ inch thick. The angles are based on the dimensions of the lengths, widths, and heights of the insole, where the dimensions may be for a pre-compressed condition or a compressed condition.

FIGS. 59-62 illustrate a top view diagram, a cross-sectional outside view diagram, a cross-sectional inside view diagram, and a cross-sectional front view diagram of a specific embodiment of an athletic positioning sole. The sole includes a heel platform 38, an angled support platform 36, and an upper shoe connecting sides 180. The sole may have one of the athletic positioning shapes and is comprised of one or more rigid materials 172 and/or compressible materials 170. For a given athletic positioning shape, the height of the heel section 21 is ½ inch and the length and width of the sole correspond to an 11½ size man's shoe (which can be adjusted for any shoe size). The big toe section is ⅛ inch thick and the little toe section is ¼ inch thick. The angles are based on the dimensions of the lengths, widths, and heights of the insole, where the dimensions may be for a pre-compressed condition or a compressed condition. The sizing of the sides may vary depending on the connecting mechanism (e.g., stitch, glue, stable, fuse, etc.) to the upper shoe section.

Figure 63:
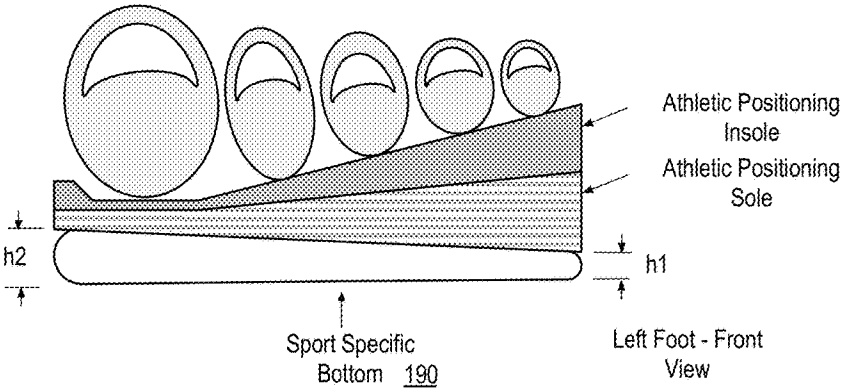
FIG. 63 illustrates a cross-sectional front view diagram of another embodiment of an athletic positioning sole and/or insole with compensating sport specific bottom in accordance with the present invention.
Figure 64:
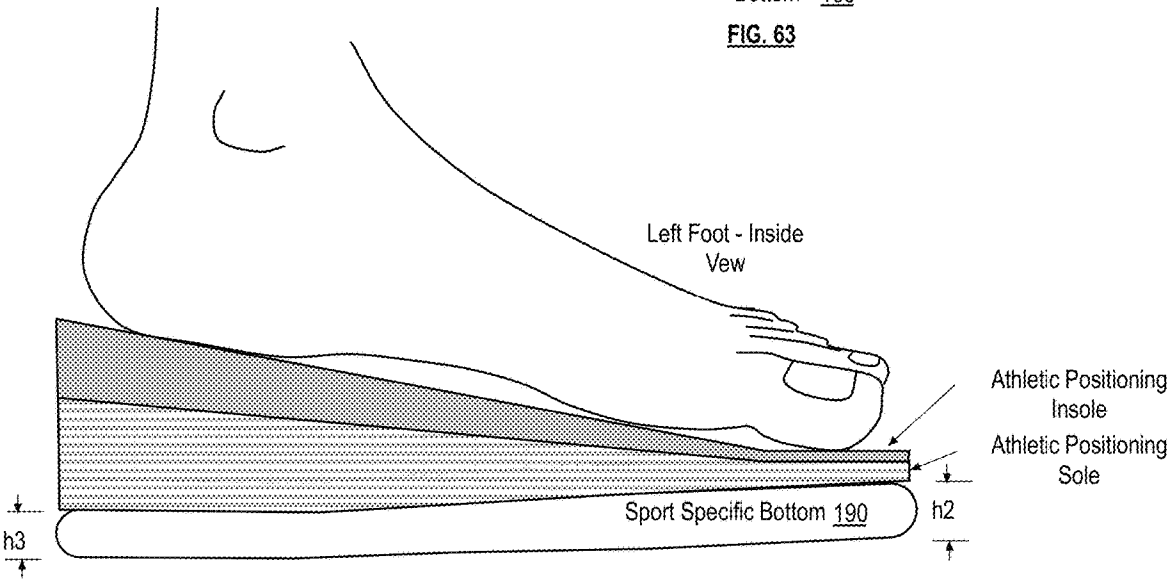
FIG. 64 illustrates a cross-sectional side view diagram of another embodiment of an athletic positioning sole and/or insole with compensating sport specific bottom in accordance with the present invention.

FIGS. 63-64 illustrate a cross-sectional front view diagram and a cross-sectional inside view diagram of another embodiment of an athletic positioning sole 10 and/or insole 12 with compensating sport specific bottom 190. The athletic positioning insole may have one of the athletic positioning shapes and may be comprised of a compressible material, a recoil material, and/or a rigid material. Similarly, the athletic positioning sole may have one of the athletic positioning shapes and may be comprised of a compressible material, a recoil material, and/or a rigid material. Note that a shoe implemented in accordance with this embodiment may include the athletic positioning sole and a conventional insole, a conventional sole and an athletic positioning insole, or may include an athletic positioning insole and an athletic positioning sole.

In an athletic position, more pressure is applied on the inside edge of the shoe at the ball-of-foot area than on other parts of the shoe. To compensate for this increased pressure, which could lead to greater wear and tear, the sport specific bottom 190 is thicker in this region than along the outer edge of the shoe. In addition, the sport specific sole may be thicker or equally as thick in the inner ball-of-foot region as in the heel region of the shoe. The sport specific bottom 190 may have an overall shape that reduces shock on the body when running and/or when making explosive movement.

Figure 65:
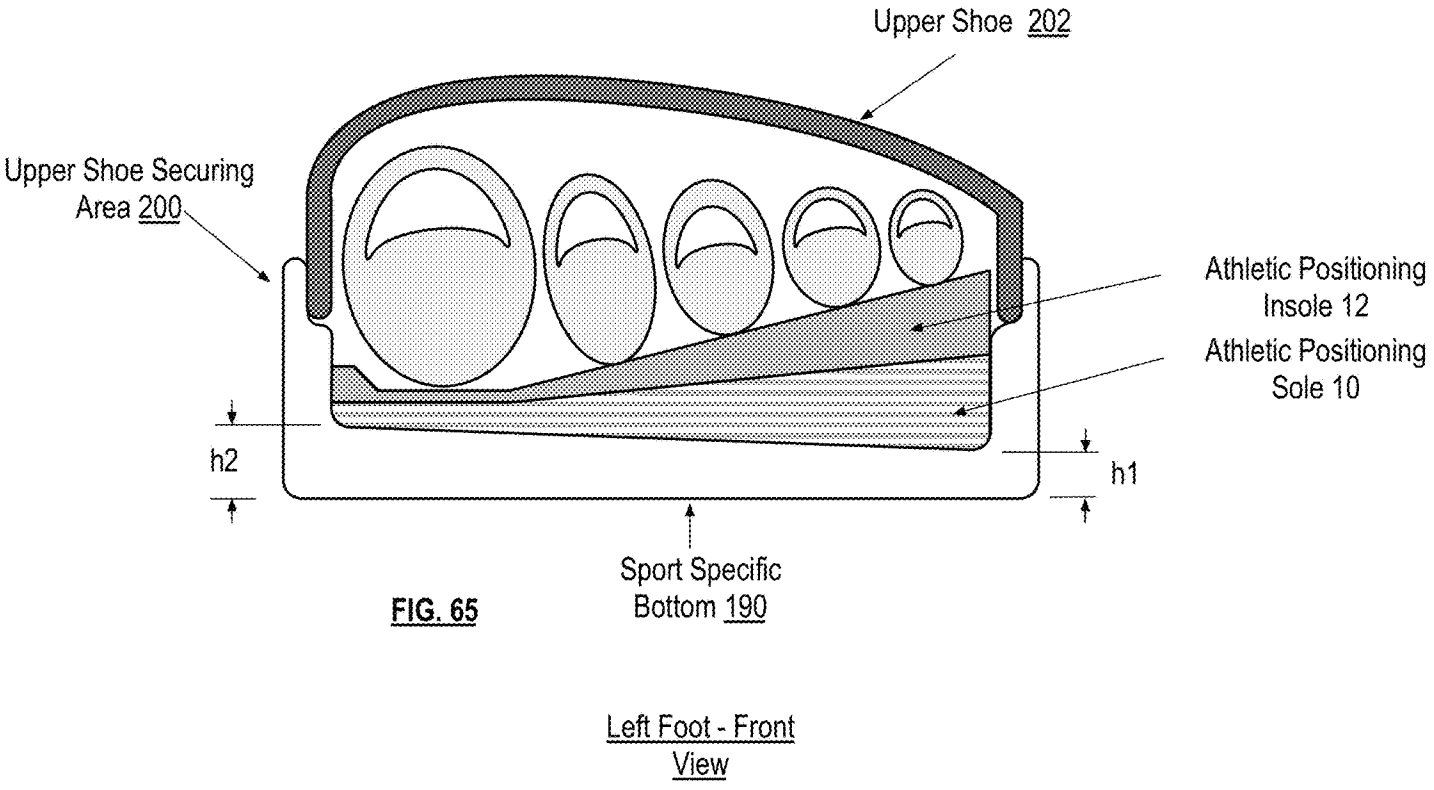
FIG. 65 illustrates a cross-sectional front view diagram of another embodiment of shoe having an athletic positioning sole and/or insole in accordance with the present invention.

FIG. 65 illustrates a cross-sectional front view diagram of another embodiment of a shoe having an athletic positioning sole and/or insole and a sport specific bottom that includes an upper shoe securing area 200. The athletic positioning insole may have one of the athletic positioning shapes and may be comprised of a compressible material, a recoil material, and/or a rigid material. Similarly, the athletic positioning sole may have one of the athletic positioning shapes and may be comprised of a compressible material, a recoil material, and/or a rigid material. Note that a shoe implemented in accordance with this embodiment may include the athletic positioning sole and a conventional insole, a conventional sole and an athletic positioning insole, or may include an athletic positioning insole and an athletic positioning sole.

The sport specific bottom 190 includes a sport specific tread pattern (e.g., tennis, basketball, training, running, etc.), a spike and/or cleat pattern (e.g., baseball, football, golf, soccer, etc.), or a sliding coupling pattern (e.g., ice skates, ski boots, snowboard boots, rollerblades, etc.). In addition, the sport specific bottom 190 includes the upper securing area 200 to secure the sole assembly (e.g., sport specific bottom, the athletic positioning insole, and/or the athletic positioning sole) to an upper shoe 202, which may be a conventional upper shoe for a given sport, activity, or dress, or may an upper shoe as described in subsequent figures. The sole assembly may be secured to the upper shoe 202 by stitching, gluing, stapling, fusing, riveting, etc. The sport specific bottom may also include a sloped bottom as discussed with reference to FIGS. 63 and 64.

Figure 66:
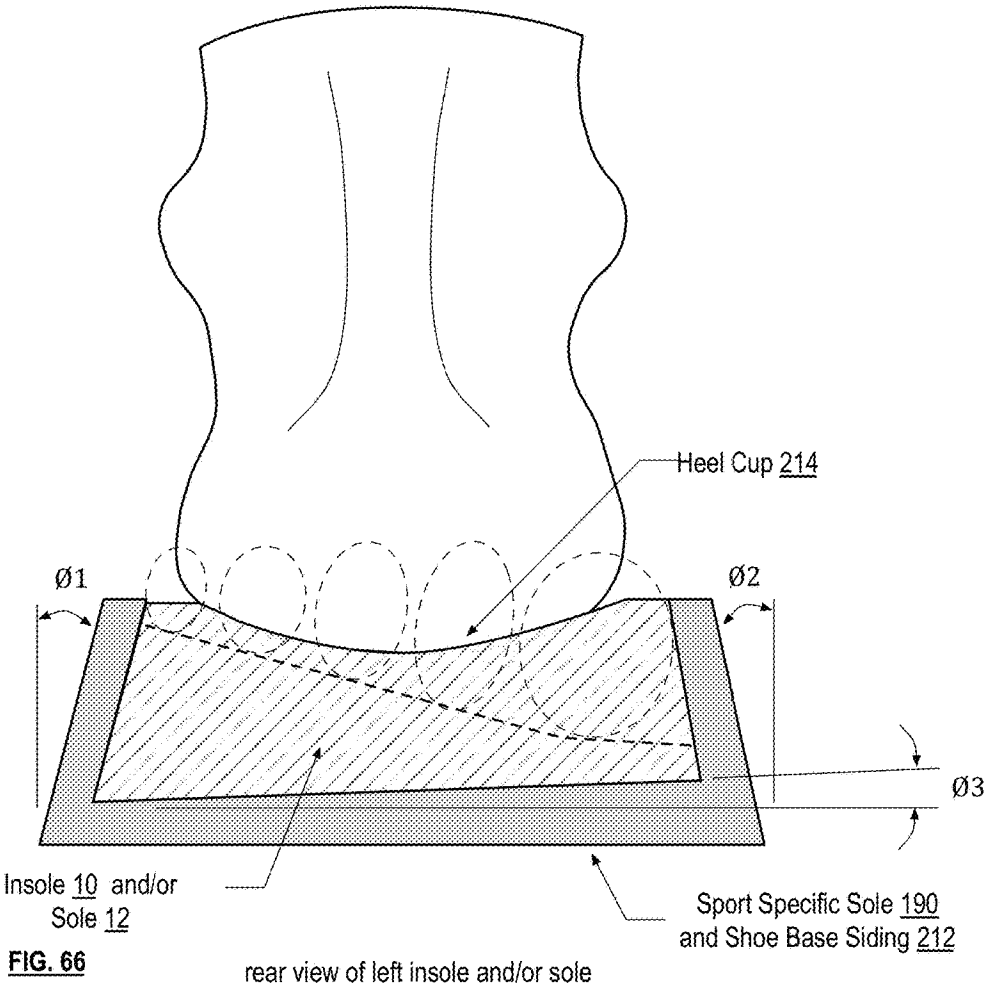
FIG. 66 illustrates a cross-sectional heel view diagram of another embodiment of an athletic positioning sole and/or insole in accordance with the present invention.

FIG. 66 illustrates a cross-sectional heel view diagram of another embodiment of an athletic positioning sole 10 and/or insole 12 and a sport specific bottom 190. The athletic positioning insole may have one of the athletic positioning shapes and may be comprised of a compressible material, a recoil material, and/or a rigid material. Similarly, the athletic positioning sole may have one of the athletic positioning shapes and may be comprised of a compressible material, a recoil material, and/or a rigid material. Note that a shoe implemented in accordance with this embodiment may include the athletic positioning sole and a conventional insole, a conventional sole and an athletic positioning insole, or may include an athletic positioning insole and an athletic positioning sole.

The sport specific bottom 190 includes a sport specific tread pattern (e.g., tennis, basketball, training, running, etc.), a spike and/or cleat pattern (e.g., baseball, football, golf, soccer, etc.), or a sliding coupling pattern 212 (e.g., ice skates, ski boots, snowboard boots, rollerblades, etc.). In addition, the sport specific bottom 190 includes a wider base than its upper portion to provide lateral stability. As shown, the outer edge of the sport specific bottom 190 angles in at a first angle (e.g., Ø1) and the inner edge of the bottom angles in at a second angle (e.g., Ø2). When the shoe includes the athletic positioning insole 12 and/or sole 10, it may be desirable to have the first angle larger than the second to provide more lateral stability, but both angles may be equal. The sport specific bottom 190 may also include a sloped bottom as discussed with reference to FIGS. 63 and 64. Note that the heel section may include a heel cup area 214

Figure 67:
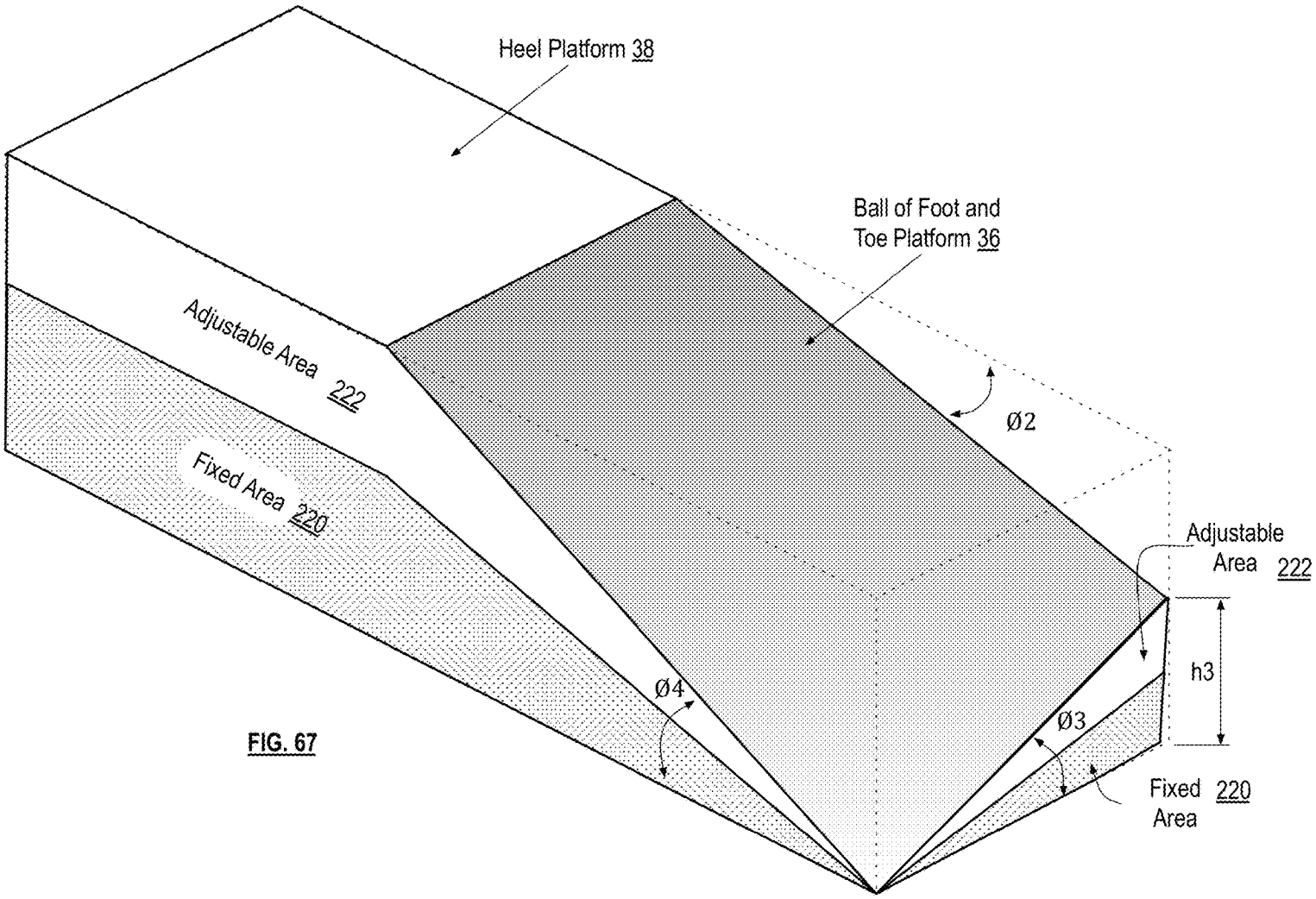
FIG. 67 illustrates an isometric diagram of an embodiment of an adjustable athletic positioning sole and/or insole in accordance with the present invention.

FIG. 67 illustrates an isometric diagram of an embodiment of an adjustable athletic positioning sole 10 and/or insole 12. The insole 12 and/or sole 10 includes a fixed area 220 and an adjustable area 222, each area may be of one of the athletic positioning shapes. The fixed area 220 provides a positioning of a big toe area 76 at a lower position than a heel area 21 and at a lower position than an outer edge area. In addition, the fixed area 220 may include one or more compressible materials, one or more rigid materials, and/or one or more recoil materials.

The adjustable area 222 may be implemented in a variety of ways, which will be discussed in subsequent drawings. In general, the adjustable area 222 allows for the heights, widths, lengths, and/or angles of the athletic positioning insole and/or athletic positioning sole to be adjusted from a minimum setting (e.g., the fixed area dimensions) to a maximum setting (e.g., the fixed area dimensions plus the adjustable area dimensions). The present figures illustrate a left shoe implementation, but the concepts are equally applicable to a right shoe.

Figure 68:
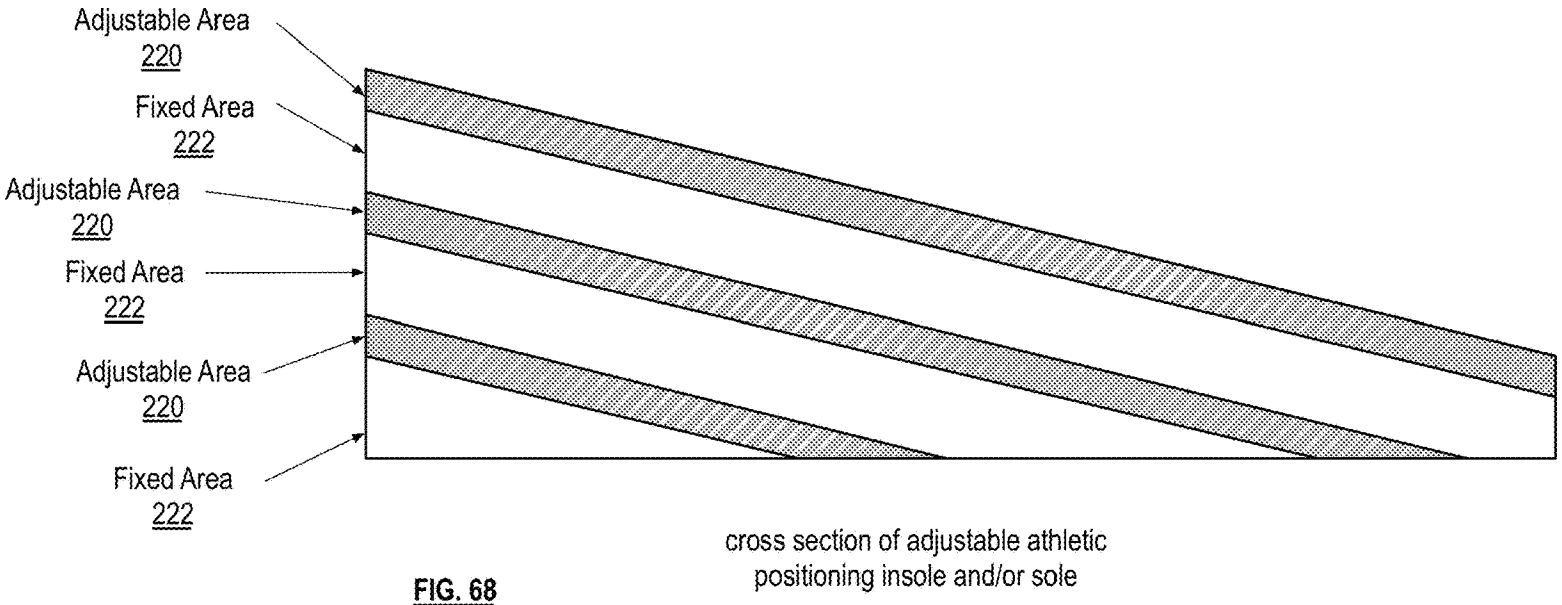
FIG. 68 illustrates a cross-sectional side view diagram of another embodiment of an adjustable athletic positioning sole and/or insole in accordance with the present invention.

FIG. 68 illustrates a cross-sectional side view diagram of another embodiment of an adjustable athletic positioning sole 10 and/or insole 12 having an alternating fixed area 222 and adjustable area 220. The first adjustable area (e.g., the lowest one) allows the height of the heel platform 38 to be adjusted. The second adjustable area (e.g., the next one up) allows for the angled support platform 36 to be adjusted with minimal adjustment to the toe area. The third adjustable area (e.g., the top one) allows for the overall athletic position shape to be adjusted.

In an example, the fixed section 222 includes a plurality of fixed subsections and the adjustable section 220 includes a plurality of adjustable subsections, which are layered to vary the lower positioning of the big toe area 76 with respect to the heel area 21 and/or the big toe area 76 with respect to the outer edge area.

Figure 69:
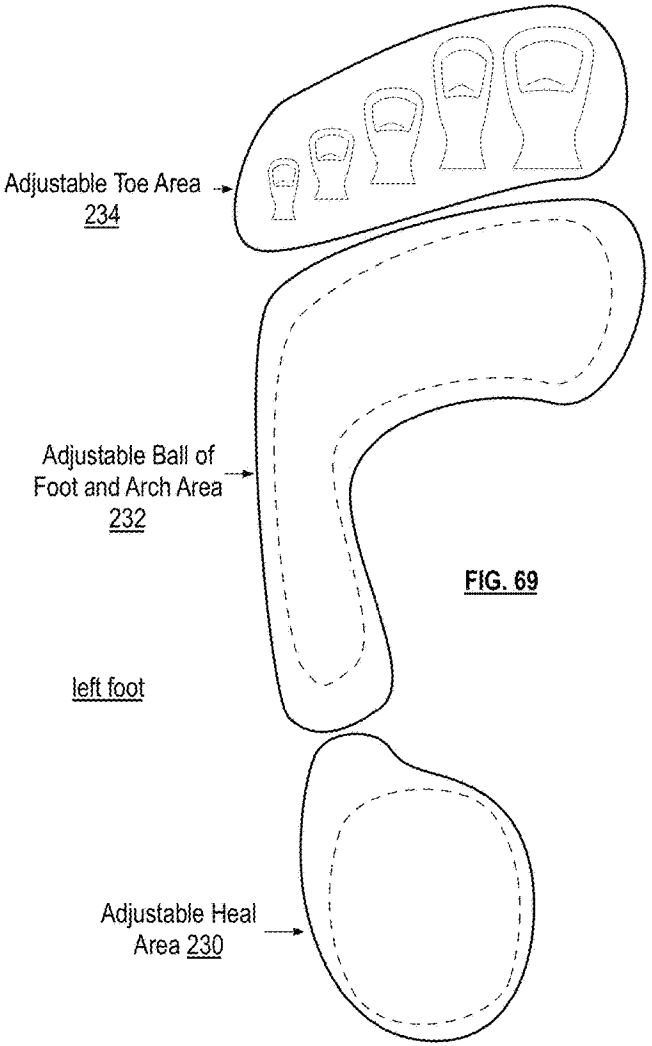
FIG. 69 illustrates a top view diagram of another embodiment of an adjustable athletic positioning sole and/or insole in accordance with the present invention.

FIG. 69 illustrates a top view diagram of another embodiment of an adjustable athletic positioning sole 10 and/or insole 12 that includes an adjustable heel section 230, an adjustable ball of foot and arch area 232, and an adjustable toe area 234. Each adjustable area 220 may be implemented using an air bladder structure that can be expanded from a minimal size (e.g., height, width, length, and/or angles) to a maximum size. Accordingly, each section would need an air intake nozzle to allow a needle to be inserted to add or remove air from the air bladder. In this instance, the air bladder would maintain the minimal shape even when all of the air is removed and expands to the maximum shape when sufficient air is added.

Alternatively, each adjustable area may include a fixed section 222 and an adjustable section 220. In an example, the fixed section 222 includes a fixed toe area, a fixed mid-foot area and a fixed heel area and the adjustable section 220 includes an adjustable toe area that is positioned proximal to the fixed toe area, an adjustable mid-foot area that is positioned proximal to the fixed mid-foot area, and an adjustable heel area that is positioned proximal to the fixed heel area. The fixed section 222 has a shape as shown and is comprised of one or more compressible materials, one or more rigid materials, and/or one or more recoil materials. The adjustable section 220 may be an air bladder, stackable plates, and/or another adjusting mechanism.

Figure 70:
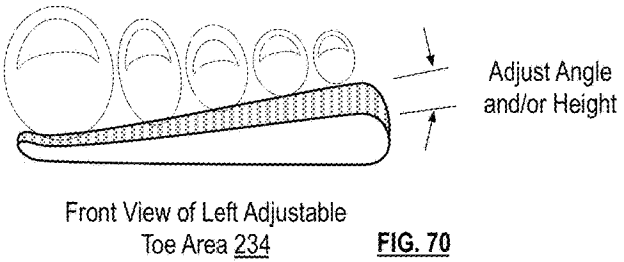
FIG. 70 illustrates a cross-sectional front view diagram of an embodiment of an adjustable toe section of an athletic positioning sole and/or insole in accordance with the present invention.
Figure 71:
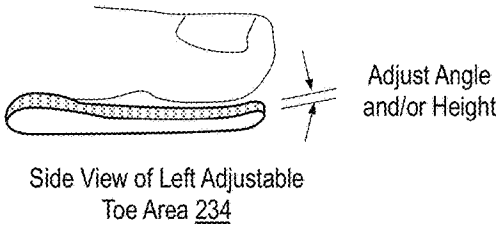
FIG. 71 illustrates a cross-sectional side view diagram of an embodiment of an adjustable toe section of an athletic positioning sole and/or insole in accordance with the present invention.

FIGS. 70 and 71 illustrate a cross-sectional front view diagram and a cross-sectional side view diagram of an embodiment of an adjustable toe section 234 of an athletic positioning sole 10 and/or insole 12. The adjustable toe section 234 may be adjusted from a minimal size (e.g., height, width, length, and/or angles) to a maximum size. For example, the toe section 234 includes an air bladder that has a minimal shape corresponding to the toe section 234 of one of the athletic positioning shapes, which can be expanded to a maximum shape. As another example, the toe section 234 includes a fixed section 222 that has a minimal shape corresponding to the toe section 234 of one of the athletic positioning shapes and an adjustable section 220 (e.g., air bladder, stackable plates, etc.) that allows the toe section 234 to expand to its maximum shape.

Figures 72, 73, 74, 75, 76:
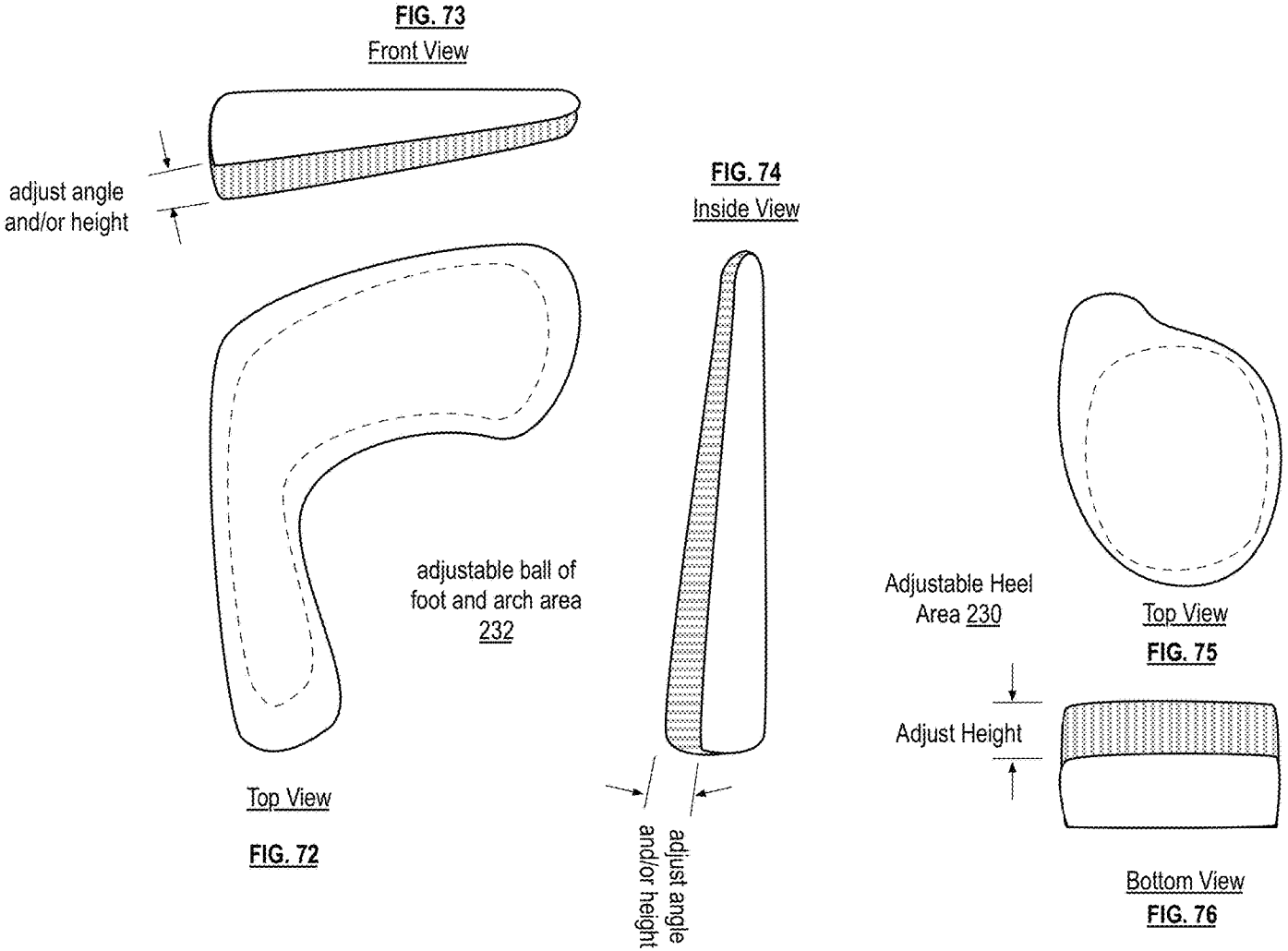
FIG. 72 illustrates a top view diagram of another embodiment of an adjustable ball of foot section of an athletic positioning sole and/or insole in accordance with the present invention.
FIG. 73 illustrates a cross-sectional front view diagram of an embodiment of an adjustable ball of foot section of an athletic positioning sole and/or insole in accordance with the present invention.
FIG. 74 illustrates a cross-sectional inside view diagram of an embodiment of an adjustable ball of foot section of an athletic positioning sole and/or insole in accordance with the present invention.
FIG. 75 illustrates a top view diagram of another embodiment of an adjustable heel section of an athletic positioning sole and/or insole in accordance with the present invention.
FIG. 76 illustrates a cross-sectional heel view diagram of an embodiment of an adjustable heel section of an athletic positioning sole and/or insole in accordance with the present invention.

FIGS. 72-74 illustrate a top view diagram, a cross-sectional front view diagram, and a cross-sectional inside view diagram of another embodiment of an adjustable ball of foot section of an athletic positioning sole 10 and/or insole 12. The adjustable ball of foot section 232 may be adjusted from a minimal size (e.g., height, width, length, and/or angles) to a maximum size. For example, the ball of foot section 232 includes an air bladder that has a minimal shape corresponding to the ball of foot and/or arch section 232 of one of the athletic positioning shapes, which can be expanded to a maximum shape. As another example, the ball of foot section includes a fixed section that has a minimal shape corresponding to the ball of foot and/or arch section of one of the athletic positioning shapes and an adjustable section (e.g., air bladder, stackable plates, etc.) that allows the ball of foot section to expand to its maximum shape.

FIGS. 75 and 76 illustrate a top view diagram and a cross-sectional heel view diagram of another embodiment of an adjustable heel section of an athletic positioning sole 10 and/or insole 12. The adjustable heel section 230 may be adjusted from a minimal size (e.g., height, width, length, and/or angles) to a maximum size. For example, the heel section includes an air bladder that has a minimal shape corresponding to the heel section of one of the athletic positioning shapes, which can be expanded to a maximum shape. As another example, the heel section 230 includes a fixed section that has a minimal shape corresponding to the heel section of one of the athletic positioning shapes and an adjustable section (e.g., air bladder, stackable plates, etc.) that allows the heel section to expand to its maximum shape.

Figure 77:
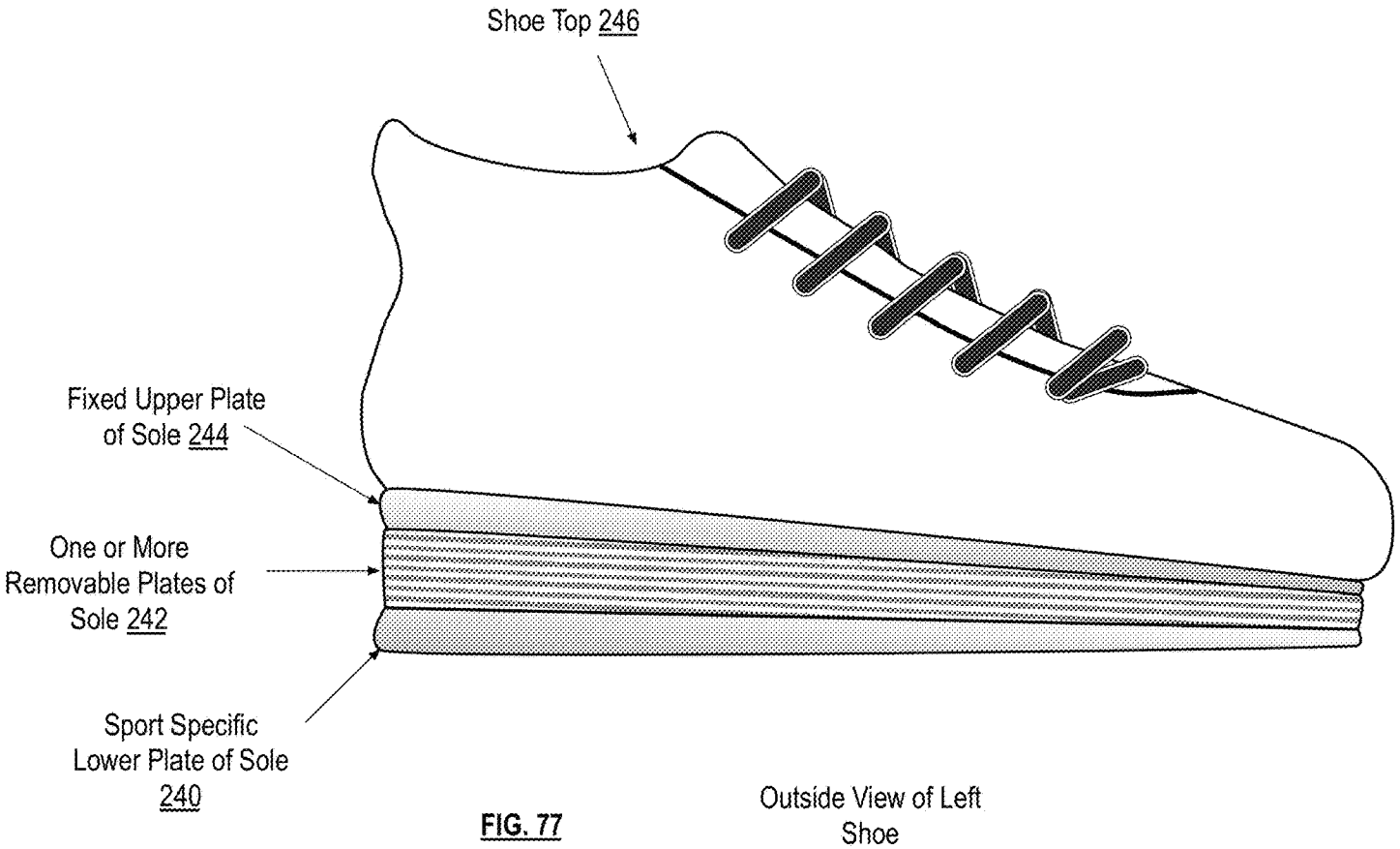
FIG. 77 illustrates a side view diagram of an embodiment of a shoe having an adjustable athletic positioning sole and/or insole in accordance with the present invention.

FIG. 77 illustrates a side view diagram of an embodiment of a shoe 246 having an adjustable athletic positioning sole. The shoe includes a sport specific lower plate 240 of the sole (which includes the sport specific sole pattern), one or more removable plates of the sole 242, a fixed upper plate of the sole 244, and a shoe top 246. The shoe may further include an athletic positioning insole (not shown), which may be fixed or adjustable.

The fixed upper plate 244 is secured to the shoe top 246 using conventional means (e.g., glue, stitching, fusing, stapling, riveting, etc.). The fixed upper plate 244 includes a securing mechanism that allows a removable plate or the sport specific bottom (if no removable plates are used) to be mechanically coupled thereto. In addition, the fixed upper plate 244 includes a shape that corresponds to one of the athletic positioning shapes (or a relatively flat shape) and is comprised of one or more rigid materials and/or one or more recoil materials.

The sport specific plate includes a sport specific pattern 240 and a securing mechanism that allows it to be mechanically coupled to a removable plate 242 or to the sport specific bottom 240 (if no removable plates are used). The sport specific lower plate 240 includes a shape that corresponds to one of the athletic positioning shapes (or a relatively flat shape) and is comprised of one or more rigid materials and/or one or more recoil materials.

Each of the removable plates 242 includes a securing mechanism that allows it to be mechanically coupled to another removable plate, to the fixed upper plate 244, or to the sport specific bottom 240. Each of the removable plates includes a shape that corresponds to one of the athletic positioning shapes (which, from plate to plate, may be different and/or of the same shape but of different dimensions) and is comprised of one or more rigid materials and/or one or more recoil materials (which, from plate to plate, may be different or the same).

Figure 78:
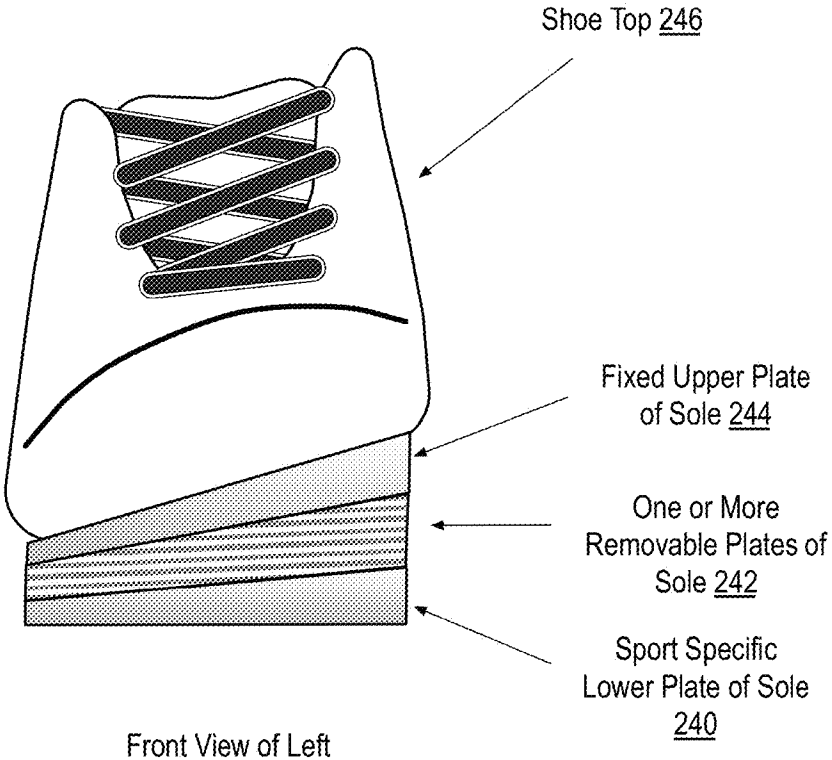
FIG. 78 illustrates a front view diagram of an embodiment of a shoe having an adjustable athletic positioning sole and/or insole in accordance with the present invention.

FIG. 78 illustrates a front view diagram of an embodiment of a shoe having an adjustable athletic positioning sole. The shoe, as discussed with reference to FIG. 77, includes a sport specific lower plate of the sole 240 (which includes the sport specific sole pattern), one or more removable plates of the sole 242, a fixed upper plate of the sole 244, and a shoe top 246. The shoe may further include an athletic positioning insole (not shown), which may be fixed or adjustable.

Figure 79:
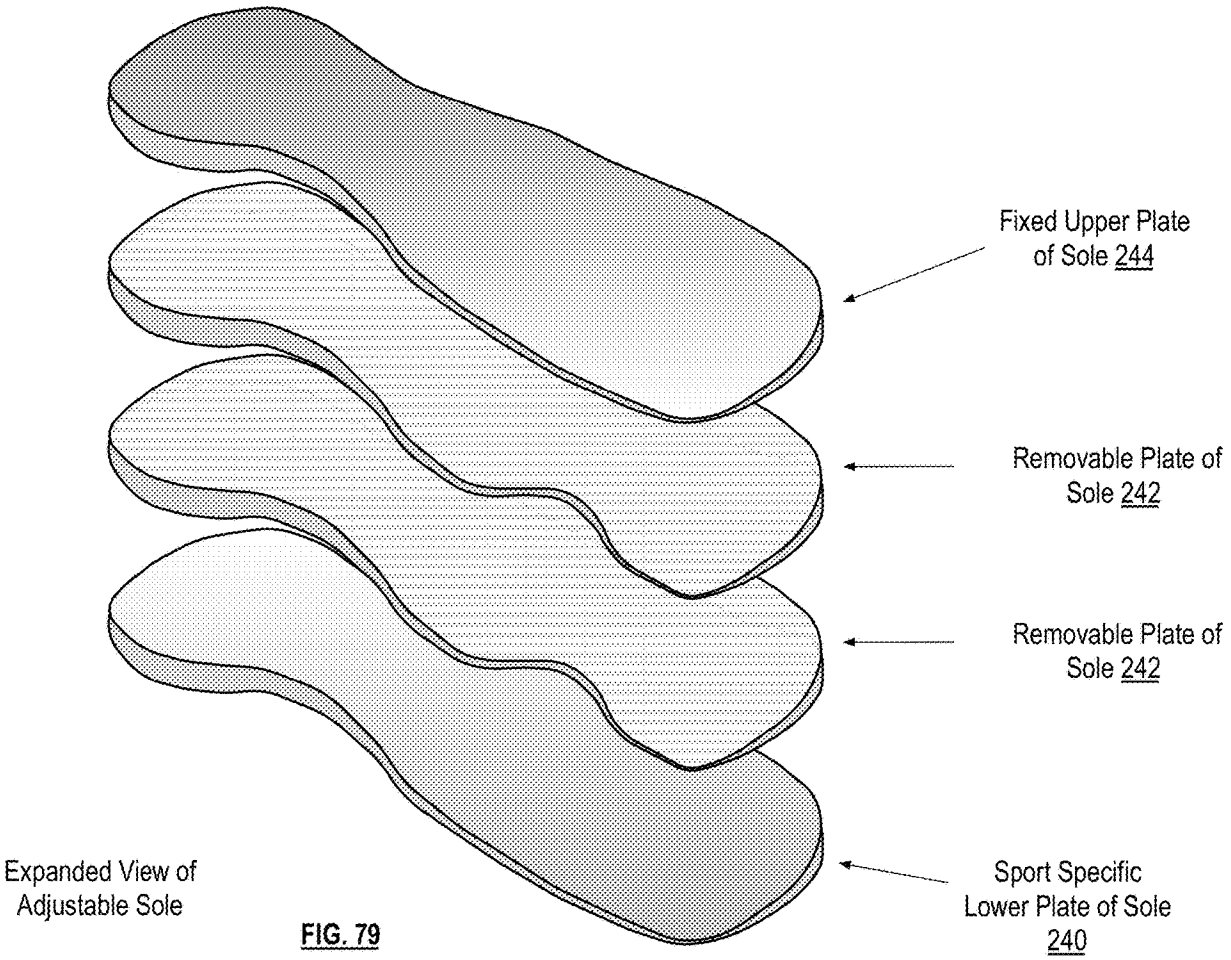
FIG. 79 illustrates an expanded view diagram of another embodiment of an adjustable athletic positioning sole and/or insole in accordance with the present invention.

FIG. 79 illustrates an expanded view diagram of another embodiment of an adjustable athletic positioning sole, which includes the fixed upper plate 244, one or more removable plates 242, and a sport specific lower plate 240. Each of the plates includes a securing mechanism, a shape that corresponds to one of the athletic positioning shapes (or a relatively flat shape) and is comprised of one or more rigid materials and/or one or more recoil materials.

An adjustable athletic positioning insole includes a fixed upper insole plate 244, one or more removable insole plates 242, and a lower insole plate 240. Each of the plates includes a securing mechanism, a shape that corresponds to one of the athletic positioning shapes (or a relatively flat shape) and is comprised of one or more rigid materials, one or more compressible materials, and/or one or more recoil materials.

Figure 80:
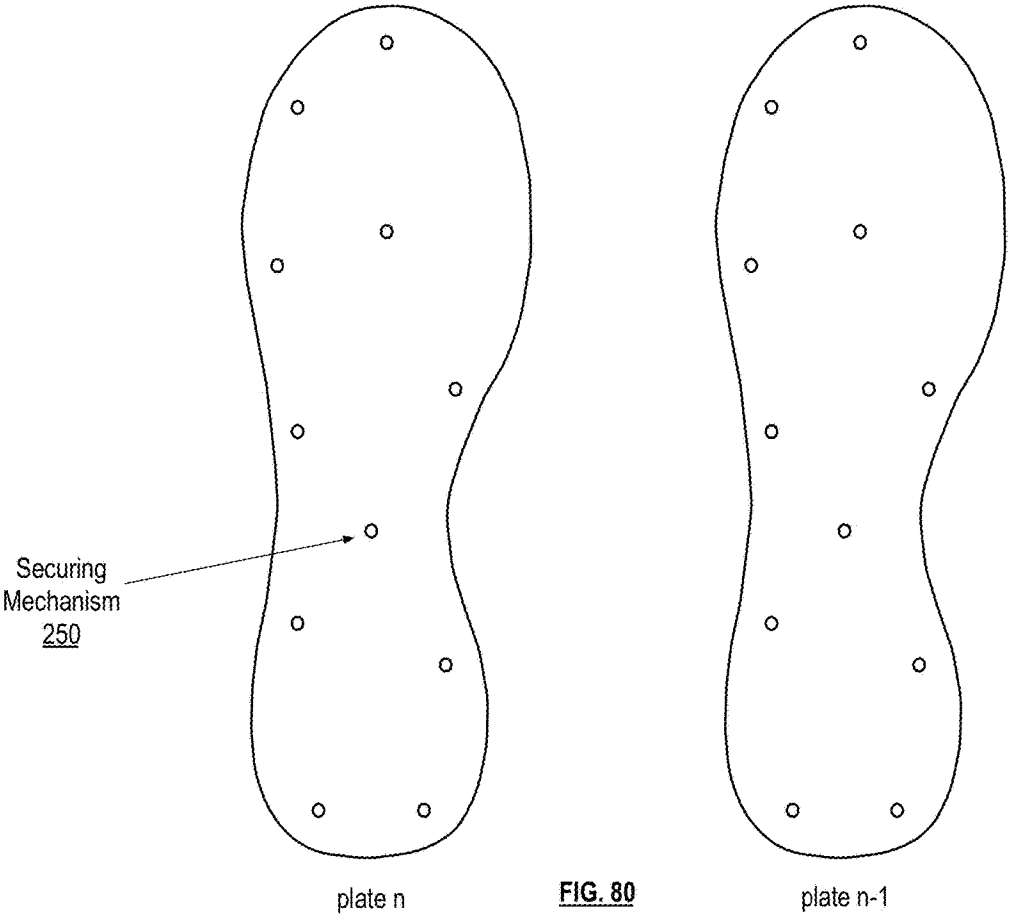
FIG. 80 illustrates a top view diagram of an embodiment of removable plates of an adjustable athletic positioning sole and/or insole in accordance with the present invention.

FIG. 80 illustrates a top view diagram of an embodiment of the fixed upper plate, one or more of the removable plates, and a lower plate of an adjustable athletic positioning sole and/or of an adjustable athletic positioning insole. The securing mechanisms 250 are positioned throughout the plate to provide secure and reliable mechanical fastening of one plate to another. Note that more or less locations of the securing mechanisms 250 may be included on each plate. Further note that each plate includes substantially the same pattern of securing mechanisms.

Figure 81:
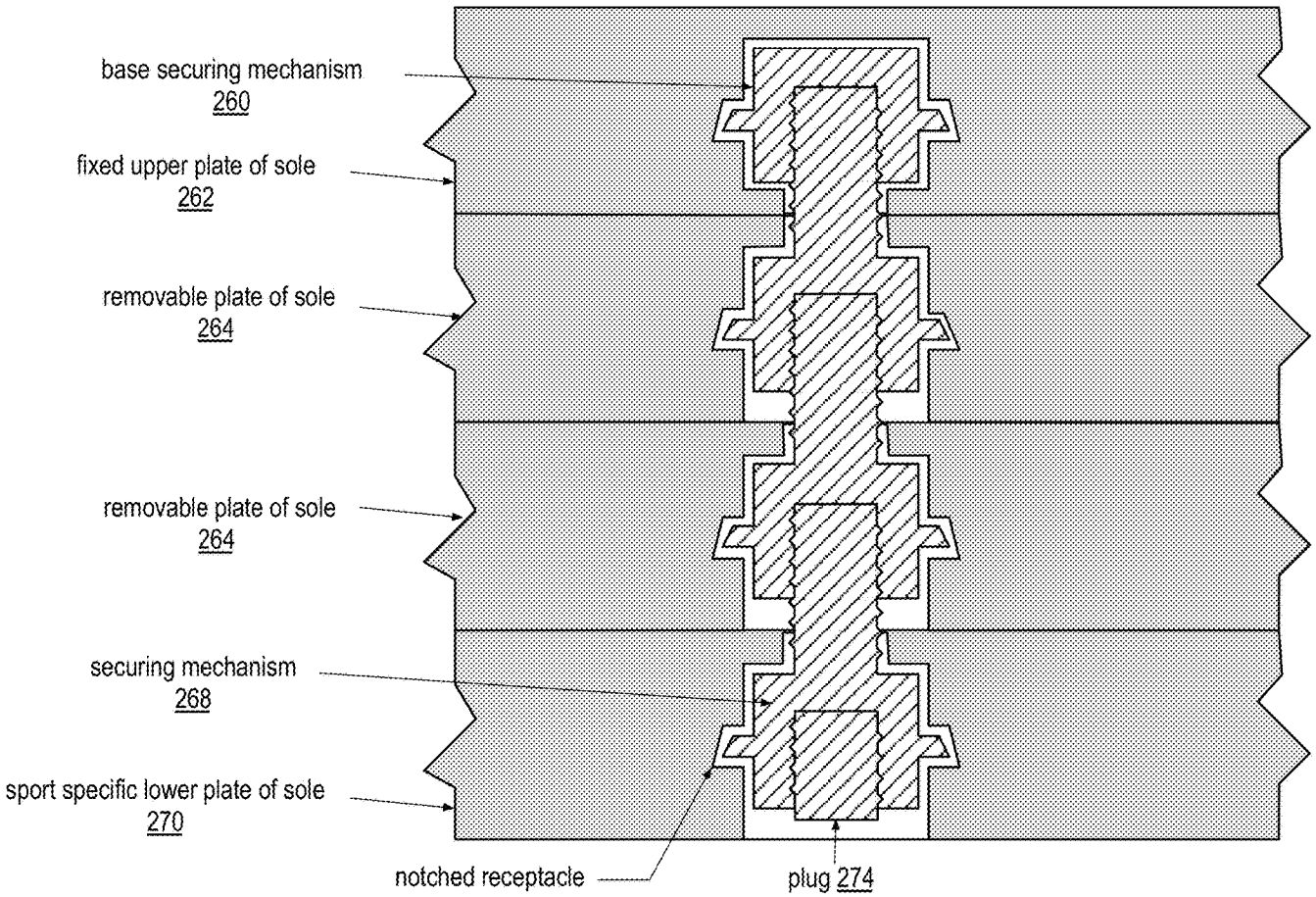
FIG. 81 illustrates a cross-sectional side view diagram of an embodiment of removable plates of an adjustable athletic positioning sole and/or insole in accordance with the present invention.

FIG. 81 illustrates a cross-sectional side view diagram of an embodiment of plates of an adjustable athletic positioning sole 10 and/or insole 12 mechanically coupled together at one of the securing mechanisms 268 of the pattern of securing mechanisms. The fixed upper plate 262 (of the sole or insole) includes a base securing mechanism 260 (e.g., a custom nut having an encircling flange to maintain its position in the fixed upper plate) at one or more securing mechanism positions of the securing mechanism pattern. Each of the other plates 264 (e.g., the lower plate 270 and the removable plates) includes a securing mechanism 268 (e.g., a custom bolt with a threaded receptacle head) at one or more securing mechanism positions of the securing mechanism pattern. Each of the plates 264 includes a notched receptacle 272, which may be tapered, for holding the respective securing mechanism 268 in place. In addition, each plate includes a securing ledge, which allows the securing mechanisms to be screwed together to produce a secure butt joint between the plates.

The lower plate securing mechanism 268 may include a threaded plug 274, which may include a cap, to substantially cover the open area of the securing mechanism holding area. Each of the securing mechanisms 268 includes a standard drive head pattern (e.g., Phillips, straight blade, star, Allen wrench, etc.) or a custom drive head pattern, which requires a proprietary tool for securing and unsecuring plates.

Figure 82:
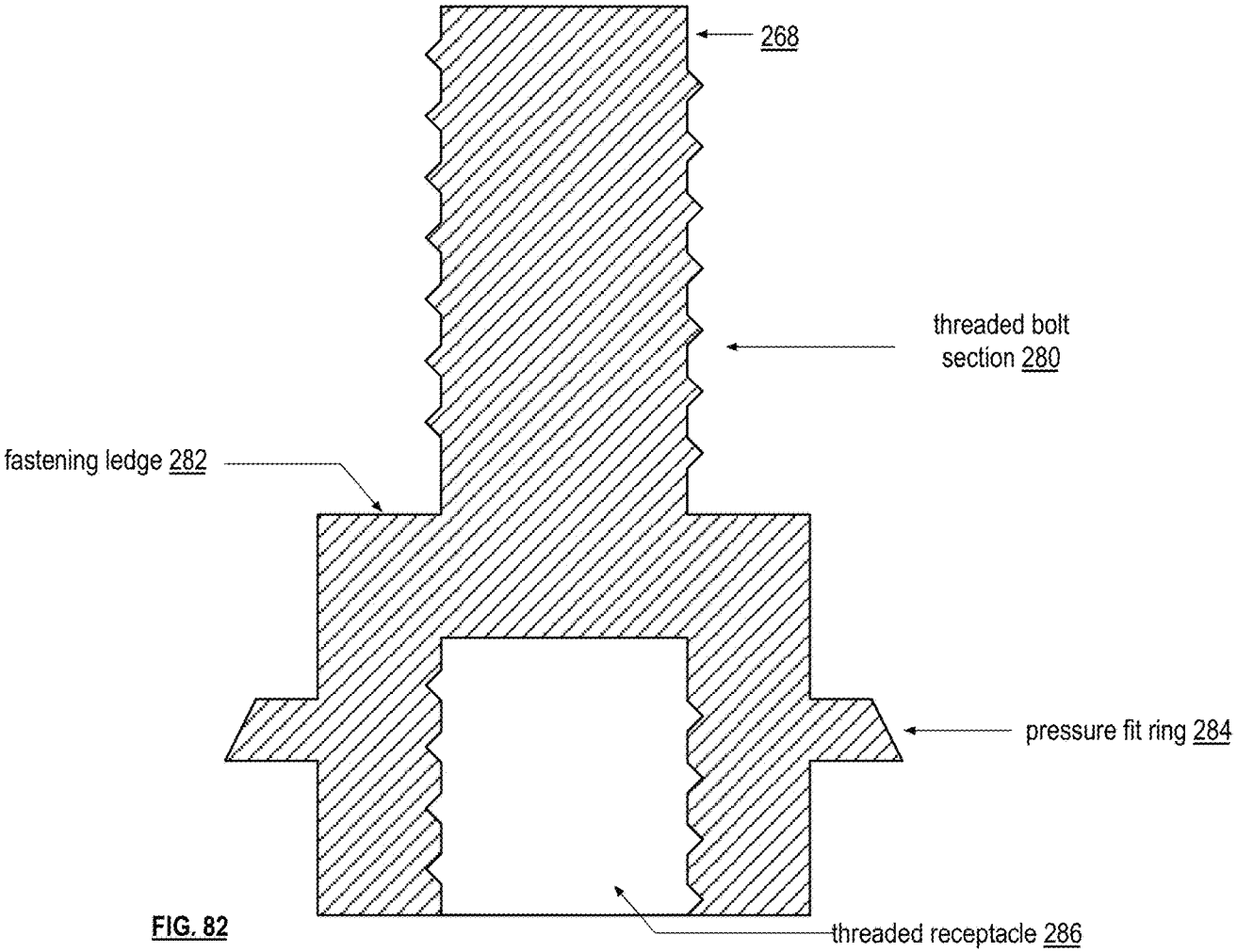
FIG. 82 illustrates a cross-sectional side view diagram of an embodiment of a securing mechanism for removable plates of an adjustable athletic positioning sole and/or insole in accordance with the present invention.

FIG. 82 illustrates a cross-sectional side view diagram of an embodiment of a securing mechanism 268 for removable plates of an adjustable athletic positioning sole and/or insole. The securing mechanism 268 includes a threaded bolt section 280, a fastening ledge 282, a pressure fit ring 284, and a threaded receptacle 286. The thread count may be any number so long as at least one full turn is required to secure the plates together. The fastening ledge presses against the inside edge of the plate as it is screwed into the threaded receptacle of the securing mechanism of the other plate, which presses against the notched receptacle 272.

Figure 84:
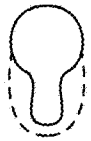
FIG. 84 illustrates a cross-sectional side view diagram of another embodiment of a securing mechanism for removable plates of an adjustable athletic positioning sole and/or insole in accordance with the present invention.
Figure 83:
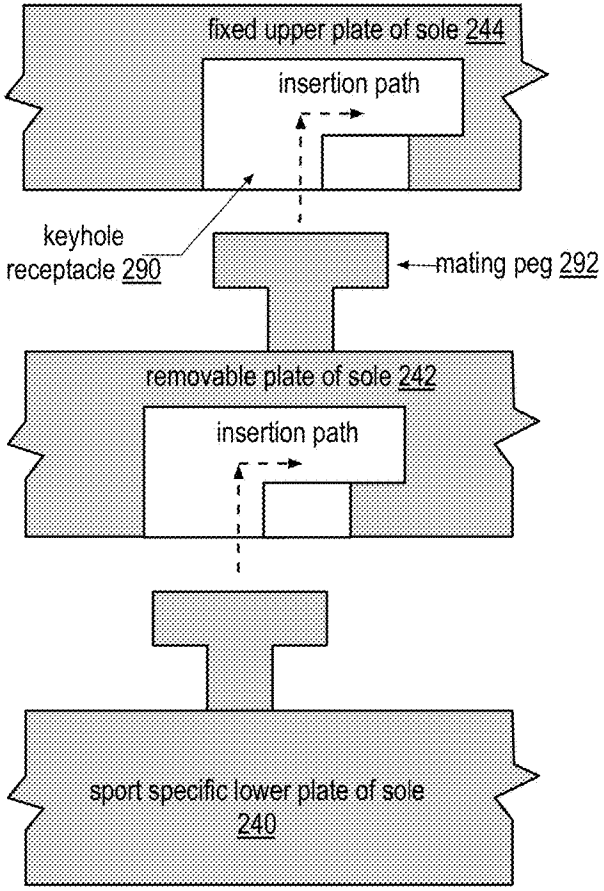
FIG. 83 illustrates an expanded cross-sectional side view diagram of another embodiment of an adjustable athletic positioning sole and/or insole in accordance with the present invention.

FIG. 83 illustrates an expanded cross-sectional side view diagram of another embodiment of an adjustable athletic positioning sole 10 and/or insole 12 at one of the securing mechanisms 268 of the pattern of securing mechanisms. The adjustable insole and/or sole includes a fixed upper plate 244, one or more removable plates 242, and a lower plate 240. The fixed upper plate 244 includes a keyhole receptacle 290, which is illustrated in FIG. 84, at one or more securing mechanism positions of the securing mechanism pattern. Each of the removable plates includes a keyhole receptacle and a mating peg 292 at one or more securing mechanism positions of the securing mechanism pattern. The lower plate 240 includes a mating peg 292 at one or more securing mechanism positions of the securing mechanism pattern.

Figure 85:
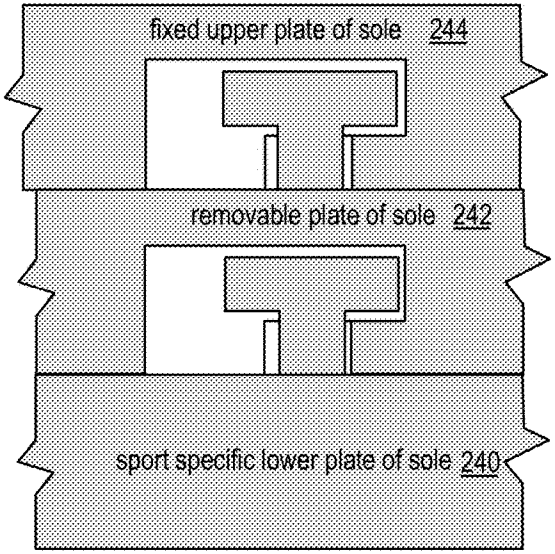
FIG. 85 illustrates a cross-sectional side view diagram of another embodiment of an adjustable athletic positioning sole and/or insole in accordance with the present invention.

FIG. 85 illustrates a cross-sectional side view diagram of another embodiment of an adjustable athletic positioning sole 10 and/or insole 12 at one of the securing mechanisms 268 of the pattern of securing mechanisms. In this example, the mating pegs 292 are inserted and moved into position to provide mechanical coupling of the plates together. In an example, the keyhole 290 and peg assembly 292 may be used at the big toe—ball of foot area where the material is thinner and the securing mechanism of FIGS. 81 and 82 would be used at other securing mechanism positions.

Figure 86:
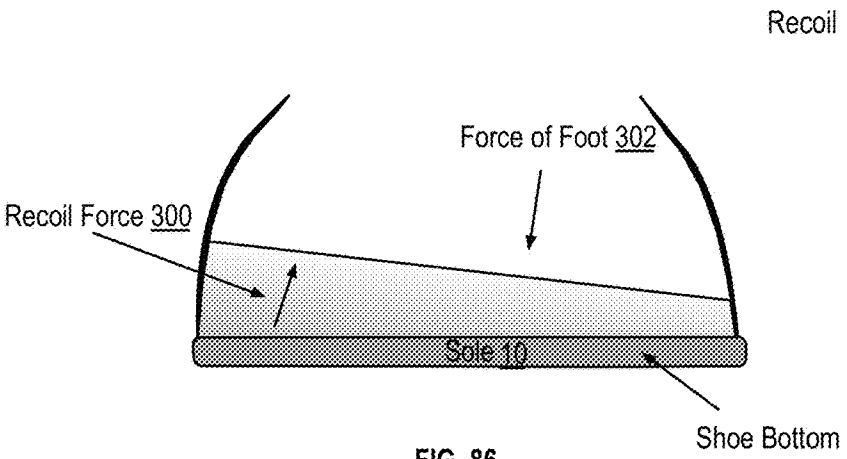
FIG. 86 illustrates a cross-sectional front view diagram of another embodiment of an athletic positioning sole and/or insole in accordance with the present invention.

FIG. 86 illustrates a cross-sectional front view diagram of another embodiment of an athletic positioning sole 10 and/or insole 12 that includes a recoil component. The recoil component may be achieved by including a series of springs, stiffened memory foam, and/or resilient rubber material. The recoil component may have one of the athletic positioning shapes or it may be a layer in an athletic positioning sole and/or insole.

The recoil component functions to provide a recoil force 300 after a foot force 302 is removed. The force may be in the opposite direction of the foot force or at some angle thereof.

Figure 87:
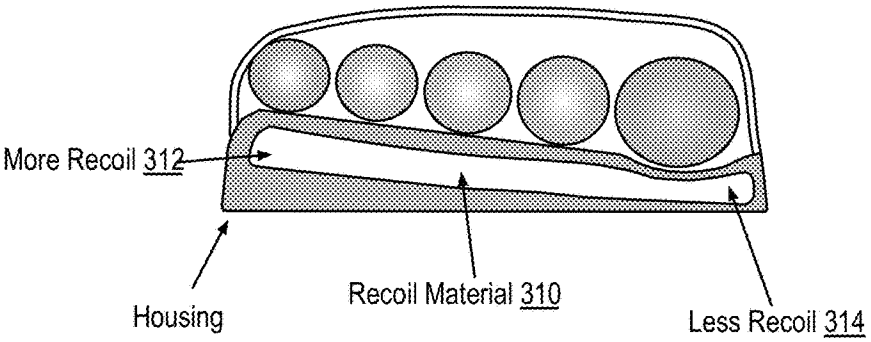
FIG. 87 illustrates a cross-sectional front view diagram of another embodiment of an athletic positioning sole and/or insole in accordance with the present invention.

FIG. 87 illustrates a cross-sectional front view diagram of another embodiment of an athletic positioning sole 10 and/or insole 12 that includes a recoil component within a housing. The recoil component may have one of the athletic positioning shapes or it may be a layer in an athletic positioning sole and/or insole. The recoil component 310 includes a series of springs, stiffened memory foam, and/or resilient rubber material that have more recoil force on the outer edge of the shoe 312 versus the inner edge of the shoe 314. In this manner, the direction of the recoil force is not opposite that of the foot force, but more horizontal and in the direction from the outside of the shoe to the inside of the shoe.

Figure 88:
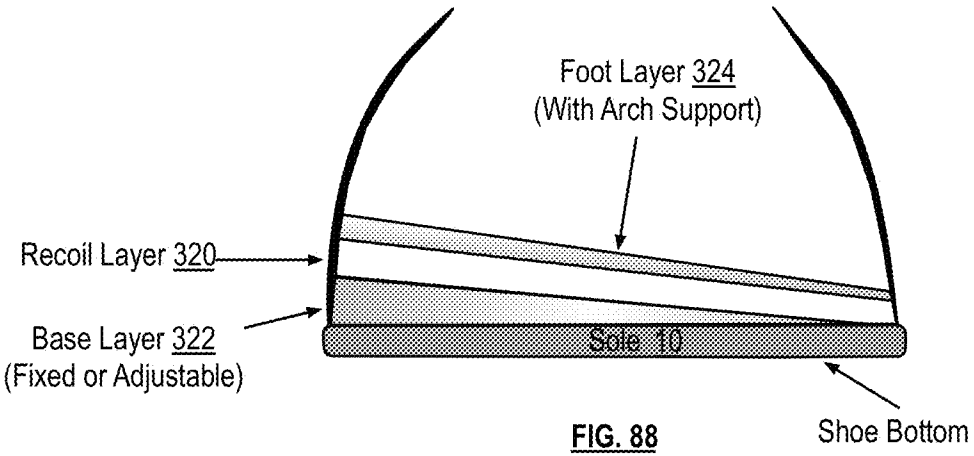
FIG. 88 illustrates a cross-sectional front view diagram of another embodiment of an athletic positioning sole and/or insole in accordance with the present invention.

FIG. 88 illustrates a cross-sectional front view diagram of another embodiment of an athletic positioning sole 10 and/or insole 12 that includes a recoil layer 320, a base layer 322, and a foot layer 324. The base layer 322 includes one of the athletic positioning shapes and may be comprises of one or more rigid materials and/or one or more compressible materials. The foot layer may include arch support and may include a relatively flat shape or it may include one of the athletic positioning shapes. In addition, the foot layer 324 may be comprised of one or more compressible materials. The recoil layer 320 includes one or more recoil materials and may include a relatively flat shape or it may include one of the athletic positioning shapes.

Figure 89:
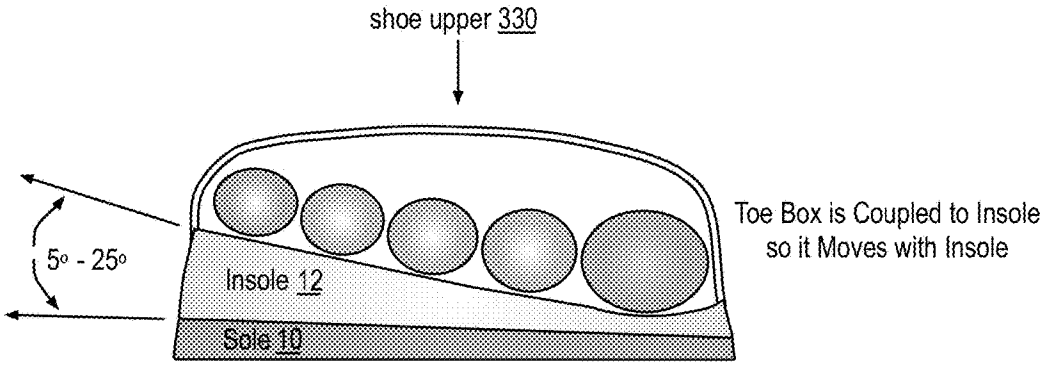
FIG. 89 illustrates a cross-sectional front view diagram of another embodiment of an athletic positioning sole and/or insole in accordance with the present invention.

FIG. 89 illustrates a cross-sectional front view diagram of another embodiment of a shoe that includes an athletic positioning sole 10, an athletic positioning insole 12, and an upper shoe 330. From the font perspective, the upper shoe 330 forms a toe box around and over the toe area. From a side perspective, the upper shoe 330 forms the remainder of the shoe for containing the foot. The upper shoe 330 may include one or more materials (e.g., leather, a synthetic material, plastic, cotton, a wicking material, etc.) to form the sides, heel, tongue, and/or toe areas of the shoe. The upper shoe 330 may further include a toe cover area of material similar to that of the sole 10, which provides at least a portion of the toe box.

In this embodiment, the insole comprises a compressible material, which, under a load of the wearer, compresses by a few millimeters to 10 or more millimeters. The upper shoe 330 is mechanically coupled (e.g., stitched, glued, fused, stapled, etc.) to the insole and/or sole such that, as the insole 12 compresses and decompresses, the upper shoe moves accordingly to maintain the toe box at a desired size and/or shape. For example, the upper shoe 330 is mechanically coupled to the upper portion of the insole 12, which is within a vertically extended outersole portion of the sole 10, such that the upper shoe 330 moves with the compression and decompression of the insole 12.

As another example, the upper shoe includes a compressible coupling section for mechanically coupling to the sole 10 and/or insole 12. As the insole 12 compresses and decompresses, the compressible coupling section, which includes a compressible material, compresses and decompresses similarly. In this manner, the size and/or shape of the toe box is substantially maintained.

Figure 90:
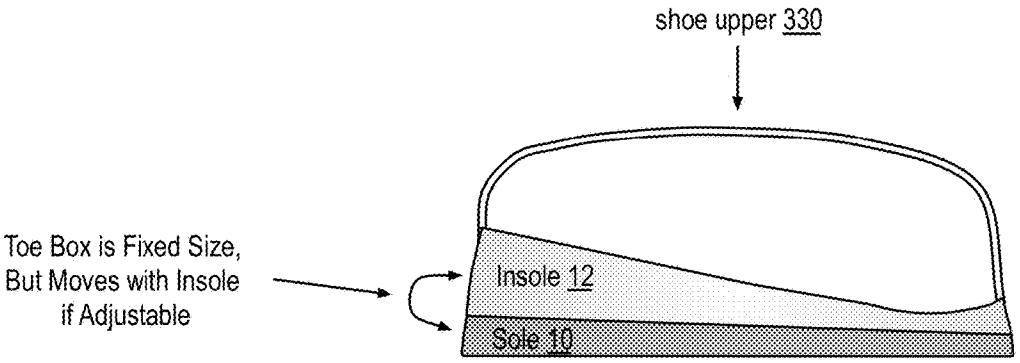
FIG. 90 illustrates a cross-sectional front view diagram of another embodiment of an athletic positioning sole and/or insole in accordance with the present invention.

FIG. 90 illustrates a cross-sectional front view diagram of another embodiment of a shoe that includes a sole 10, an insole 12, and an upper shoe 330. The insole 12 and/or sole 10 are/is adjustable and at least one of the sole and insole has a shape corresponding to one of the athletic positioning shapes. The upper shoe 330 may include one or more materials (e.g., leather, a synthetic material, plastic, cotton, a wicking material, etc.) to form the sides, heel, tongue, and/or toe areas of the shoe. The upper shoe 330 may further include a toe cover area of material similar to that of the sole 10, which provides at least a portion of the toe box.

The upper shoe 330 is mechanically coupled to the sole/insole assembly such that, as the sole/insole assembly is adjusted, the upper shoe maintains a desired size and shape of the toe box. For example, the upper shoe 330 is mechanically coupled to the upper portion of the sole/insole assembly, which is within a vertically extended outersole portion of the sole, such that the upper shoe tracks the adjustment of the sole/insole assembly.

Figure 91:
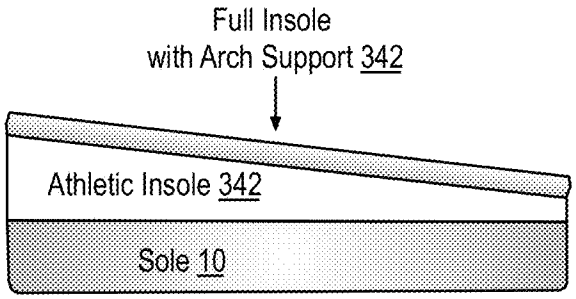
FIG. 91 illustrates a cross-sectional front view diagram of another embodiment of an athletic positioning sole and/or insole in accordance with the present invention.

FIG. 91 illustrates a cross-sectional front view diagram of another embodiment of a sole/insole assembly that includes a sole 10, an athletic positioning insole 340, and an arch support 342. The sole may include a conventional sole design for a specific sport (or other use) or it may include one of the athletic positioning shapes discussed herein. In addition, the sole 10 may be comprised of a conventional sole material and/or one or more rigid materials. Note that the conventional sole material and the rigid materials are not mutually exclusive.

The athletic positioning insole 340 has a shape corresponding to one of the athletic positioning shapes, may be adjustable, and is comprised of one or more rigid materials, one or more recoil materials, and/or one or more compressible materials. The athletic positioning insole may be mechanically coupled to the sole or it may just rest on the sole (i.e., not glued, stitched, fused, etc.).

The arch support may be integrated into the athletic positioning insole 340 or it may be a separate piece that is mechanically coupled to the sole and/or insole or rests on the sole and/or insole. The arch support may be shaped to compensate for one or more of flat feet, plantar fasciitis, high arches, low arches, pronation, supination, etc. The arch support 342 may be of a custom design, a conventional design, etc., and/or may be comprised of one or more of a graphite material, leather, a rigid material, a compressible material, etc.

Figure 92:
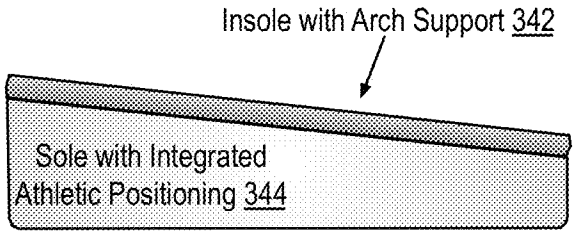
FIG. 92 illustrates a cross-sectional front view diagram of another embodiment of an athletic positioning sole and/or insole in accordance with the present invention.

FIG. 92 illustrates a cross-sectional front view diagram of another embodiment of a sole/insole assembly that includes an athletic positioning sole 10 and an insole 12 with an integrated arch support 342. The sole 10 includes one of the athletic positioning shapes 344 discussed herein and may be adjustable. In addition, the sole 10 may be comprised of a conventional sole material and/or one or more rigid materials. Note that the conventional sole material and the rigid materials are not mutually exclusive.

The insole 12 has a conventional insole shape or a shape corresponding to one of the athletic positioning shapes and has an arch support integrated therein. The arch support may be shaped to compensate for one or more of flat feet, plantar fasciitis, high arches, pronation, supination, etc. The insole with the integrated arch support 342 may be of a custom design, a conventional design, etc., and may be comprised of one or more of a graphite material, leather, a rigid material, a compressible material, etc.

Figure 93:
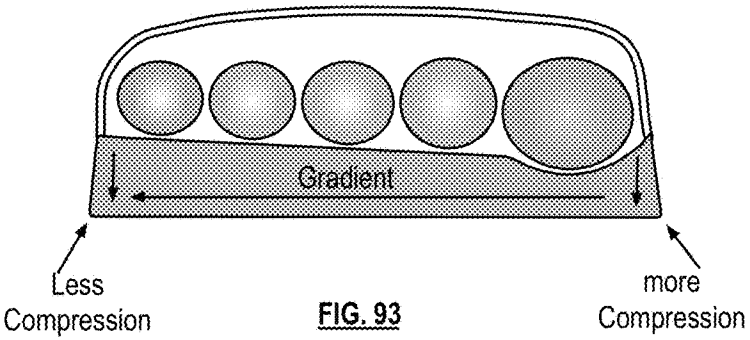
FIG. 93 illustrates a cross-sectional front view diagram of another embodiment of an athletic positioning sole and/or insole in accordance with the present invention.
Figure 94:
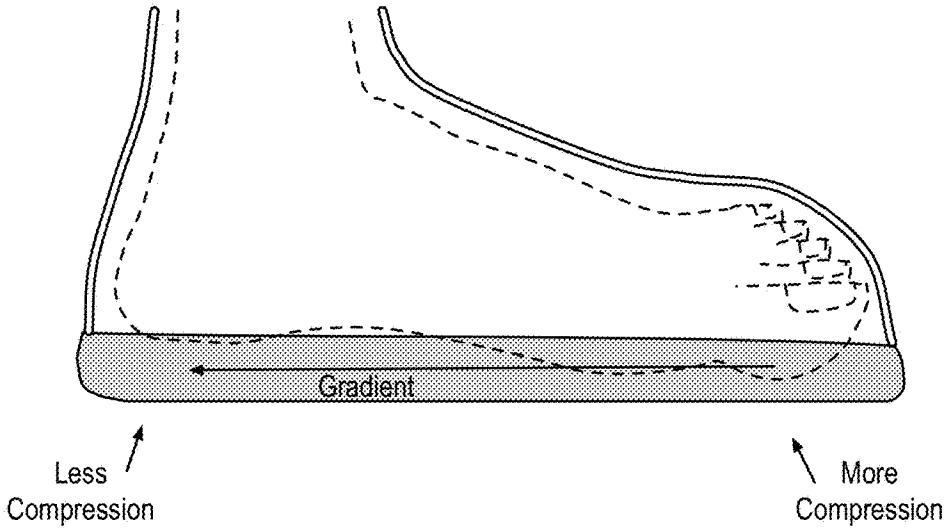
FIG. 94 illustrates a cross-sectional side view diagram of another embodiment of an athletic positioning sole and/or insole in accordance with the present invention.

FIGS. 93 and 94 illustrate a cross-sectional front view diagram and a cross-sectional side view diagram of another embodiment of an integrated athletic positioning sole and insole. The integrated sole 10 and insole 12 is comprised of one or more materials that provides a more compressible area towards the big toe/ball of foot area and increasingly less compressible away from the big toe/ball of foot area to facilitate an athletic position. The integrated sole and insole may be adjustable to adjust the athletic position (e.g., include removable plates, air bladders, etc.).

For example, the integrated sole and insole may include a rigid material as an outersole (e.g., a sport specific bottom) to provide a base. On top of the base, the integrated sole and insole includes one or more varying compressible materials. For example, the next layer is a single resilient material (e.g., rubber, gel, foam, synthetic material, etc.) of varying density to provide a compressible gradient. As another example, the next layer includes a plurality of materials, each having a shape to collectively provide the athletic positioning shape. In addition, at least some of the materials have a different level of compressibility to facilitate the compressible gradient.

The integrated sole and insole may further include an insole cover layer and/or an arch support cover layer. The insole cover layer may be of a compressible material to provide a more comfortable fit. The arch support may be shaped to compensate for one or more of flat feet, plantar fasciitis, high arches, pronation, supination, etc. The arch support may be of a custom design, a conventional design, etc., and may be comprised of one or more of a graphite material, leather, a rigid material, a compressible material, etc.

Figure 95:
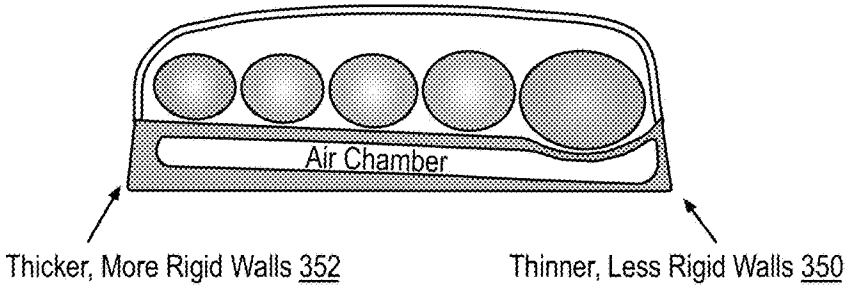
FIG. 95 illustrates a cross-sectional front view diagram of another embodiment of an athletic positioning sole and/or insole in accordance with the present invention.

FIG. 95 illustrates a cross-sectional front view diagram of another embodiment of an integrated athletic positioning sole and insole. The integrated sole and insole is comprised of a flexible and resilient material that creates a chamber (which may be filled with gel, air, another liquid material, oil, water, etc), which provides a more compressible area towards the big toe/ball of foot area 350 and increasingly less compressible away from the big toe/ball of foot area 352 to facilitate an athletic position. The material may be one or more of rubber, a synthetic material, plastic, fiberglass, carbon fiber, etc. In addition, the integrated sole and insole may be adjustable to adjust the athletic position (e.g., include removable plates, air bladders, etc.). Further, the integrated sole and insole may include an outsole of a rigid material (e.g., a sport specific bottom).

As shown, the walls of the integrated sole and insole are thicker on the outer edge 352 of the shoe than on the inner edge of the shoe 350. As such, the outer edge of the sole/insole is less compressible than the inner edge. Similarly, the walls of the sole/insole at big toe and ball of foot area are thinner than the walls towards the heel of the shoe. Accordingly, when a shoe that includes the present insole/sole assembly is worn, the more compressible areas on the insole/sole assembly compress more than the less compressible areas, putting the wearer in an athletic position (e.g., one or more of heel higher than toes, knees bent, more weight on big toe and/or ball-foot, more weight on inside of leg versus outside of leg, etc.).

Figure 96:
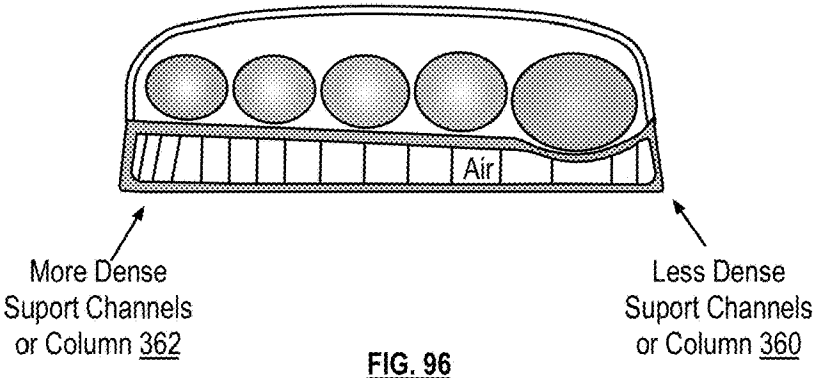
FIG. 96 illustrates a cross-sectional front view diagram of another embodiment of an athletic positioning sole and/or insole in accordance with the present invention.

FIG. 96 illustrates a cross-sectional front view diagram of another embodiment of an integrated athletic positioning sole and insole. The integrated sole and insole is comprised of a flexible and resilient material and includes a plurality of supporting columns and/or panels. The columns and/or panels create a plurality of chambers (which may be filled with gel, air, oil, another liquid material, water, etc). The number and/or thickness of the columns and/or panels is greater at the outer edge 362 of the shoe than on the inner edge of the shoe 360, which provides a more compressible area towards the big toe/ball of foot area and increasingly less compressible away from the big toe/ball of foot area. The material may be one or more of rubber, a synthetic material, plastic, fiberglass, carbon fiber, etc. In addition, the integrated sole 10 and insole 12 may be adjustable to adjust the athletic position (e.g., include removable plates, air bladders, etc.). Further, the integrated sole and insole may include an outsole of a rigid material (e.g., a sport specific bottom).

As shown, the number of columns is greater at the outer edge of the shoe than at the inner edge of the shoe. As such, the outer edge 362 of the sole/insole is less compressible than the inner edge 360. Similarly, the number of columns and/or the thickness of the columns is less at the sole/insole at big toe and ball of foot area than the number and/or thickness of columns towards the heel of the shoe. Accordingly, when a shoe that includes the present insole/sole assembly is worn, the more compressible areas on the insole/sole assembly compress more than the less compressible areas, putting the wearer in an athletic position.

Figure 97:
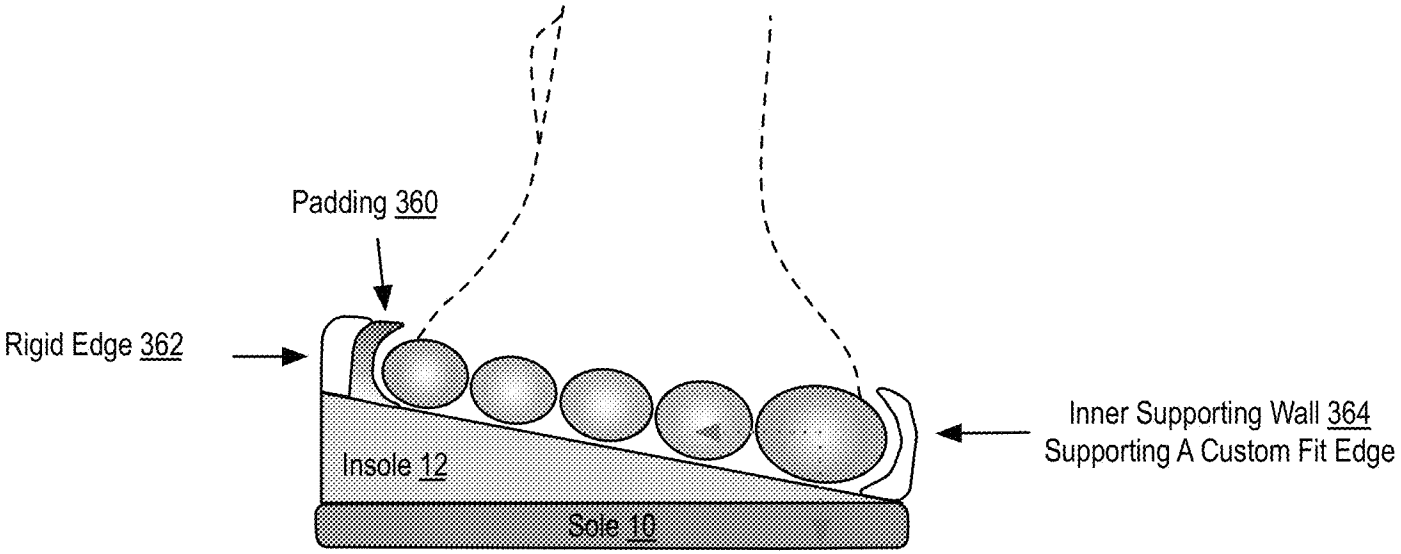
FIG. 97 illustrates a cross-sectional front view diagram of another embodiment of an athletic positioning sole and/or insole in accordance with the present invention.

FIG. 97 illustrates a cross-sectional front view diagram of another embodiment of an athletic positioning sole/insole assembly that includes a sole 10, an insole 12, a rigid outer edge 362, and padding 360. The insole 12 has a conventional insole shape or a shape corresponding to one of the athletic positioning shapes. The insole 12 may have an arch support integrated therein, where the arch support is shaped to compensate for one or more of flat feet, plantar fasciitis, high arches, pronation, supination, etc. In addition, the insole may be comprised of one or more of a graphite material, leather, a rigid material, a compressible material, etc.

The sole 10 includes a conventional shape or a shape corresponding to one of the athletic positioning shapes. In addition, the sole may be adjustable and may be comprised of a conventional sole material and/or one or more rigid materials. Note that the conventional sole material and the rigid materials are not mutually exclusive.

The sole 10 may further include an outersole (e.g., sport specific bottom) that includes an inner supporting wall 364 and may further include the rigid outer edge 362. The outersole may be comprised of a conventional sole material and/or of one or more rigid materials. Regardless of the material, the inner supporting wall is, at least on the inside edge by the toe, substantially perpendicular to the slope of the insole/sole assembly to minimize pinching of the big toe and/or the ball-of-foot. Similarly, the rigid outer edge 362 (or wall) is, at least on the inside edge by the little toe, substantially perpendicular to the slope of the insole/sole assembly to provide a rigid surface to push against when a lateral force is applied (i.e., the horizontal or near horizontal force component of the foot force during an athletic move) and/or to minimize a "give" of the shoe (e.g., foot sliding in the shoe, which may detract from the athletic move). Note that there may be padding on the inside of the rigid outer wall and/or on the inside of the inside supporting wall.

Alternatively, the rigid outer edge 362 may be coupled to, or integrated into, the insole 12. In this alternative, the outersole would further include an outer supporting wall 364, which is outside of the rigid outer edge 362. In this instance, both the rigid outer edge 362 and the outer supporting wall 364 provide a rigid surface to push against for the lateral force.

Figure 98:
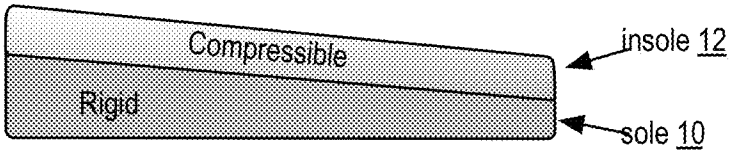
FIG. 98 illustrates a cross-sectional front view diagram of another embodiment of an athletic positioning sole and/or insole in accordance with the present invention.

FIG. 98 illustrates a cross-sectional front view diagram of another embodiment of a sole/insole assembly that includes an athletic positioning sole 10 and an insole 12. The insole 12 has a conventional insole shape and may be comprised of a compressible material. In addition, the insole may include an arch support integrated therein, where the arch support is shaped to compensate for one or more of flat feet, plantar fasciitis, high arches, pronation, supination, etc.

The sole 10 includes a shape corresponding to one of the athletic positioning shapes. In addition, the sole may be adjustable and may be comprised of a conventional sole material and/or one or more rigid materials. Note that the conventional sole material and the rigid materials are not mutually exclusive.

Figure 99:
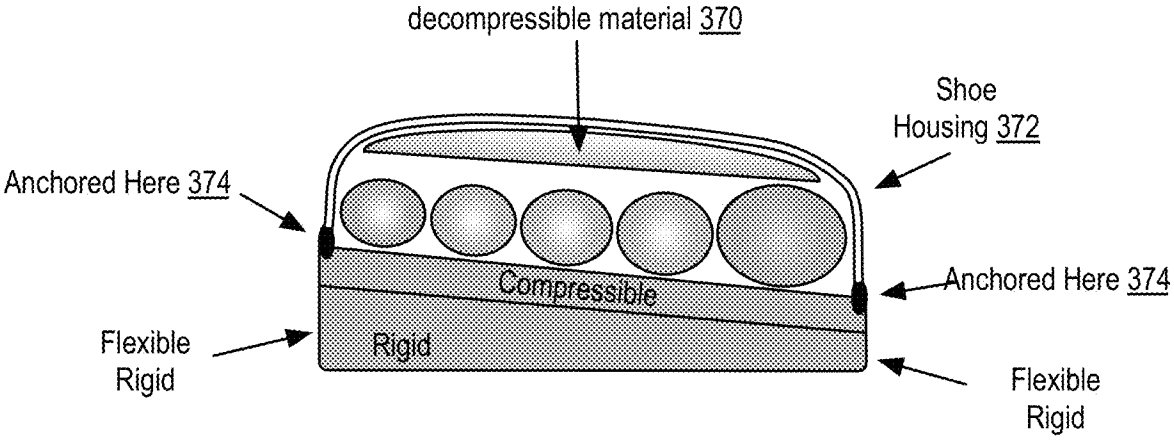
FIG. 99 illustrates a cross-sectional front view diagram of another embodiment of an athletic positioning sole and/or insole in accordance with the present invention.

FIG. 99 illustrates a cross-sectional front view diagram of another embodiment of a shoe that includes an athletic positioning sole 10, an insole 12, and a shoe housing 372. The sole 10 and insole 12 are similar to the sole 10 and insole 12 of FIG. 98. The shoe housing 372 (e.g., the shoe upper) includes a decompressible material 370 (e.g., similar material to a compressible material, but its normal state is compressed as opposed to decompressed) on the inside of the shoe housing 372.

When the shoe is place on a foot and with minimal foot force, the compressible material insole is not substantially compressed and the decompressible material is substantially compressed. When a foot force is applied (e.g., wearer of the shoe is standing, running, et.), the compressible insole compresses and, when the foot force is removed (e.g., foot off ground), the compressible insole decompresses. As the foot force varies from minimal force (e.g., foot off ground) to maximal force (e.g., leg on ground while running), the compression of the compressible insole varies proportionally.

The compression and/or decompression of the decompressible material during the variations of the foot force depend on how the shoe housing is anchored 374 (e.g., mechanically coupled) to the sole/insole assembly. In this figure, the shoe housing 372 is anchored 374 to the top of the compressible material; as such the shoe housing moves with the compression and decompression of the compressible insole. The decompressible material, however, stays in the substantially compressed state.

Figure 100:
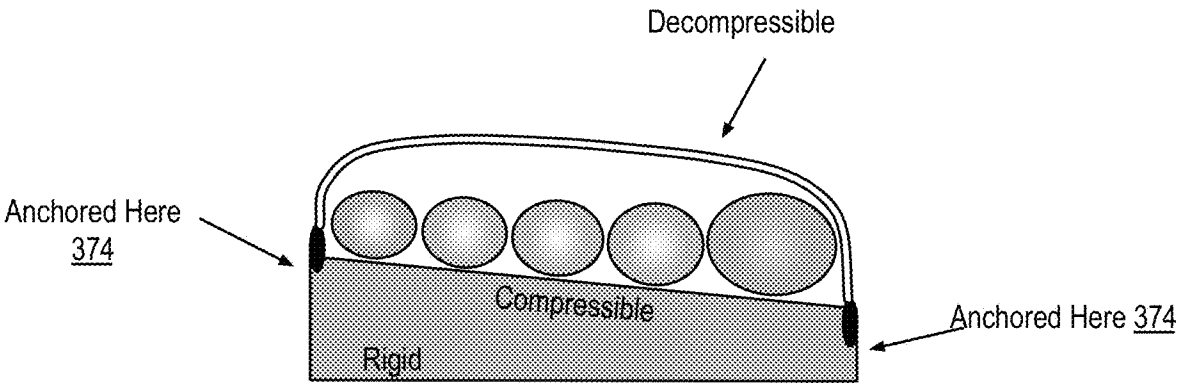
FIG. 100 illustrates a cross-sectional front view diagram of another embodiment of an athletic positioning sole and/or insole in accordance with the present invention.

FIG. 100 illustrates the shoe housing anchored to the rigid sole 374. In this example, the shoe housing does not move with the compression and decompression of the compressible insole. Accordingly, the decompressible material decompresses as the compressible insole compresses and the decompressible material compresses as the compressible insole decompresses. In either of the examples of FIGS. 99 and 100, the decompressible material facilitates a snug fit of the shoe, which may reduce energy loss during an athletic move that results from a loose fitting shoe.

Figure 101:
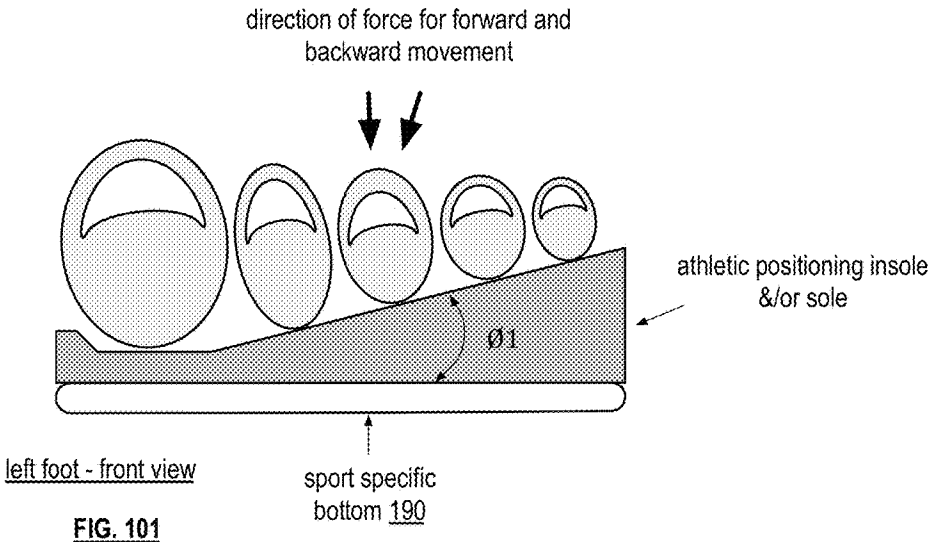
FIG. 101 illustrates a cross-sectional front view diagram of another embodiment of an adjustable athletic positioning sole and/or insole in accordance with the present invention.
Figure 102:
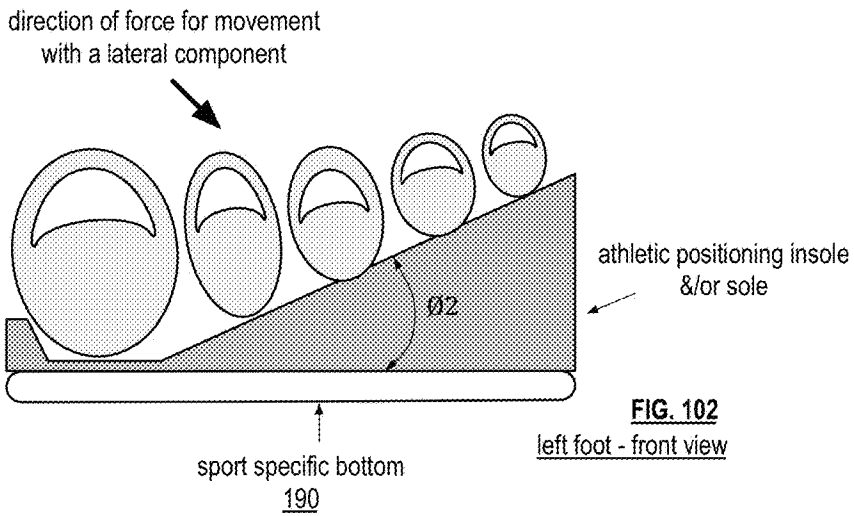
FIG. 102 illustrates a cross-sectional front view diagram of another embodiment of an adjustable athletic positioning sole and/or insole in accordance with the present invention.

FIGS. 101 and 102 illustrate a cross-sectional front view diagram of another embodiment of a sole/insole assembly that includes a dynamic athletic positioning sole-insole and a sport specific bottom (e.g., an outersole). The athletic positioning sole-insole has a shape corresponding to one of the athletic positioning shapes, which is adaptable based on the force applied.

As shown in FIG. 101, when a downward force (e.g., approximately perpendicular to the sport specific bottom 190 or slightly off perpendicular from the outer edge to the inner edge) is applied to the insole/sole assembly during a forward or backward movement (e.g., running, walking, jumping, etc., in a forward or backward direction), the angle from the outside edge of the shoe to the inside edge of shoe is of a first value (e.g., Ø1). The first value of the angle may be in the range of near zero degrees to less than 10 degrees to simulate a more conventional insole/sole assembly for forward/backward movements. In addition, the angle between the big toe/inner ball of foot area and the heel may be in the range of near zero degrees to less than 10 degrees to simulate a more conventional insole/sole assembly for forward/backward movements.

As shown in FIG. 102, when a force (e.g., off perpendicular from the inner edge to the outer edge) is applied to the insole/sole assembly during a lateral movement (e.g., pitching, hitting, making a cut while running, etc.), the angle from the outside edge of the shoe to the inside edge of shoe is of a second value (e.g., Ø2). The second value of the angle may be in the range of a fraction of a degree to 10-20 degrees (or more) to provide an athletic position for lateral movements. In addition, the angle between the big toe/inner ball of foot area and the heel may be in the range of a fraction of a degree to 10-20 degrees (or more) to provide an athletic position for lateral movements.

Figure 103:
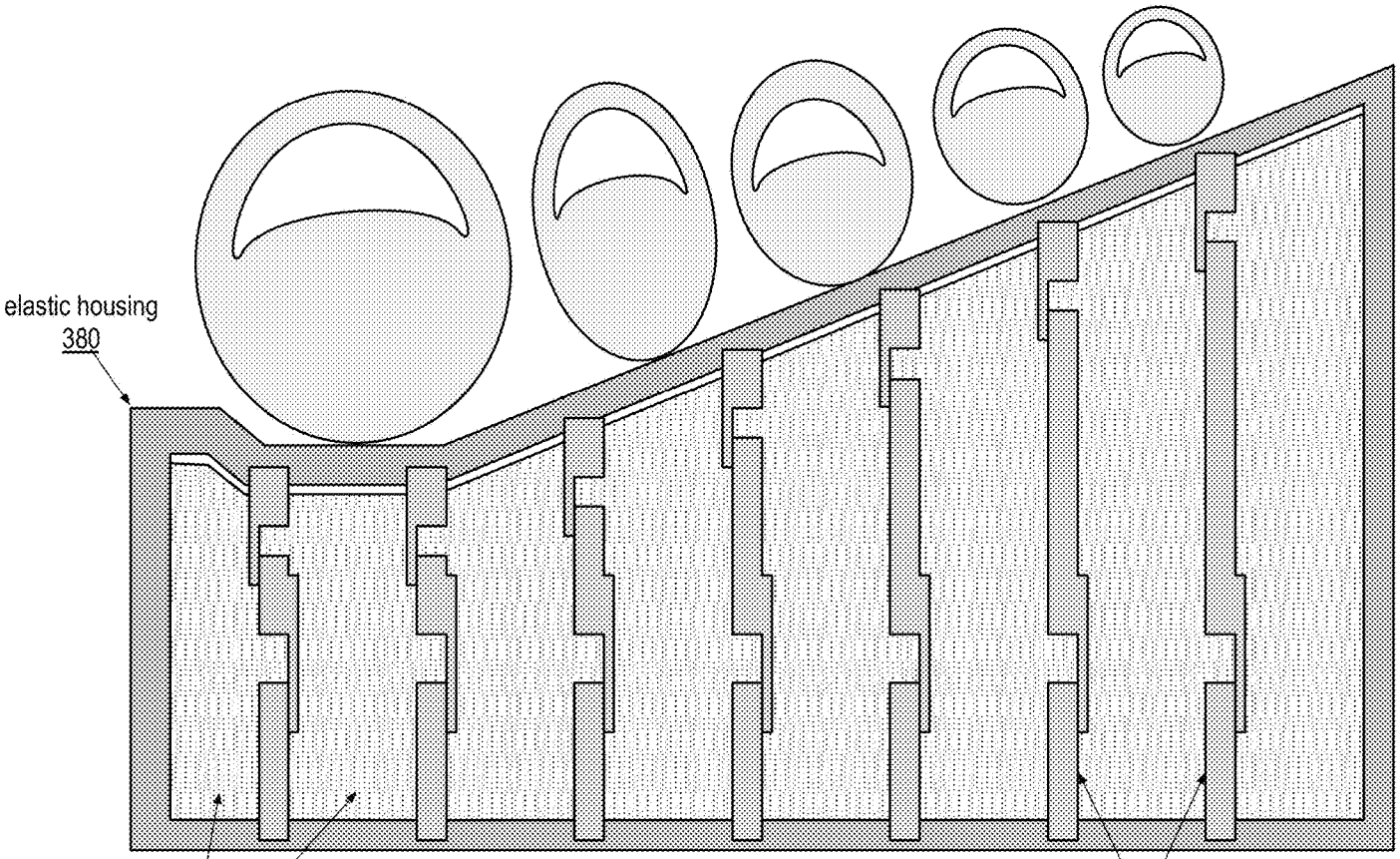
FIG. 103 illustrates a cross-sectional front view diagram of another embodiment of an adjustable athletic positioning sole and/or insole in accordance with the present invention.

FIG. 103 illustrates a cross-sectional front view diagram of an embodiment of the varying athletic positioning sole/insole assembly of FIGS. 101 and 102. The sole/insole assembly includes an elastic housing 380, a plurality of support and pressure shifting panels 382, and a liquid material 384. The elastic housing 380 is comprised of an elastic material such as one or more of rubber, a synthetic material, plastic, etc. In addition, the elastic housing 380 may be more elastic at the outer edge of the sole/insole assembly (and towards the heel) and less elastic at the inner edge of the sole/insole assembly towards the big toe/inner ball of foot area.

In a no load, steady-state condition, the flaps of the panels are closed and the liquid material is approximately equally distributed in the chambers between the panels. Note that equal distribution of the liquid material (e.g., gel, water, an oil, etc.) may be volume based and/or based on substantially equal pressure applied on the panels. In this state, the sole/insole assembly has a shape corresponding to one of the athletic positioning shapes.

Figure 104:
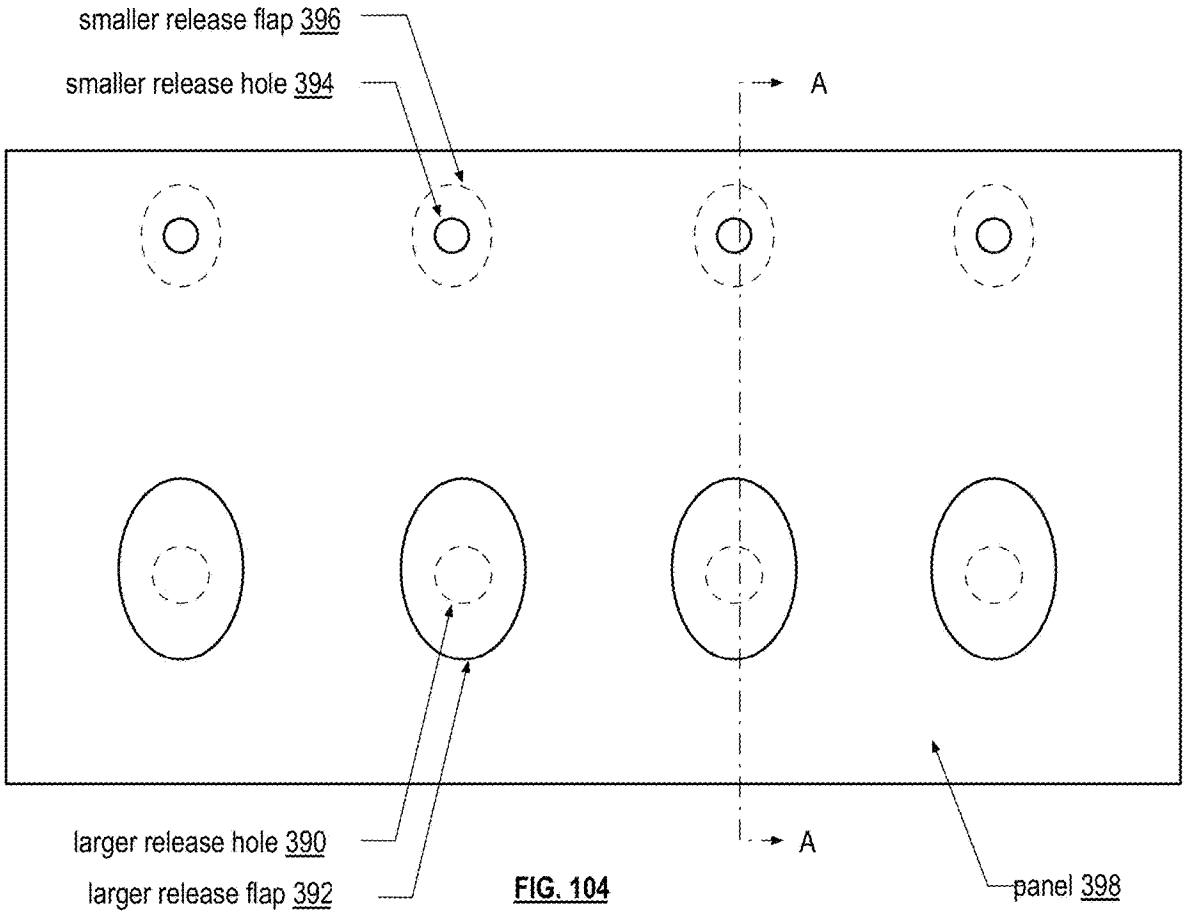
FIG. 104 illustrates a side view diagram of an embodiment of a panel of an adjustable athletic positioning sole and/or insole in accordance with the present invention.
Figure 105:
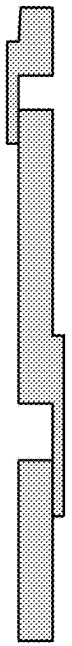
FIG. 105 illustrates a cross-sectional front view diagram of an embodiment of a panel of an adjustable athletic positioning sole and/or insole in accordance with the present invention.

FIGS. 104 and 105 illustrate a side view diagram and a cross-sectional view diagram of an embodiment of a panel of the sole/insole assembly of FIG. 103. The panel includes a plurality of larger release holes 390, a plurality of larger release flaps 392, a plurality of smaller release holes 394, and a plurality of smaller flaps 396. The panel 398 may be comprised of a semi rigid, elastic, and resilient material such as one or more of rubber, a synthetic material, plastic, etc.

The larger 392 and smaller flaps 396 are comprised of the substantially the same semi rigid, elastic, and resilient material as the panel and function to block flow of the liquid material through the corresponding release hole in one direction and enable flow of the liquid material through the corresponding release hole in the opposite direction. The size of the holes and/or the ratio between the sizes of the holes is dependent on the desired levels of flow of the liquid material in the given directions.

Figure 106:
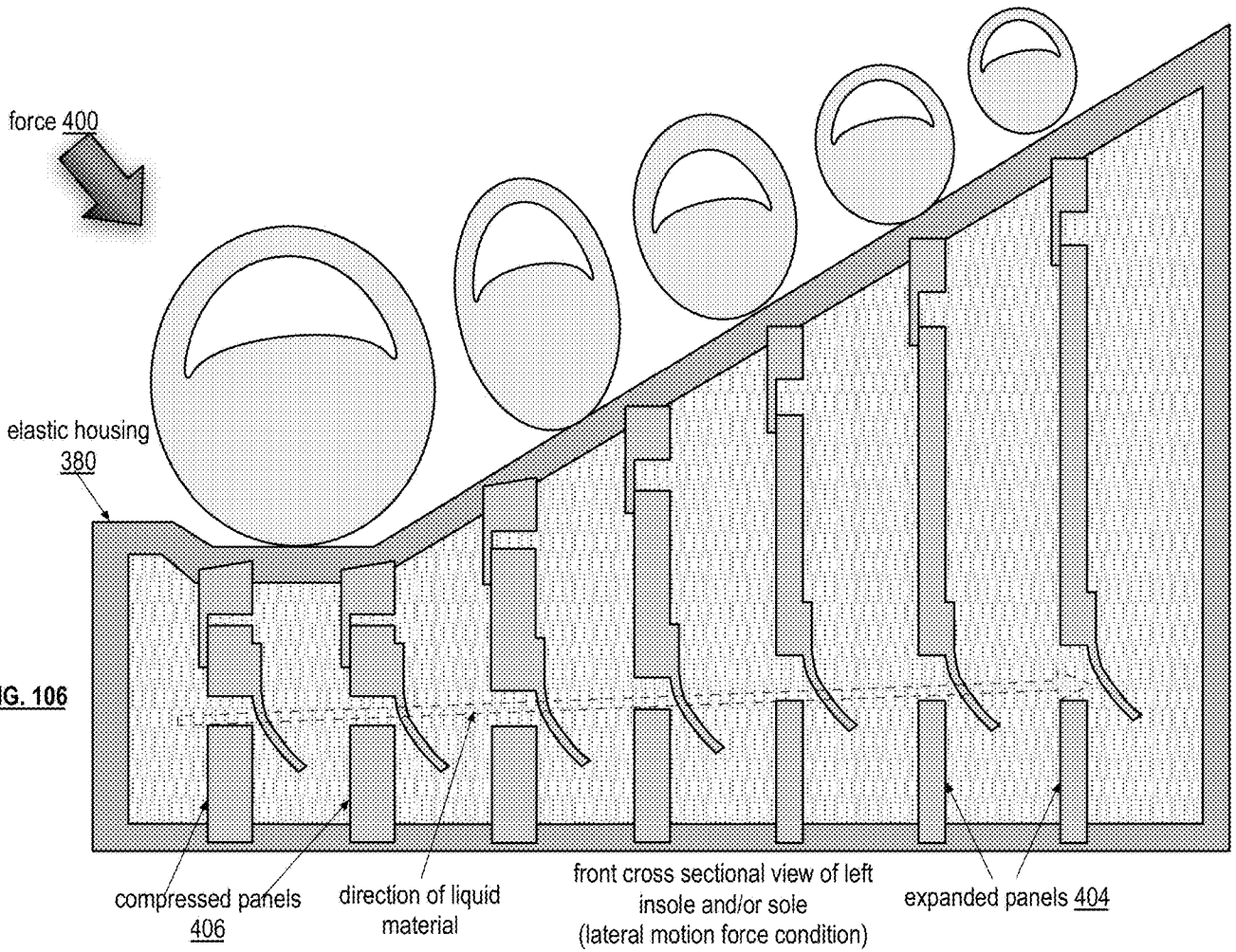
FIG. 106 illustrates a cross-sectional front view diagram of another embodiment of an adjustable athletic positioning sole and/or insole in accordance with the present invention.

FIG. 106 illustrates a cross-sectional front view diagram of another embodiment of the sole/insole assembly of FIG. 103 under a force (e.g., due to a lateral movement) as shown. In this example, more force 400 is being applied at the big toe and inner ball of foot area than at the outer edge. This puts greater force on the chambers below the big toe and inner ball of foot area than in the chambers under the outer edge of the foot. Once the pressure between an inner chamber and an adjacent outer chamber exceeds a rigidity factor of the larger flaps (e.g., a measure of how much force is needed for the flap to open), the flaps open and the liquid material 384 flows through the corresponding larger holes from the inner chamber to the adjacent outer chamber.

In this load condition, the panels under the big toe and ball of foot area are compressed. Conversely, the panels under the outer edge of the sole/insole assembly are expanded. In addition, since the elastic housing 380 is more elastic at the outer edge of the sole/insole assembly than at the inner edge, the liquid material 394 expands the outer chambers 404 more readily than the inner chambers 406. Accordingly, the angle form the outer edge to the inner edge increases with respect to the angle during the no load steady-state condition. To insure that the holes do not close during such forces, the holes may include grommets to hold their shape.

If too much pressure builds up in the outer chambers versus an adjacent inner chamber, one or more of the smaller flaps may open to allow the liquid material to flow to the adjacent inner chamber. Note that ratio between the larger holes and the smaller holes favors flow 410 of the liquid material from the inner chambers to the outer chambers. Further note that when the force is removed (e.g., return to a no load steady state), the larger flaps close and some of the smaller flaps open until the no load steady state condition is substantially achieved.

Figure 107:
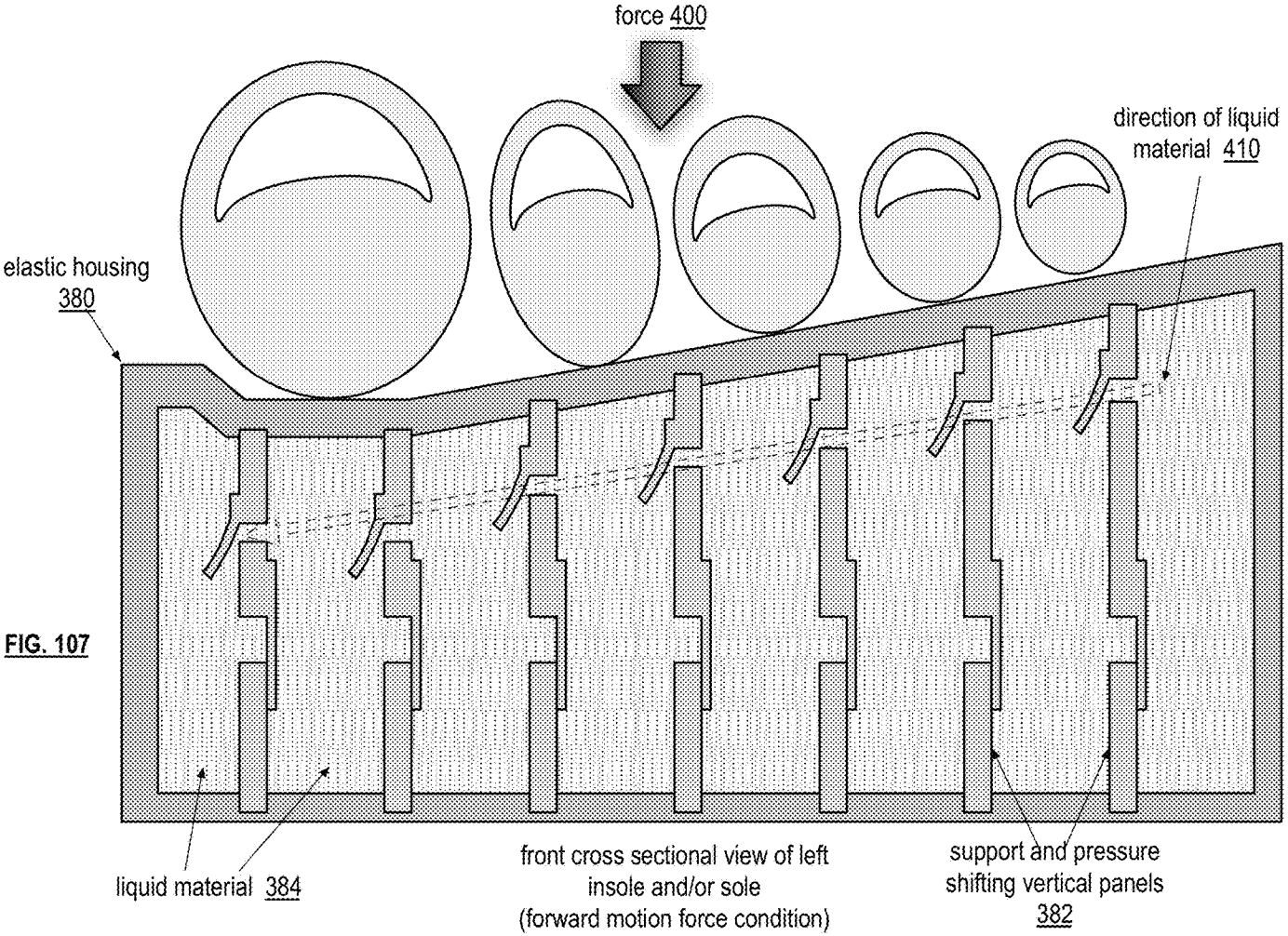
FIG. 107 illustrates a cross-sectional front view diagram of another embodiment of an adjustable athletic positioning sole and/or insole in accordance with the present invention.

FIG. 107 illustrates a cross-sectional front view diagram of another embodiment of the sole/insole assembly of FIG. 103 under a force 400 (e.g., due to a forward or backward movement or on the outer edge of the shoe) as shown. In this example, less force 400 is being applied at the big toe and inner ball of foot area than at the outer edge. This puts less force on the chambers below the big toe and inner ball of foot area than in the chambers under the outer edge of the foot. Once the pressure between an outer chamber and an adjacent inner chamber exceeds a rigidity factor of the larger flaps 382 (e.g., a measure of how much force is needed for the flap to open), the flaps open and the liquid material flows 410 through the corresponding smaller holes from the outer chamber to the adjacent inner chamber.

In this load condition, the panels under the big toe and ball of foot area are substantially uncompressed. Conversely, the panels under the outer edge of the sole/insole assembly are compressed. In addition, since the elastic housing 380 is more elastic at the outer edge of the sole/insole assembly than at the inner edge, the liquid material contracts the outer chambers less readily than the inner chambers. Accordingly, the angle form the outer edge to the inner edge decreases (or at least stays approximately the same) with respect to the angle during the no load steady-state condition.

If too much pressure builds up in the inner chambers versus an adjacent outer chamber, one or more of the larger flaps may open to allow the liquid material to flow to the adjacent outer chamber. Note that when the force is removed (e.g., return to a no load steady state), the smaller flaps close and some of the larger flaps open until the no load steady state condition is substantially achieved.

Figure 108:
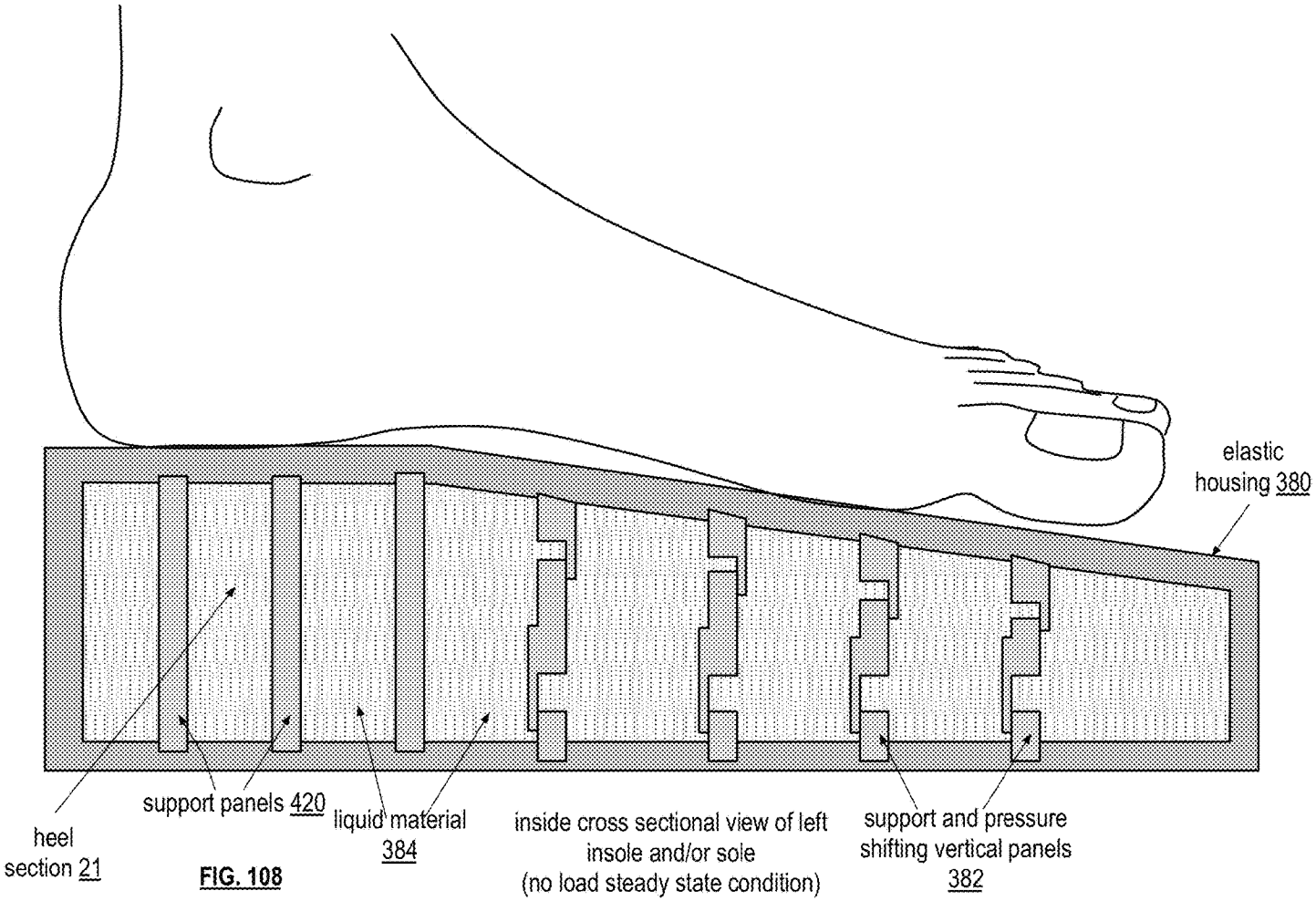
FIG. 108 illustrates a cross-sectional side view diagram of another embodiment of an adjustable athletic positioning sole and/or insole in accordance with the present invention.

FIG. 108 illustrates a cross-sectional side view diagram of another embodiment of the sole/insole assembly of FIG. 103 in the no load steady state condition. From a side perspective, the sole/insole assembly includes the elastic housing 380, a plurality of support panels 420, the plurality of support and pressure shifting panels 382, and the liquid material 384. The plurality of support panels 420 is located under the heel platform and provides substantially equal support for the heel. In the heel section 21, the panels do not include release holes or flaps, so the liquid material 384 does not flow between the chambers of the heel section.

Under the support platform for the remainder of the foot, and in the no load, steady-state condition, the flaps of the panels are closed and the liquid material 384 is approximately equally distributed in the chambers between the panels. Note that equal distribution of the liquid material 384 (e.g., gel, water, an oil, etc.) may be volume based and/or based on substantially equal pressure applied on the panels. In this state, the sole/insole assembly has a shape corresponding to one of the athletic positioning shapes.

Figure 109:
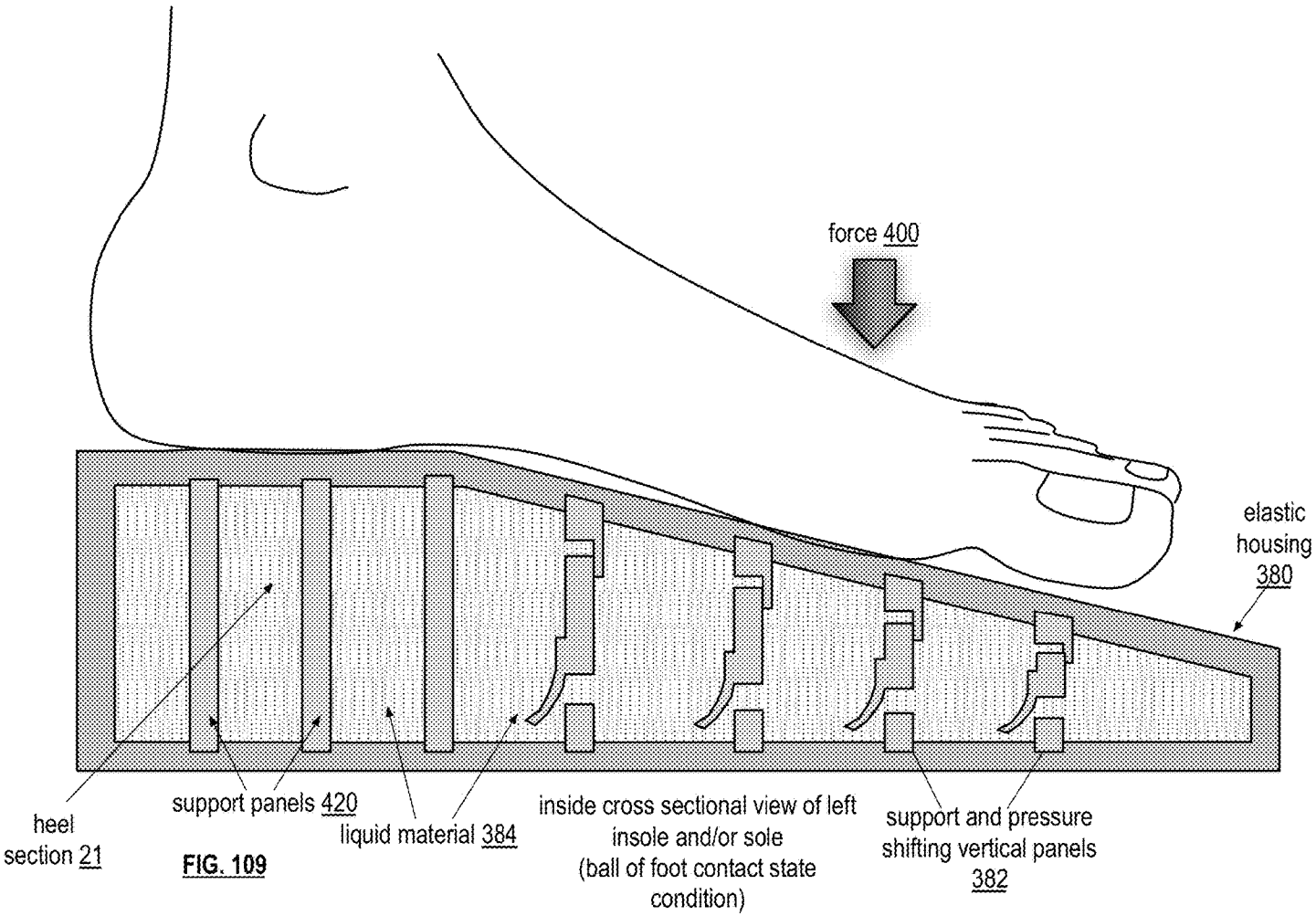
FIG. 109 illustrates a cross-sectional side view diagram of another embodiment of an adjustable athletic positioning sole and/or insole in accordance with the present invention.

FIG. 109 illustrates a cross-sectional side view diagram of another embodiment of the sole 10/insole 12 assembly of FIG. 103 under a force 400 (e.g., due to a lateral movement or forward/backward movement) as shown. In this example, more force 400 is being applied at the big toe and ball of foot area than near the heel. This puts greater force on the chambers below the big toe and ball of foot area than in the chambers under the heel. Once the pressure between a forward chamber and an adjacent rearward chamber exceeds a rigidity factor of the larger flaps (e.g., a measure of how much force is needed for the flap to open), the flaps open and the liquid material 384 flows through the corresponding larger holes from the forward chamber to the adjacent rearward chamber.

In this load condition, the panels 382 under the big toe and ball of foot area are compressed. Conversely, the panels under the near heel section are expanded. In addition, since the elastic housing is more elastic at the near heel section of the sole/insole assembly than at the toe section 25, the liquid material 384 expands the rearward chambers more readily than the forward chambers. Accordingly, the angle form the near heel section to the toe section 25 increases with respect to the angle during the no load steady-state condition.

If too much pressure builds up in the rearward chambers versus an adjacent forward chamber, one or more of the smaller flaps may open to allow the liquid material 384 to flow to the adjacent forward chamber. Note that when the force 400 is removed (e.g., return to a no load steady state), the larger flaps close and some of the smaller flaps open until the no load steady state condition is substantially achieved.

Figure 110:
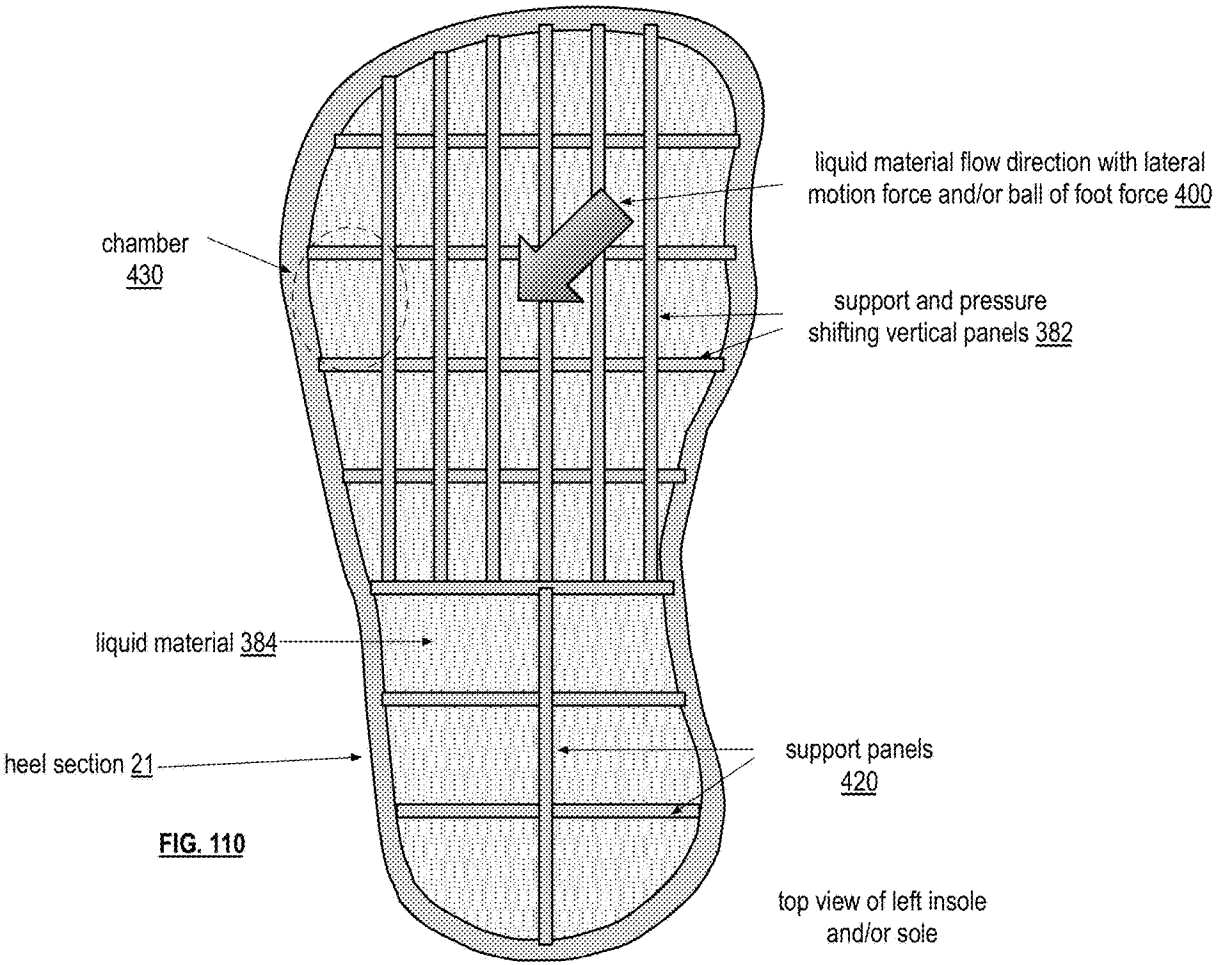
FIG. 110 illustrates a cross-sectional top view diagram of another embodiment of an adjustable athletic positioning sole and/or insole in accordance with the present invention.

FIG. 110 illustrates a cross-sectional top view diagram of another embodiment of the sole/insole assembly of FIG. 103. The heel section 21 includes fixed chambers 430 that do not allow the liquid material 384 to flow between the heel section chambers. The remaining sections of the sole/insole assembly include chambers that have panels 382 that allow the liquid metal to flow between the chambers. To promote an athletic position, the panels are orientated such that the flow of the liquid material favors the direction of the arrow during a lateral movement.

Figure 111:
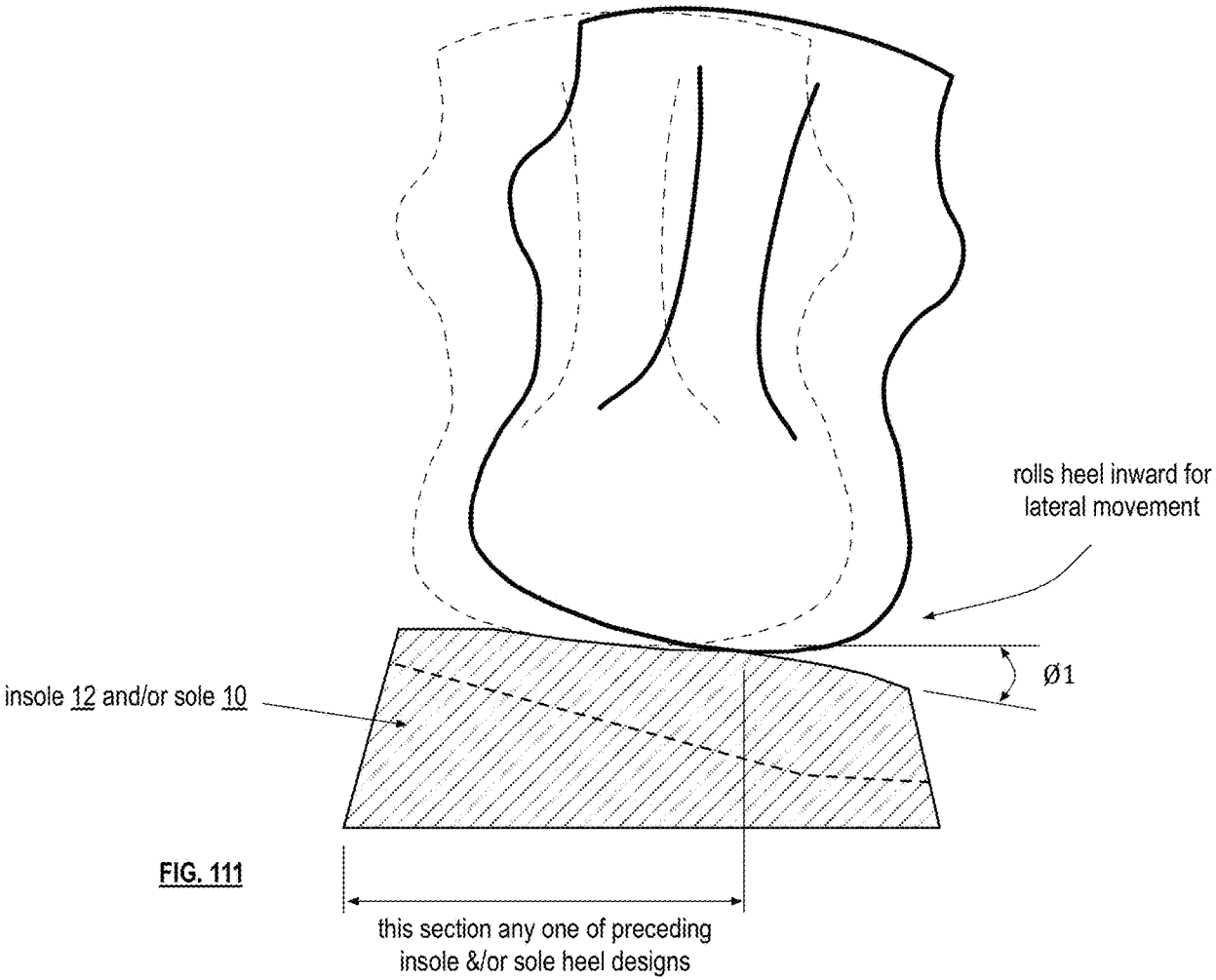
FIG. 111 illustrates a cross-sectional heel view diagram of another embodiment of a varying positioning athletic positioning sole and/or insole in accordance with the present invention.

FIG. 111 illustrates a cross-sectional heel view diagram of another embodiment of a varying positioning athletic positioning sole/insole assembly, which includes a sole 10, an insole 12, and a sport specific bottom 190. The sole 10 may include a conventional sole design for a specific sport (or other use) or it may include one of the athletic positioning shapes. In addition, the sole may be comprised of a conventional sole material and/or one or more rigid materials. Note that the conventional sole material and the rigid materials are not mutually exclusive.

The insole 12 may have a conventional insole shape or a shape corresponding to one of the athletic positioning shapes. The insole may be adjustable and is comprised of one or more rigid materials, one or more recoil materials, and/or one or more compressible materials. The insole may be mechanically coupled to the sole or it may just rest on the sole (i.e., not glued, stitched, fused, etc.) and may further include an integrated arch support.

From the heel perspective, the sole/insole assembly further includes an inward slope from a near middle point to the inner edge, which has an angle (e.g., Ø1). The angle may be in the range of a fraction of a degree to about 10 degrees. When a forward or backward movement force is applied to the sole/insole assembly, the non-angled section primarily supports the heel, which remains substantially parallel to the bottom of the sole/insole assemble. When a lateral movement force is applied, the angled section at least partially supports the heel such that a greater inward angling of the foot is achieved during athletic positioning.

Figure 112:
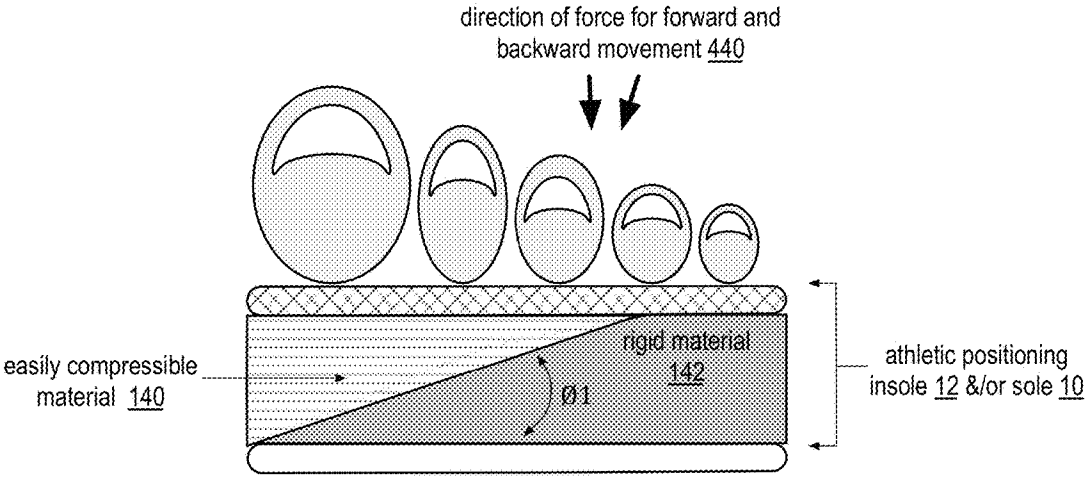
FIG. 112 illustrates a cross-sectional front view diagram of another embodiment of a varying positioning athletic positioning sole and/or insole in accordance with the present invention.

FIG. 112 illustrates a cross-sectional front view diagram of another embodiment of a varying positioning athletic positioning sole/insole assembly that includes an outersole, a sole-insole section, and an inner sole. The outersole may be a sport specific bottom, a casual shoe bottom, or a dress shoe bottom. The inner sole includes a rigid-flexible platform that may include a padding layer and/or an arch support layer.

The sole/insole section includes a rigid material section 142 and an easily compressible section 140. The rigid material section is comprised of one or more rigid materials and has a shape corresponding to one of the athletic positioning shapes. The easily compressible section is comprised of one or more easily compressible materials (e.g., foam, memory foam, soft rubber, a housing filled with a liquid material, etc.) and has a mating shape to that of the rigid material section 142 such that, under a no load condition, the combination of the rigid material section and the easily compressible material section provide a conventional sole shape or a slight athletic positioning shape (e.g., angles less than a few degrees).

Under a forward or backward movement force 440, the easily compressible material compresses slightly, such that the sole/insole assembly substantially maintains its no load shape. This condition is achieved by having more of the force 400 supported by the flat section of the rigid material section than the angled section.

Figure 113:
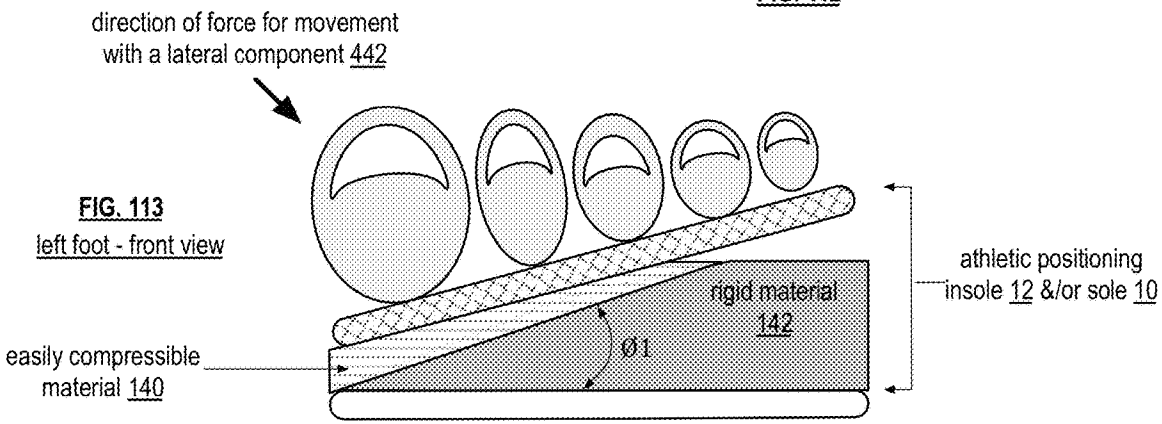
FIG. 113 illustrates a cross-sectional front view diagram of another embodiment of a varying positioning athletic positioning sole and/or insole in accordance with the present invention.

FIG. 113 illustrates a cross-sectional front view diagram of another embodiment of a varying positioning athletic positioning sole/insole assembly of FIG. 112 under a lateral movement force 442. In this diagram, the angled section of the rigid material 142 is supporting more of the force than that being supported by the flat section such that the easily compressible material 140 compresses and the inner sole tilts. The tilting of the inner sole facilitates an athletic positioning. Note that the inner sole may be somewhat flexible to allow it to conform to the athletic positioning shape.

Figure 114:
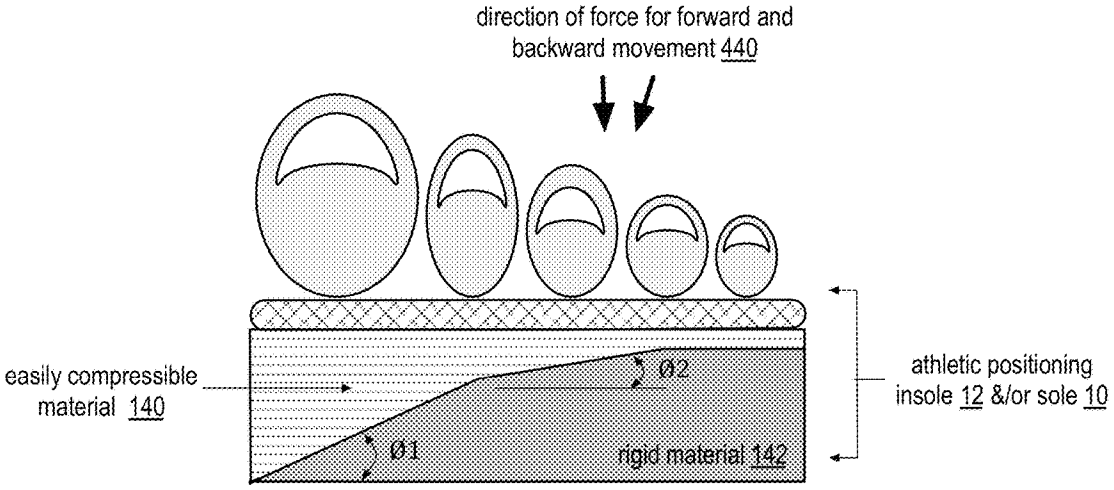
FIG. 114 illustrates a cross-sectional front view diagram of another embodiment of a varying positioning athletic positioning sole and/or insole in accordance with the present invention.

FIG. 114 illustrates a cross-sectional front view diagram of another embodiment of a varying positioning athletic positioning sole/insole assembly that includes an outersole, a sole-insole section, and an inner sole. The outersole may be a sport specific bottom, a casual shoe bottom, or a dress shoe bottom. The inner sole includes a rigid-flexible platform that may include a padding layer and/or an arch support layer.

The sole-insole section includes a rigid material section 142 and an easily compressible section 140. The rigid material section 142 is comprised of one or more rigid materials and has a basic shape corresponding to one of the athletic positioning shapes, but has two angles for the angled support platform. The easily compressible section 140 is comprised of one or more easily compressible materials (e.g., foam, memory foam, soft rubber, a housing filled with a liquid material, etc.) and has a mating shape to that of the rigid material section such that, under a no load condition, the combination of the rigid material section and the easily compressible material section provide a conventional sole shape or a slight athletic positioning shape (e.g., angles less than a few degrees).

Under a forward or backward movement force 440, the easily compressible material 140 compresses slightly, such that the sole/insole assembly substantially maintains its no load shape. This condition is achieved by having more of the force supported by the flat section of the rigid material section 142 than the angled section.

Figure 115:
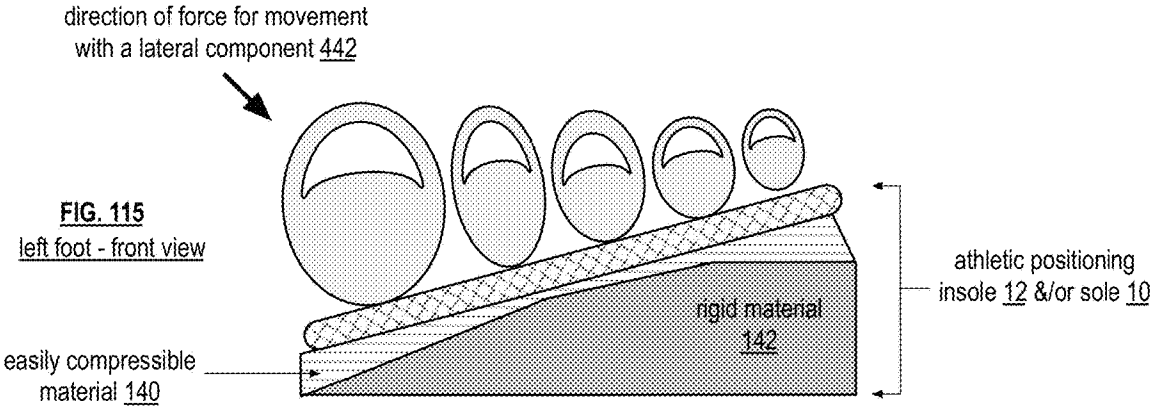
FIG. 115 illustrates a cross-sectional front view diagram of another embodiment of a varying positioning athletic positioning sole and/or insole in accordance with the present invention.

FIG. 115 illustrates a cross-sectional front view diagram of another embodiment of a varying positioning athletic positioning sole/insole assembly of FIG. 114 under a lateral movement force 442. In this diagram, the angled sections of the rigid material are supporting more of the force than the flat section such that the easily compressible material 140 compresses and the inner sole tilts. The more lateral movement force the greater the tilt of the inner sole. The tilting of the inner sole facilitates an athletic positioning.

Figure 117:
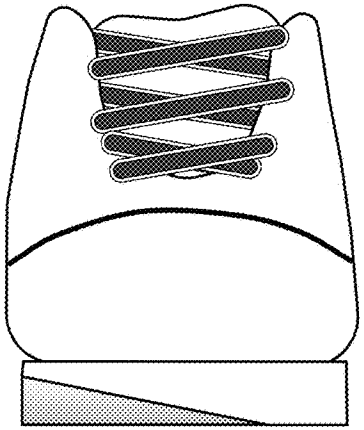
FIG. 117 illustrates a front view diagram of an embodiment of a training shoe that includes an athletic positioning sole in accordance with the present invention.
Figure 116:
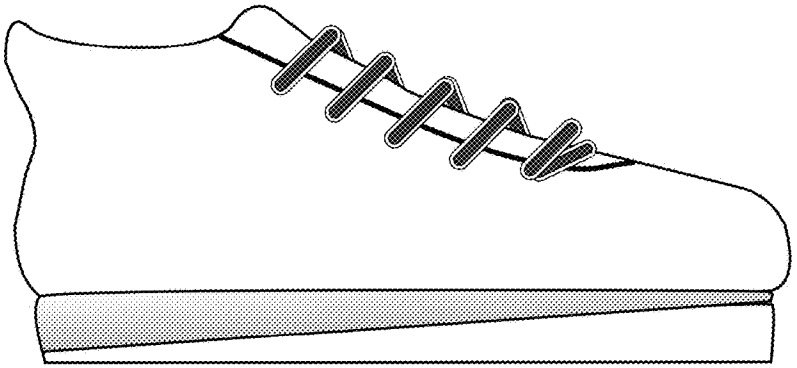
FIG. 116 illustrates a side view diagram of an embodiment of a training shoe that includes an athletic positioning sole in accordance with the present invention.
Figure 118:
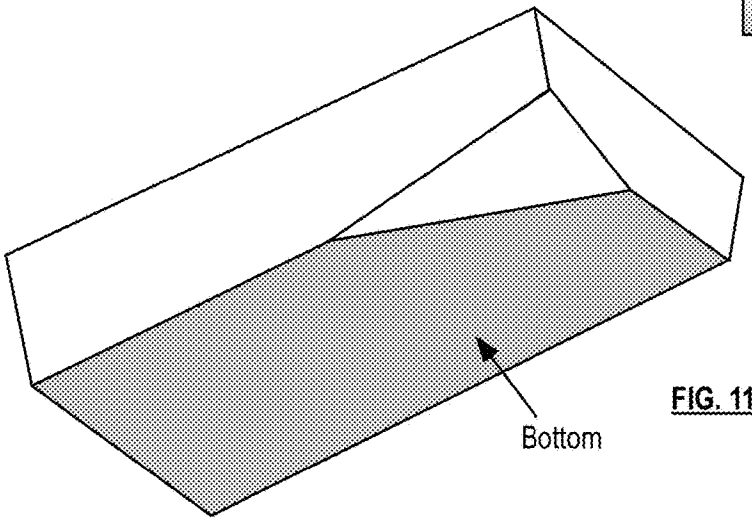
FIG. 118 illustrates an isometric view diagram of an embodiment of an athletic positioning sole of a training shoe in accordance with the present invention.

FIGS. 116-118 illustrate a side view diagram, a front view diagram, and an isometric view diagram of an embodiment of a training shoe that includes an athletic positioning sole. The sole 10 includes an angled notch portion to facilitate achieving the desired athletic position. The angles of the angled notch portion may be greater than the angles of an insole/sole assembly to accentuate training the body to achieve a desired athletic positioning.

Figure 120:
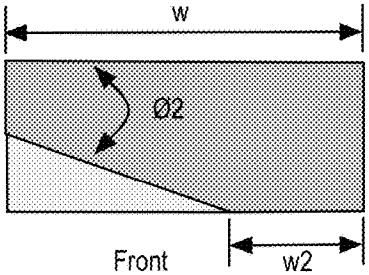
FIG. 120 illustrates a front view diagram of another embodiment of an athletic positioning sole of a training shoe in accordance with the present invention.
Figure 119:
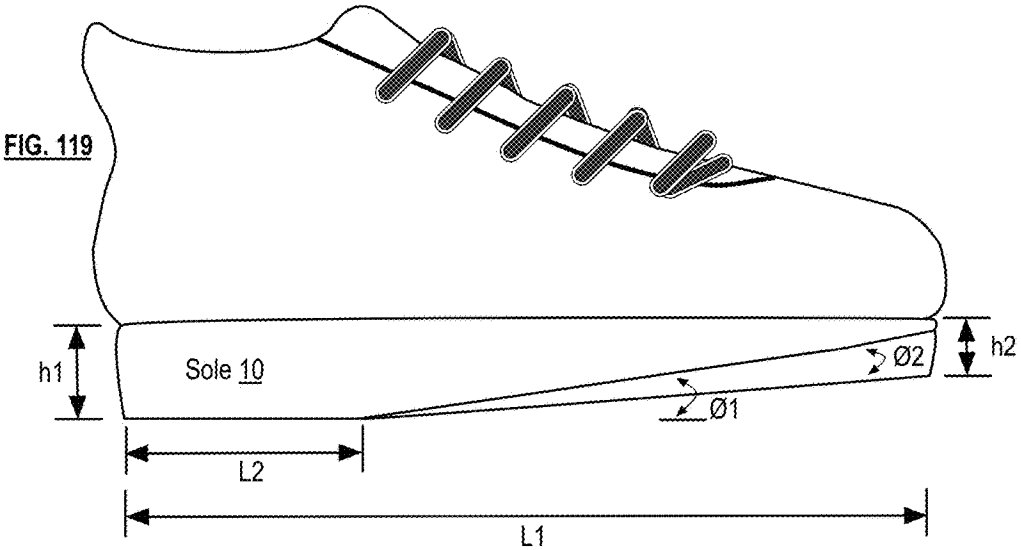
FIG. 119 illustrates a side view diagram of another embodiment of a training shoe that includes an athletic positioning sole in accordance with the present invention.
Figure 121:
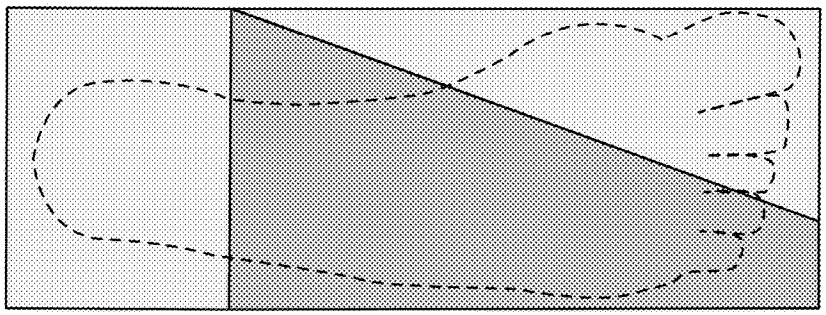
FIG. 121 illustrates a bottom view diagram of another embodiment of an athletic positioning sole of a training shoe in accordance with the present invention.

FIGS. 119-121 illustrate a side view diagram, a front view diagram, and a bottom view diagram of another embodiment of a training shoe that includes an athletic positioning sole. The sole 10 includes an athletic positioning shape to facilitate achieving the desired athletic position. The angles of the athletic positioning shape may be greater than the angles of an insole/sole assembly to accentuate training the body to achieve a desired athletic positioning.

Figure 123:
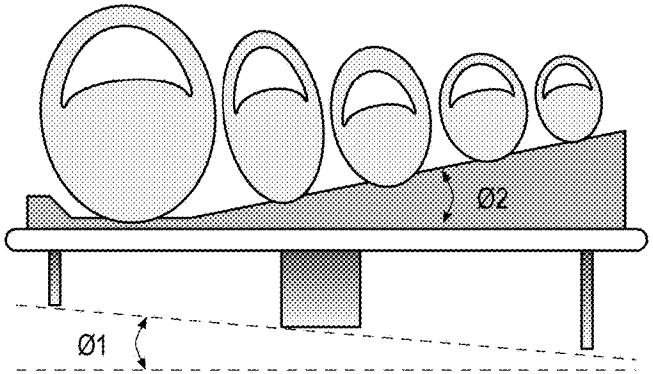
FIG. 123 illustrates a front view diagram of an embodiment of baseball spikes that include an athletic positioning spike pattern in accordance with the present invention.
Figure 122:
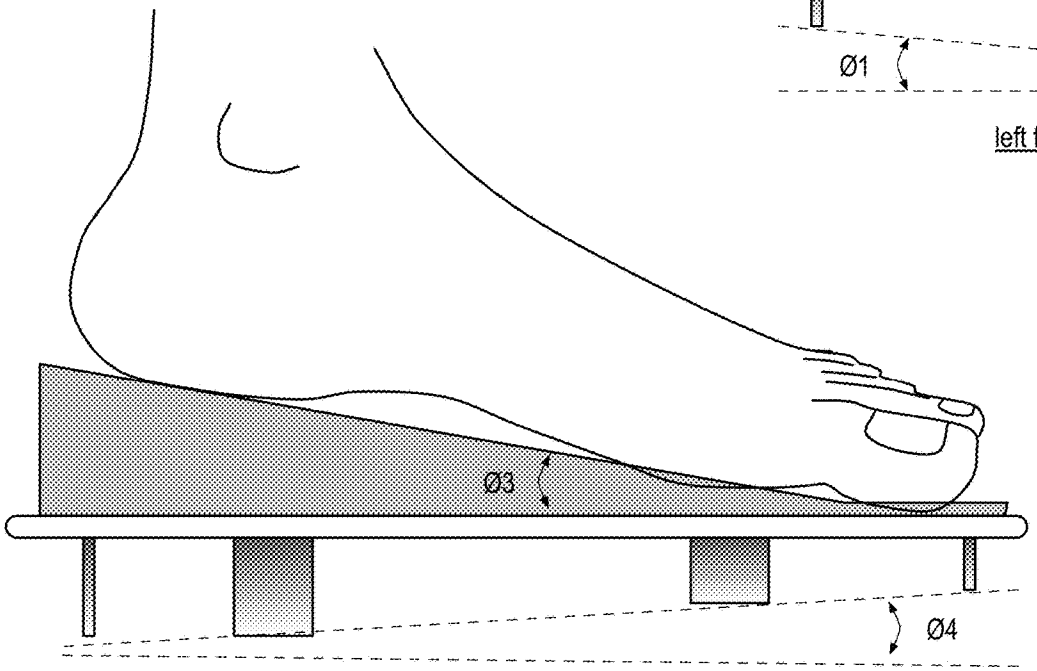
FIG. 122 illustrates a side view diagram of an embodiment of baseball spikes that include an athletic positioning spike pattern in accordance with the present invention.

FIGS. 122 and 123 illustrate a side view diagram and a front view diagram of an embodiment of baseball spikes that include an athletic positioning spike pattern. The baseball spikes include an insole/sole assembly, an outersole, and an upper shoe (not shown). The insole/sole assembly includes a sole 10 and an insole 12. The sole 10 may include a conventional sole design or it may include one of the athletic positioning shapes. In addition, the sole 10 may be comprised of a conventional sole material and/or one or more rigid materials. Note that the conventional sole material and the rigid materials are not mutually exclusive.

The insole 12 may have a conventional insole shape or a shape corresponding to one of the athletic positioning shapes. The insole may be adjustable and is comprised of one or more rigid materials, one or more recoil materials, and/or one or more compressible materials. The insole may be mechanically coupled to the sole or it may just rest on the sole (i.e., not glued, stitched, fused, etc.) and may further include an integrated arch support.

The spikes may have differing heights to form one of the athletic positioning shapes. Accordingly, the spikes underneath the heel are the longest and the spike or spikes underneath the big toe and/or inner ball of foot are the shortest. The other spikes are of a length between the longest and shorted depending on their position. Note that the spikes may be metal spikes, plastic cleats, changeable plastic cleats, and/or a combination thereof. Further note that the same concept applies to football cleats, soccer cleats, golf shoes, track shoes, and any other sport shoes that include cleats and/or spikes.

Figure 124:
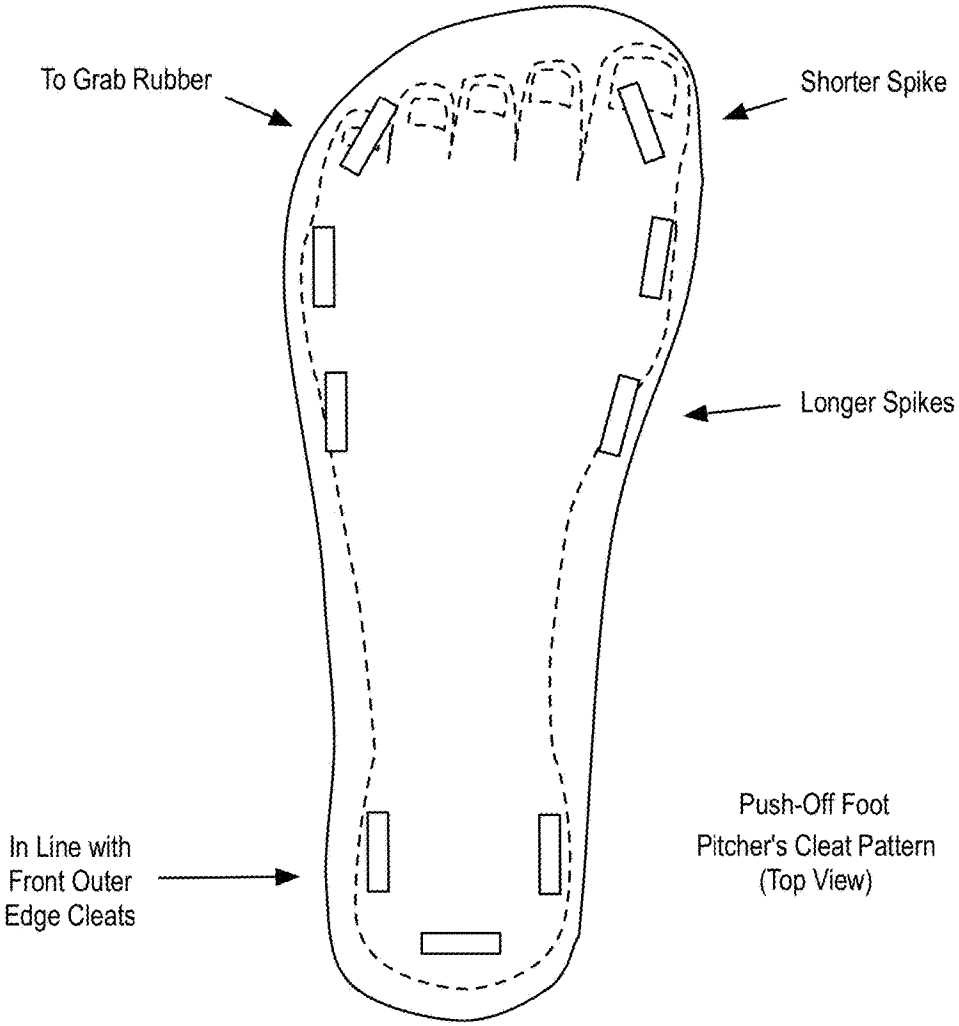
FIG. 124 illustrates a top view diagram of another embodiment of baseball spikes that include an athletic positioning spike pattern in accordance with the present invention.

FIG. 124 illustrates a bottom view diagram of another embodiment of baseball spikes that include spike pattern for the drive leg of a pitcher. The spike pattern may also include the athletic positioning pattern of FIGS. 122 and 123. The baseball spikes may also include the sole/insole assembly of FIGS. 122 and 123.

The pitcher drive leg spike pattern includes two or three spikes aligned with the big toe and the inner ball of the foot. This row of spikes may be used to engage the pitching rubber such that multiple spikes are engaging the rubber. The pitcher drive leg spike pattern further includes two or three spikes along the outer edge of the toe and ball of foot area. These spikes may be linearly aligned, may be positioned along a line that outlines the outer edge of the toes and ball of foot, or may be positioned in another manner. A set of heel spikes may be positioned in a conventional manner. Note that the pitcher's drive leg spike pattern does not include a spike at the top of the shoe under the middle toe(s). Further note that the spikes may be metal spikes and/or plastic cleats.

Figure 125:
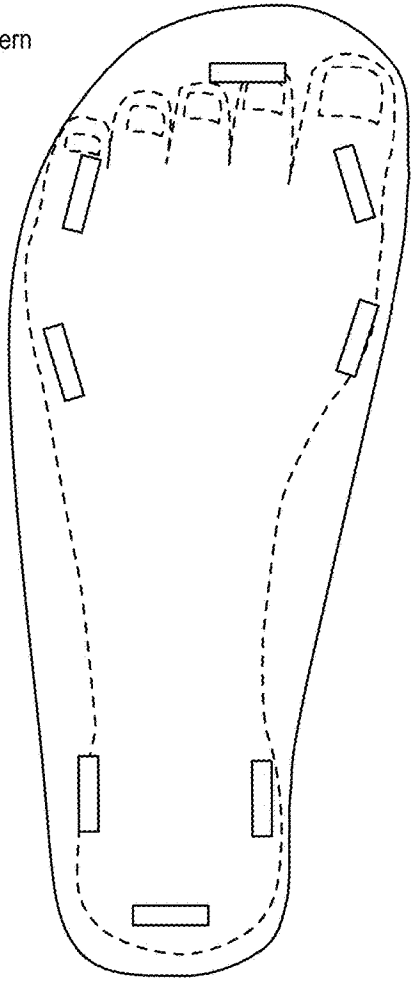
FIG. 125 illustrates a top view diagram of another embodiment of baseball spikes that include an athletic positioning spike pattern in accordance with the present invention.

FIG. 125 illustrates a bottom view diagram of another embodiment of baseball spikes that includes a spike pattern for the plant leg of a pitcher. The spike pattern may also include the athletic positioning pattern of FIGS. 122 and 123. The baseball spikes may also include the sole/insole assembly of FIGS. 122 and 123.

The spike pattern for the plant leg of pitcher includes a conventional heel spike configuration and a ball of foot and toe pattern to firmly plant the spikes into the pitching mound. The ball of foot and toe spike pattern may be as shown.

Note that a pair of baseball spikes may include outer-soles that allow for the spike pattern to be changed depending on whether the wearer is left-handed or right-handed. For example, a left-handed pitcher would configure the spike pattern of FIG. 124 for his/her left foot and the spike pattern of FIG. 125 for his/her right foot. Conversely, a right-handed pitcher would configure the spike pattern of FIG. 125 for his/her right foot and the spike pattern of FIG. 125 for his/her left foot.

Figure 126:
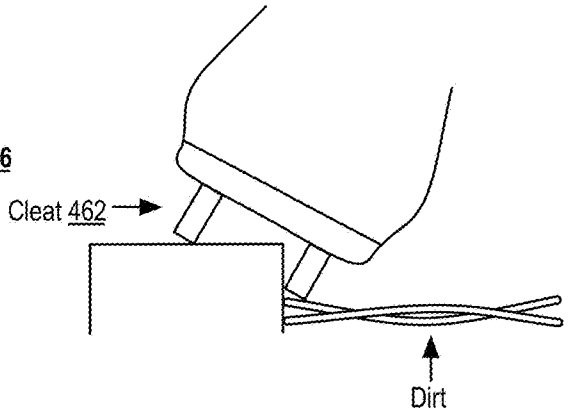
FIG. 126 illustrates a heel view diagram of another embodiment of baseball spikes that include an athletic positioning spike pattern in accordance with the present invention.
Figure 127:
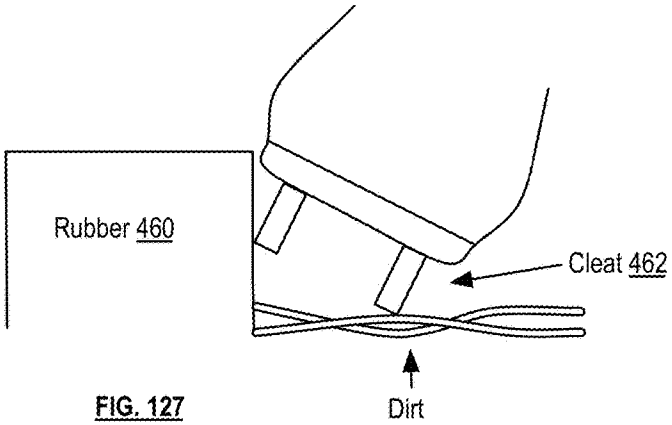
FIG. 127 illustrates a heel view diagram of another embodiment of baseball spikes that include an athletic positioning spike pattern in accordance with the present invention.

FIGS. 126 and 127 illustrate heel view diagrams of another embodiment of baseball spikes of FIGS. 122-125 engaging a pitching rubber 460. As shown in FIG. 126, the row of spikes 462 under the big toe and inner ball of foot area is engaging the rubber. As shown in FIG. 127, the outer row of spikes 462 is engaging the rubber 460. Note that the angles of the spike pattern of FIGS. 122 and 123 may be adjusted depending on whether the inner or outer row of spikes 462 is used to engage the rubber. For instance, if the inner row of spikes are used to engage the rubber 460, the angles of the spike pattern may be less than when the outer row of spikes 462 are used since the rubber adds to achieving the desired athletic positioning when the inner row of spikes 462 are engaging the rubber 460.

Figure 128:
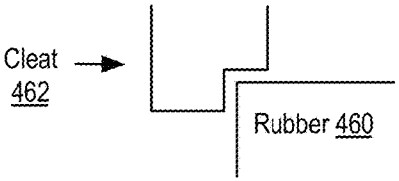
FIG. 128 illustrates a diagram of an embodiment of a spike for baseball spikes that include an athletic positioning spike pattern in accordance with the present invention.

FIG. 128 illustrates a diagram of an embodiment of a spike for baseball spikes. The baseball spikes may include a spike pattern of one or more of FIGS. 122-127 and may further include the sole/insole assembly of FIGS. 122 and 123. In this embodiment, one or more of the spikes 462 that engage the rubber 460 includes a notch to facilitate a secure engagement with the rubber 460. The notch may be along a major edge of the spike 462 (e.g., a rear view of the spike is shown in the present figure). Alternatively, the spike may include one or more sides (forming an L or a C shape from a top perspective) where one or more of the sides include the notch.

In another embodiment, the spike pattern of FIG. 124 further includes one or more spikes 462 that are perpendicular to the spikes at the big toe and/or ball of foot. The perpendicular spike(s) include a notch that is aligned with the inner row of spikes 462 to further improve engagement with the rubber 460.

Figure 129:
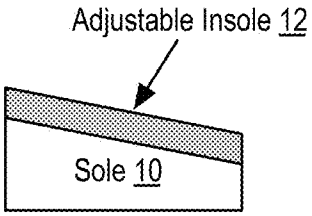
FIG. 129 illustrates a cross-section front view diagram of another embodiment of an athletic positioning pattern in accordance with the present invention.

FIG. 129 illustrates a cross-section front view diagram of another embodiment of an insertable sole/insole assembly that may be inserted into a pair of sport specific shoes (e.g., baseball spikes). The insertable sole/insole assembly includes a sole 10, an insole 12, and may further include an arch support. The sole 10 may include a conventional sole design for a specific sport (or other use) or it may include one of the athletic positioning shapes discussed herein. In addition, the sole 10 may be comprised of a conventional sole material and/or one or more rigid materials. Note that the conventional sole material and the rigid materials are not mutually exclusive.

The insole 12 includes a conventional insole shape or it has a shape corresponding to one of the athletic positioning shapes. The insole 12 may be adjustable and is comprised of one or more rigid materials, one or more recoil materials, and/or one or more compressible materials. The insole 12 may be mechanically coupled to the sole 10 or it may just rest on the sole 10 (i.e., not glued, stitched, fused, etc.). The arch support may be integrated into the athletic positioning insole or it may be a separate piece that is mechanically coupled to the insole or rests on the insole. The insertable sole/insole assembly may be used in combination with one or more of the heel attachments of FIGS. 130-139 to modify a conventional pair of baseball spikes into athletic positioning baseball spikes.

Figure 130:
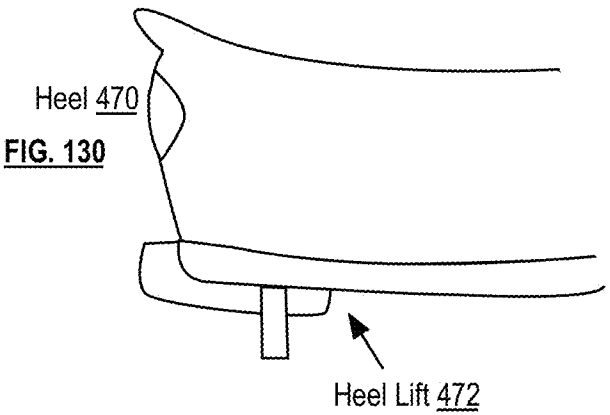
FIG. 130 illustrates a side view diagram of an embodiment of an athletic positioning heel attachment for baseball spikes in accordance with the present invention.
Figure 131:
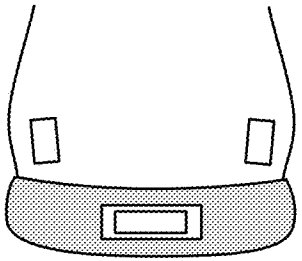
FIG. 131 illustrates a bottom view diagram of an embodiment of an athletic positioning heel attachment for baseball spikes in accordance with the present invention.
Figure 132:
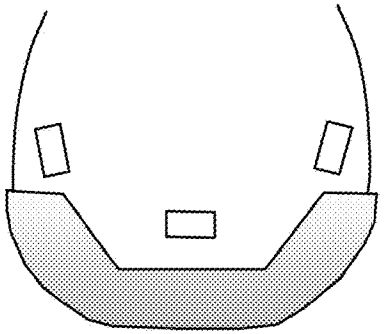
FIG. 132 illustrates a bottom view diagram of another embodiment of an athletic positioning heel attachment for baseball spikes in accordance with the present invention.

FIGS. 130-132 illustrate a side view diagram and a bottom view diagram of an embodiment of an athletic positioning heel attachment for baseball spikes. The heel attachment 472 includes a height, width, and depth to raise the heel of the baseball spikes with respect to the toe of the spikes by 5-20 mm. In addition, the heel attachment 472 may include one or more notches or holes to clear one or more of the spikes on the heel section 470 of the baseball spikes. Further, the heel attachment 472 may be comprised of one or more of the rigid materials and may be mechanically coupled (e.g., glued, stitched, riveted, fused, etc.) to the heel of the baseband spikes.

Figure 133:
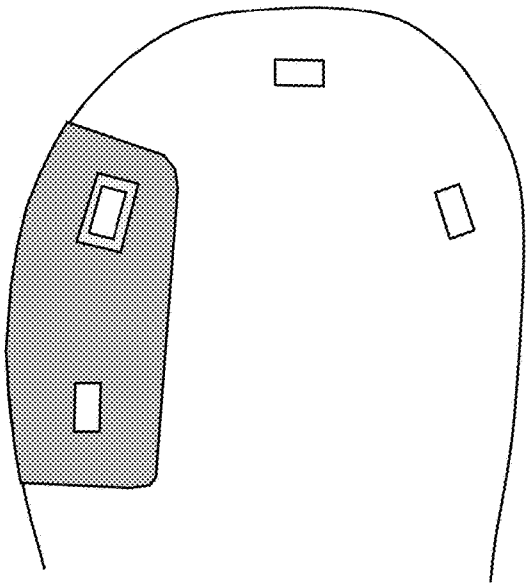
FIG. 133 illustrates a bottom view diagram of an embodiment of an athletic positioning toe and ball-of-foot attachment for baseball spikes in accordance with the present invention.

FIG. 133 illustrates a bottom view diagram of another embodiment of an athletic positioning attachment for baseball spikes that attaches to the outer edge of the ball of foot and toe section of the baseball spikes. The athletic positioning attachment 480 has a shape corresponding to the non-heel section of one of the athletic positioning shapes. In addition, the athletic positioning attachment may include one or more notches or holes to clear one or more spikes of the baseball spikes. Further, the athletic positioning attachment may be comprised of one or more of the rigid materials and may be mechanically coupled (e.g., glued, stitched, riveted, fused, etc.) to the heel of the baseband spikes.

Figure 134:
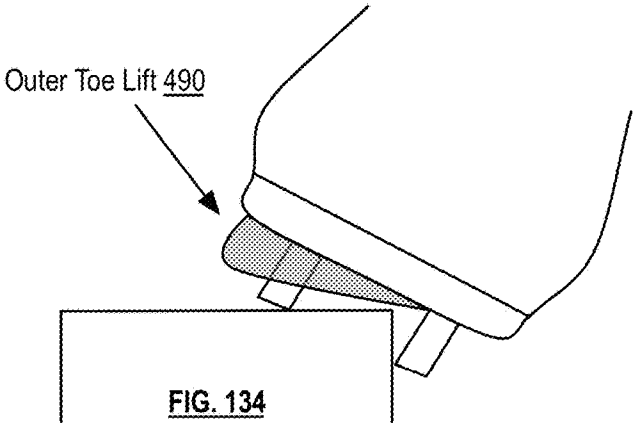
FIG. 134 illustrates a heel view diagram of another embodiment of an athletic positioning heel attachment for baseball spikes in accordance with the present invention.

FIG. 134 illustrates a heel view diagram of another embodiment of an athletic positioning attachment for baseball spikes. In this diagram, the athletic positioning attachment 490 is attached to a pitcher's drive leg baseball spike to provide a desired athletic positioning of the drive leg.

Figure 135:
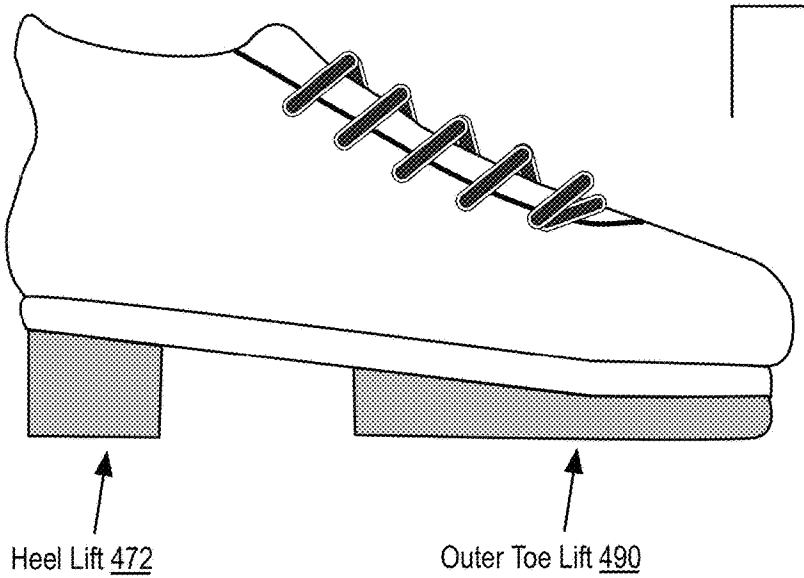
FIG. 135 illustrates a side view diagram of another embodiment of an athletic positioning heel attachment and athletic positioning toe and ball-of-foot attachment for baseball spikes in accordance with the present invention.

FIG. 135 illustrates a side view diagram of another embodiment of a heel attachment 472 and an athletic positioning attachment 490 attached to one of a pair of baseball spikes. The heel 472 and athletic positioning attachments 490 may be separate attachments as previously discussed with reference to FIGS. 130-134. Alternatively, the attachments may be a single attachment as discussed below.

Figure 138:
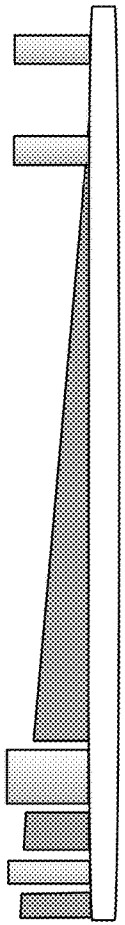
FIG. 138 illustrates an outside view diagram of an embodiment of an athletic positioning attachment for baseball spikes in accordance with the present invention.
Figure 136:
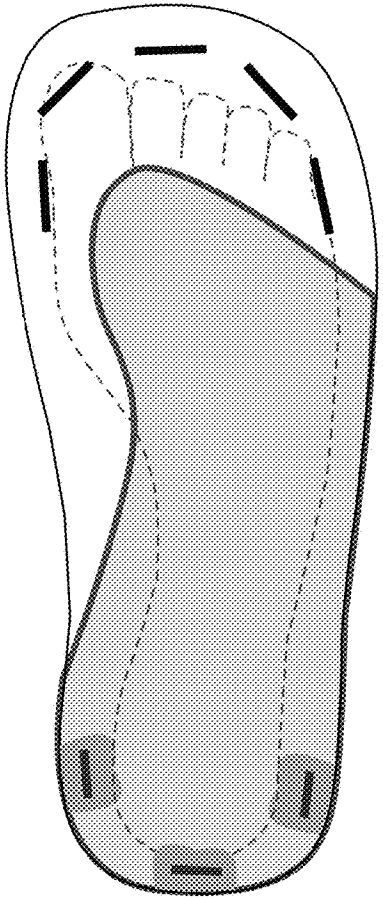
FIG. 136 illustrates a bottom view diagram of an embodiment of an athletic positioning attachment for baseball spikes in accordance with the present invention.
Figure 137:
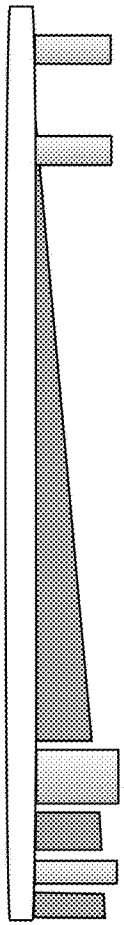
FIG. 137 illustrates an inside view diagram of an embodiment of an athletic positioning attachment for baseball spikes in accordance with the present invention.

FIGS. 136-138 illustrate a bottom view diagram, an inside view diagram, and an outside view diagram of an embodiment of an athletic positioning attachment for baseball spikes. The attachment 500 may have a shape corresponding to one of the athletic positioning shapes and may be comprised of one or more rigid materials. In addition, the attachment 500 may be mechanically coupled (e.g., glued, stitched, riveted, fused, etc.) to the outer-sole of the baseband spikes and may include one or more notches to provide clearance for one or more spikes.

Figure 139:
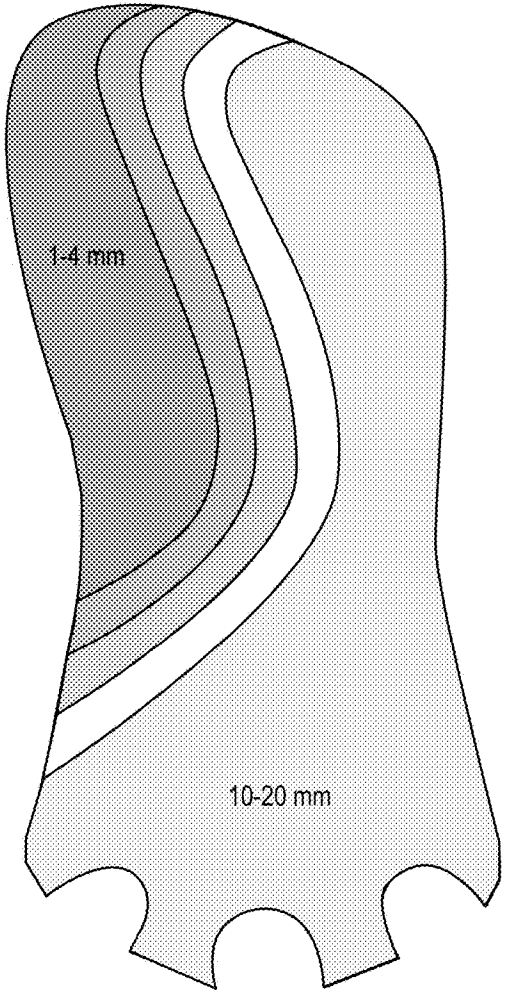
FIG. 139 illustrates a topological view diagram of an embodiment of an athletic positioning attachment for baseball spikes in accordance with the present invention.

FIG. 139 illustrates a topological view diagram of an embodiment of an athletic positioning attachment of FIGS. 136-138. The attachment has a topology that ranges from a thickness of 1-4 mm under the ball of foot to 10-20 mm under the heel.

Figure 140:
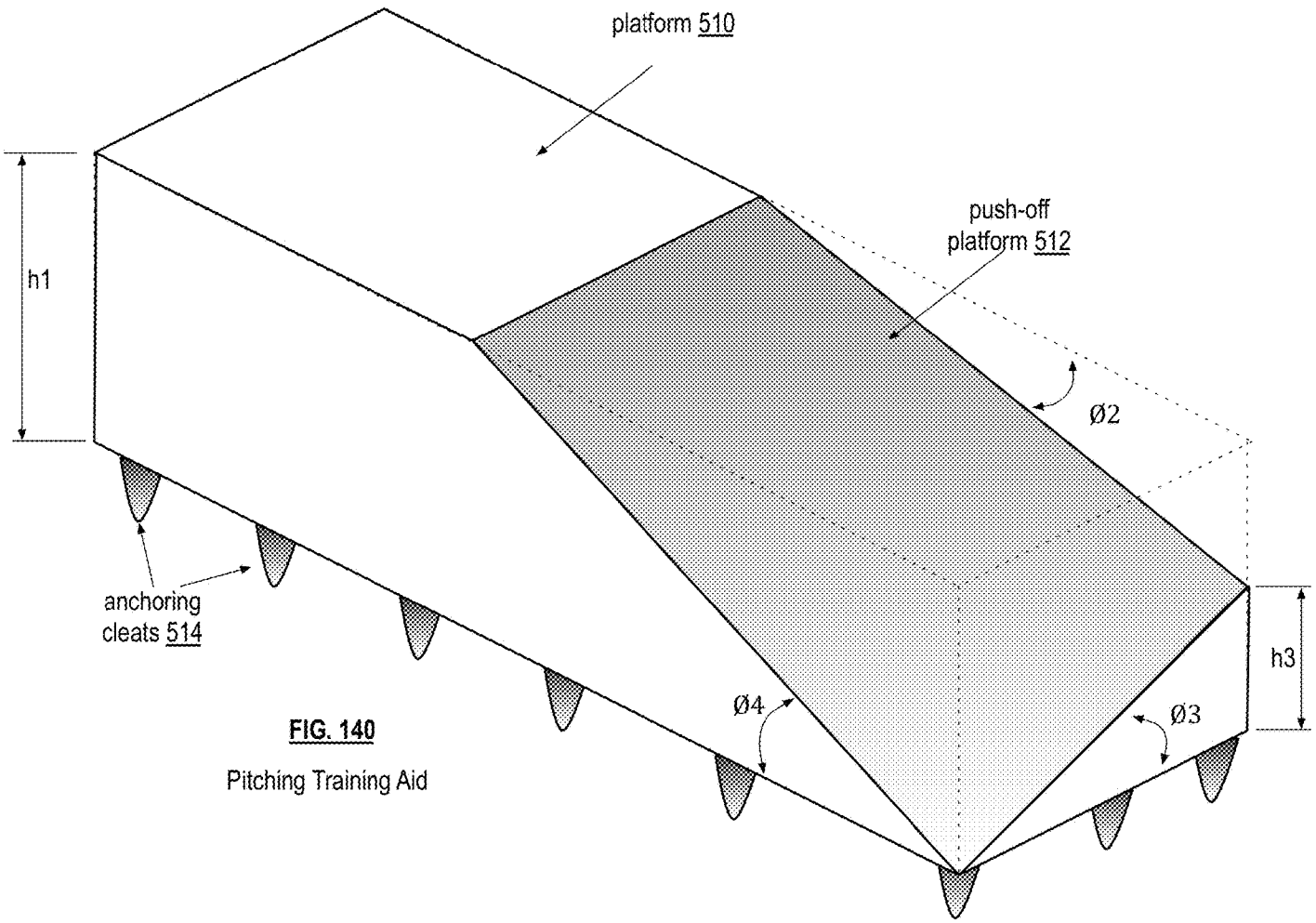
FIG. 140 illustrates an isometric view diagram of an embodiment of a pitching training aid that includes an athletic positioning shape in accordance with the present invention.

FIG. 140 illustrates an isometric view diagram of an embodiment of a pitching training aid that includes a platform 510, a push-off platform that has one of the athletic positioning shapes, and a plurality of anchoring cleats 514. In an example, the training aid has dimensions that include a height (h1) of 20-50 mm, a second height (h3) of 5-20 mm, a width of 75-125 mm, a length of 250-350 mm, and corresponding angles (Ø2, Ø3, and Ø4).

In use, the pitching training aid is placed in front of the rubber and secured into the pitching mound via the anchoring cleats. The pitcher places his/her drive leg shoe on the training aid 512 (e.g., on the push-off platform) such that his/her big toe and/or ball of foot is positioned at the lowest point the training aid and the heel is positioned at a higher point. This will help place the pitcher's drive leg to be in an athletic position.

Figure 141:
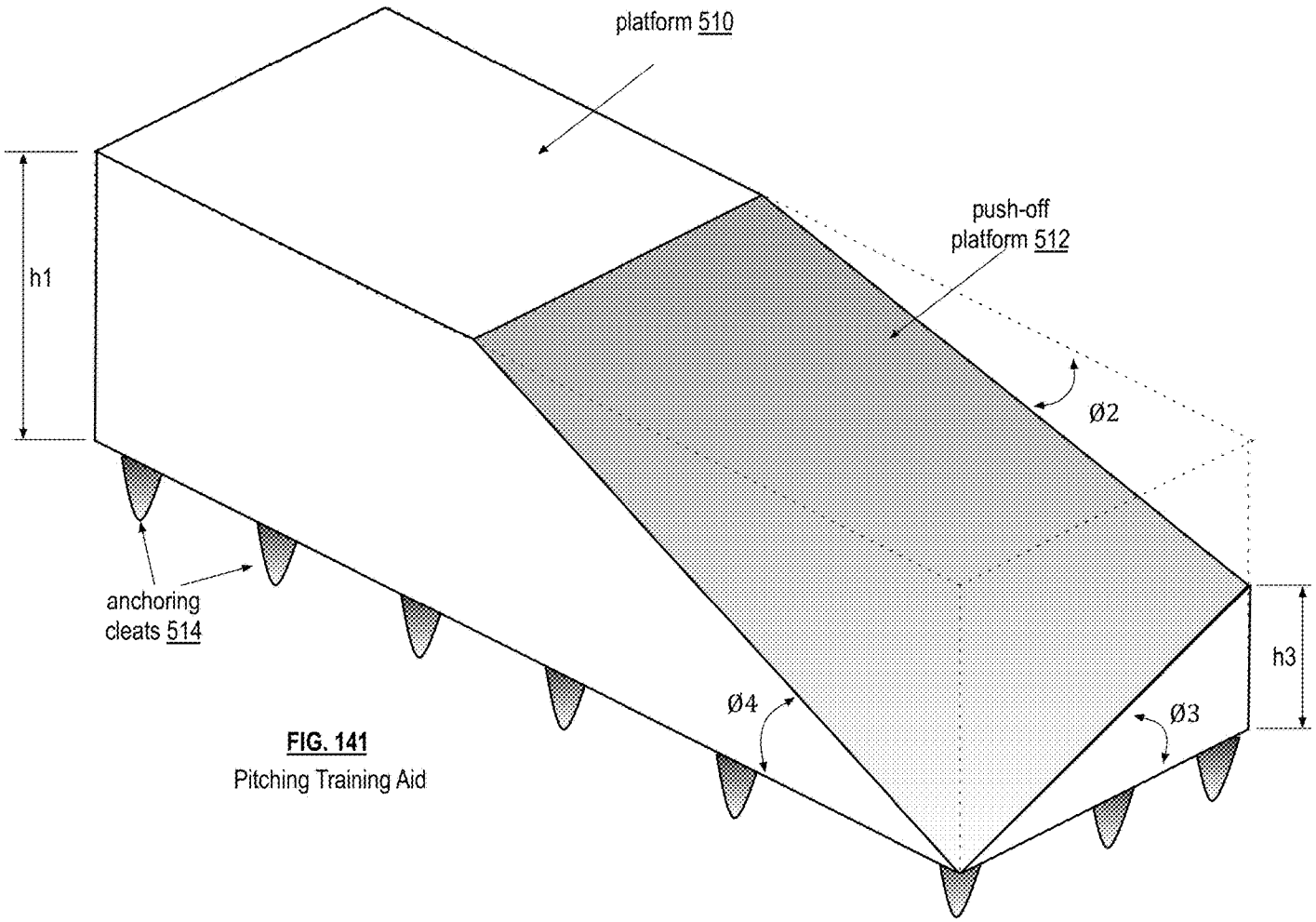
FIG. 141 illustrates an isometric view diagram of another embodiment of a pitching training aid that includes an athletic positioning shape in accordance with the present invention.

FIG. 141 illustrates an isometric view diagram of another embodiment of a pitching training aid that includes one of the athletic positioning shapes, a notch for engaging the rubber (no notch shown), and a plurality of anchoring cleats 514. In an example, the training aid has dimensions that include a height (h1) of 20-50 mm, a second height (h3) of 5-20 mm, a width of 75-125 mm, a length of 250-350 mm, and corresponding angles (Ø2, Ø3, and Ø4).

In use, the pitching training aid is placed such that the notch engages the front edge of the rubber. The training aid is secured the pitching mound via the anchoring cleats 514. The pitcher places his/her drive leg shoe on the training aid 512 such that his/her big toe and/or ball of foot is positioned at the lowest point the training aid and the heel is positioned at a higher point.

Figure 142:
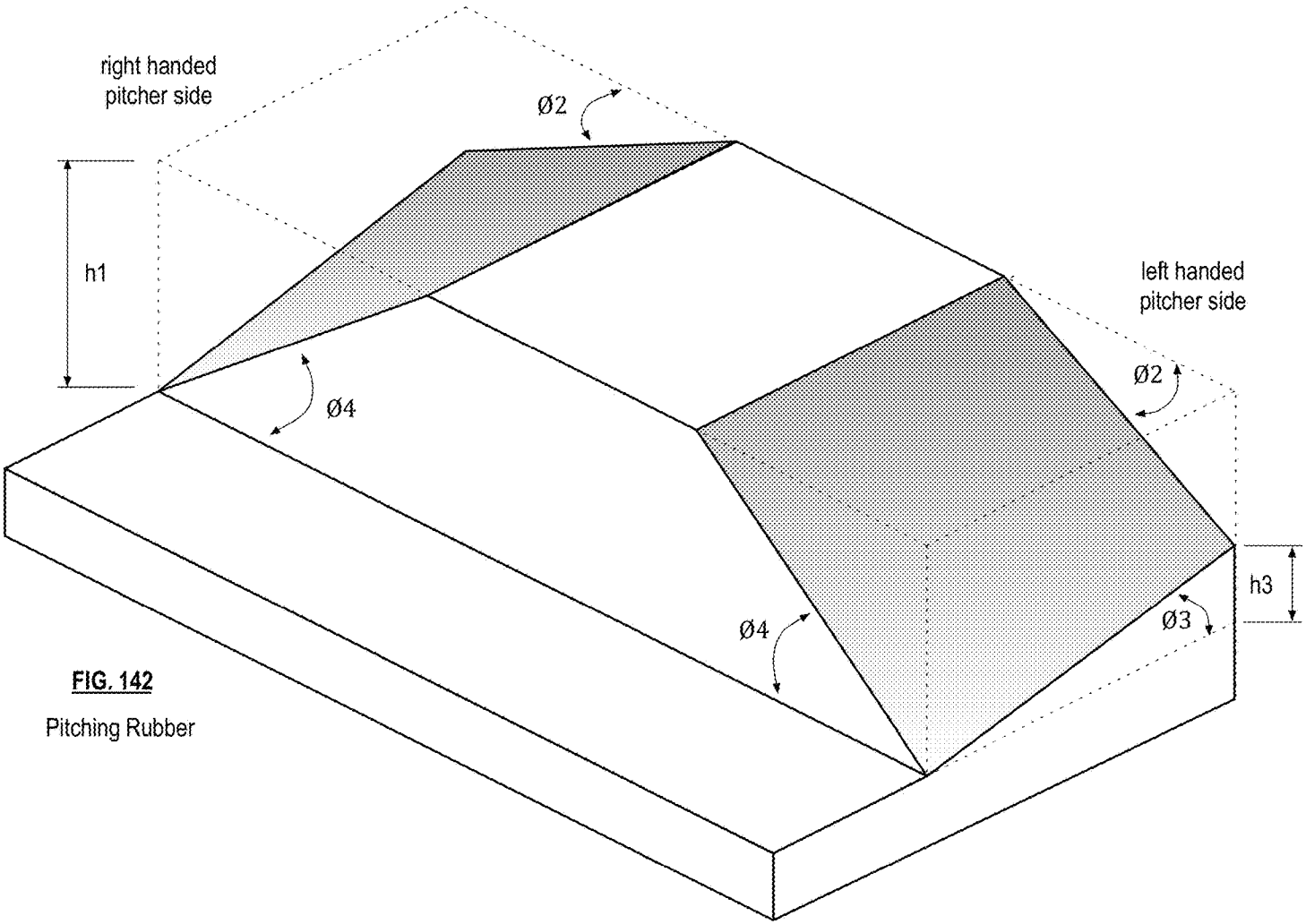
FIG. 142 illustrates an isometric view diagram of an embodiment of a pitching rubber that includes an athletic positioning shape in accordance with the present invention.

FIG. 142 illustrates an isometric view diagram of an embodiment of a pitching rubber that includes a left-handed side and a right-handed side. Each side includes one of the athletic positioning shapes to facilitate achieving an athletic position for pitching. The pitching rubber may further include a ledge to ensure a proper height for engaging the athletic positioning ends of the rubber.

Figure 143:
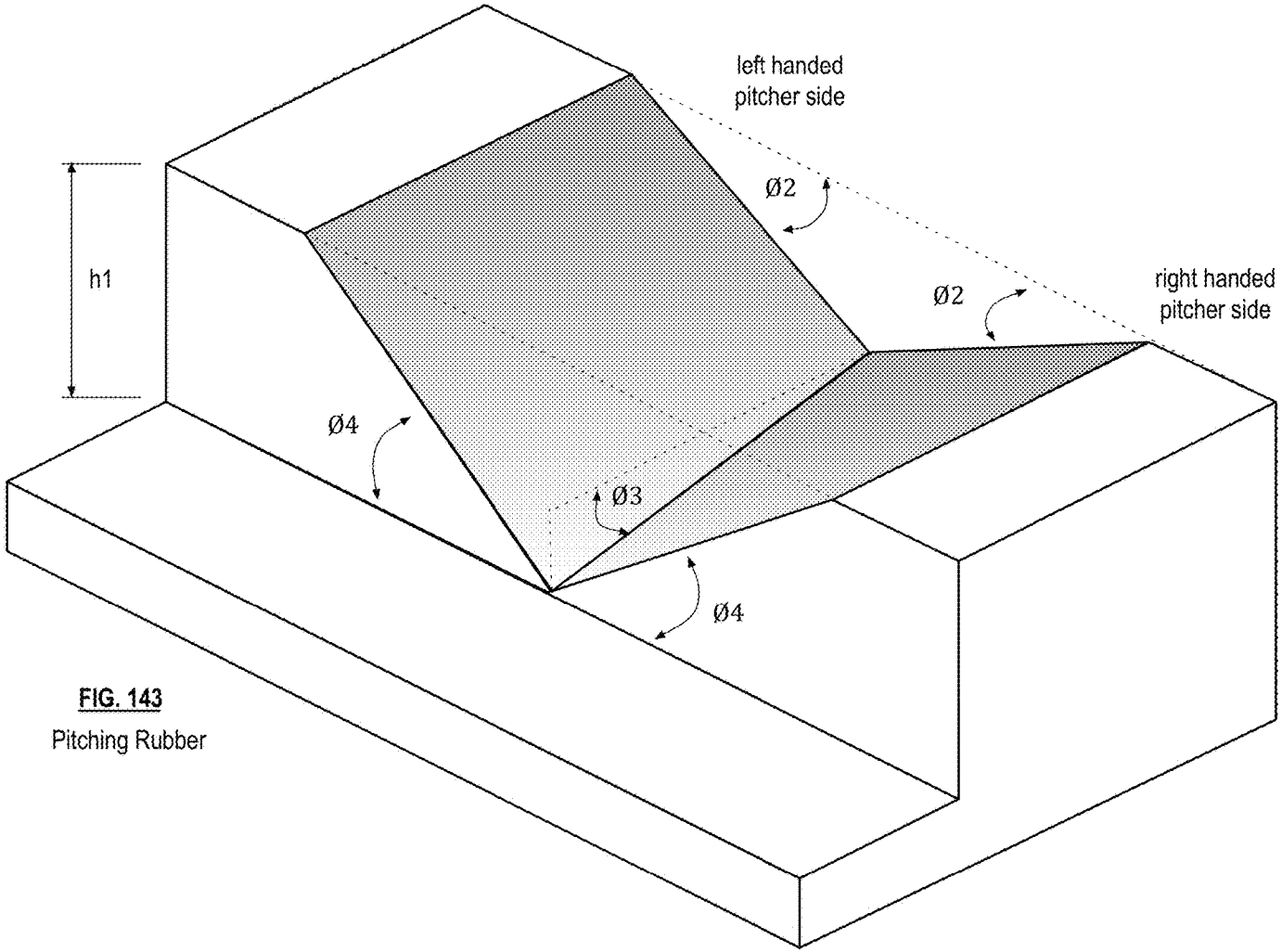
FIG. 143 illustrates an isometric view diagram of another embodiment of a pitching rubber that includes an athletic positioning shape in accordance with the present invention.

FIG. 143 illustrates an isometric view diagram of another embodiment of a pitching rubber that includes a left-handed middle section and a right-handed middle section. Each middle section includes one of the athletic positioning shapes to facilitate achieving an athletic position for pitching. The pitching rubber may further include a ledge to ensure a proper height for engaging the athletic positioning ends of the rubber.

Figure 144:
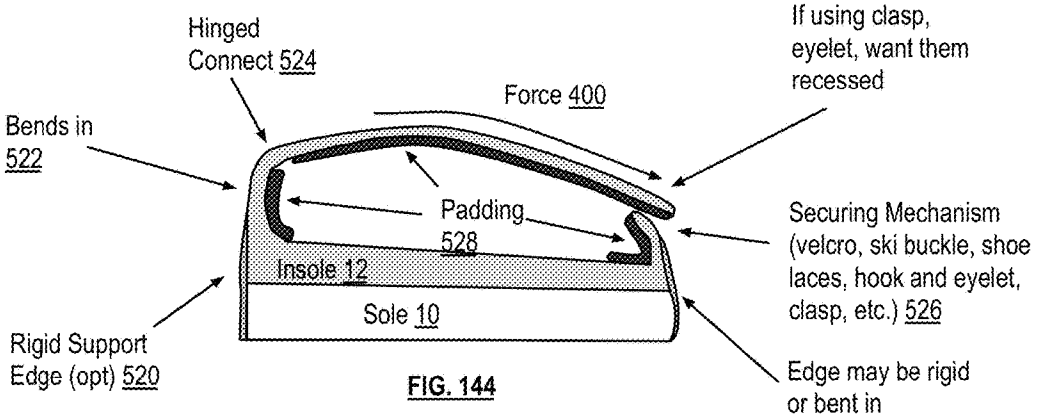
FIG. 144 illustrates a cross-section view diagram of an embodiment of a fitting mechanism for a shoe that includes an athletic positioning shape in accordance with the present invention.
Figure 145:
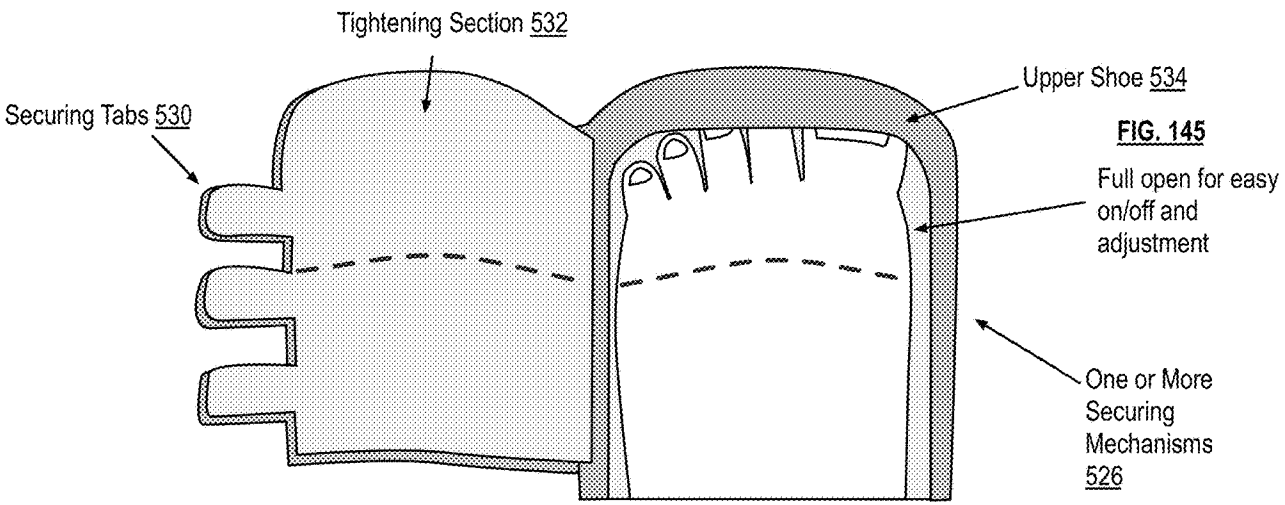
FIG. 145 illustrates a top front view diagram of an embodiment of a fitting mechanism for a shoe that includes an athletic positioning shape in accordance with the present invention.

FIGS. 144 and 145 illustrate a top view diagram and a cross-section front view diagram of an embodiment of a shoe that includes an athletic positioning insole/sole assembly, an upper shoe 534, one or more tightening sections, and one or more securing mechanisms 526. The upper shoe 534 includes a toe cover section, sides, and an Achilles heel section. The one or more tightening sections include one or more flaps (one shown), where each flap includes one or more securing tabs attached thereto. A flap 532 may be comprised of a similar material as a tongue on a conventional shoe and/or of a similar material as at least a portion of the upper shoe 534.

The upper shoe 534 is attached to the one or more tightening sections via a hinged coupling mechanism 524 (e.g., a flexible and durable material mechanically coupling (e.g., stitched, glued, fused, stapled, riveted, etc.) the upper shoe 534 to the tightening section, a fabric hinge, a plastic and/or rubber hinge, etc.). The one or more securing mechanisms 526 (e.g., Velcro, buckles, shoe laces, hook and eyelets, clasps, etc.) include one mating element mechanically coupled to the vertical component of the outer-sole and/or to the sole/insole assembly on the inside edge of the shoe and another mating element mechanically coupled to the securing tabs 530 of the tightening section.

In use, the tightening section 532 is open to allow the wearer to easily insert his/her foot. Once the foot is placed within the shoe, the wearer pulls the tightening section 532 over the top of his/her foot. Due to the sole/insole assembly, the outer edge of the foot is higher than the inside edge (especially towards the toes and ball of foot areas) and the heel is higher than the toes and ball of foot areas. With this orientation of the foot, applying a force 400 from the outside edge to the inside edge while closing and fastening the tightening section 532 to the securing mechanism 526 provides a desired snug fit and may further promote the athletic positioning. Padding within the shoe provides added comfort.

Figure 146:
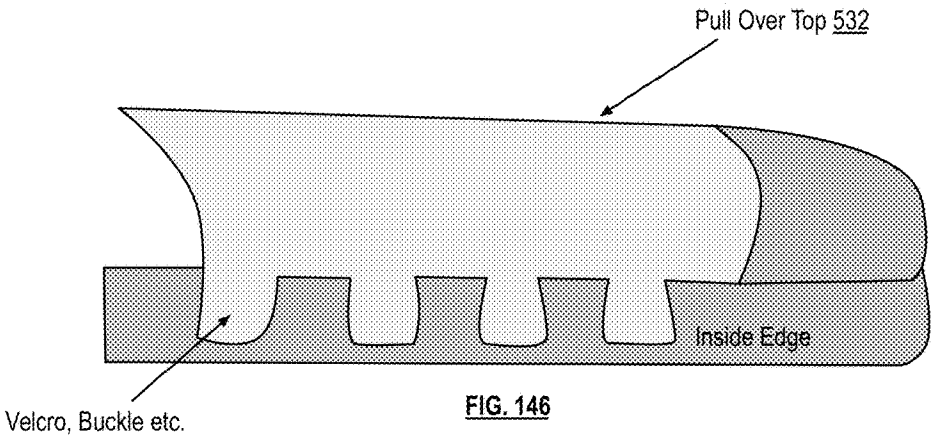
FIG. 146 illustrates a side view diagram of an embodiment of a fitting mechanism for a shoe that includes an athletic positioning shape in accordance with the present invention.

FIG. 146 illustrates a side view diagram of an embodiment of the shoe of FIGS. 144 and 145 with the one or more tightening sections 532 (e.g., pull over top) securely fastened to the one or more securing mechanisms 326, which are securely mounted on the vertical outer-sole section on the inside edge of the shoe. With the tightening section 532 securely fastened, it is applying a force from the outer edge of the shoe to the inner edge of the shoe, which provides the desired snug fit and promotes the athletic positioning.

Figure 147:
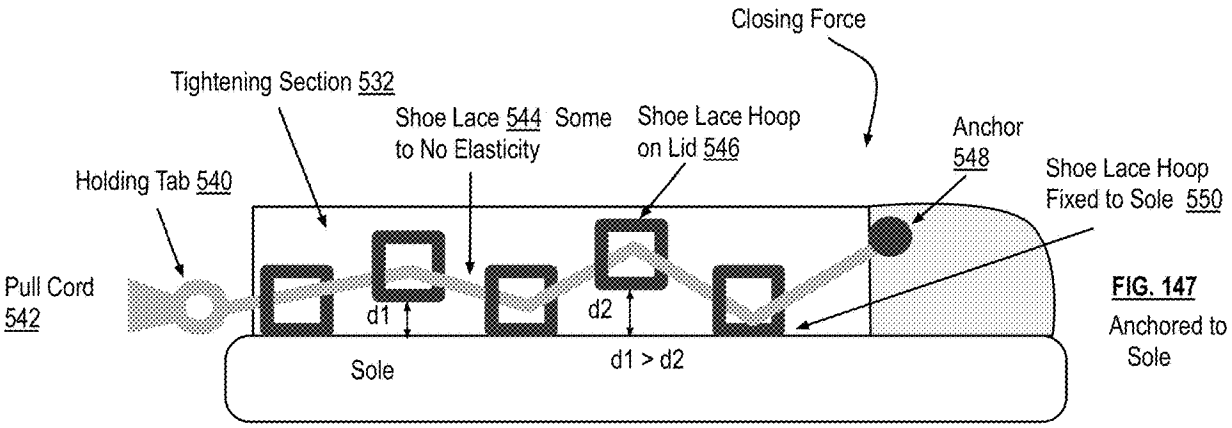
FIG. 147 illustrates a side view diagram of another embodiment of a fitting mechanism for a shoe that includes an athletic positioning shape in accordance with the present invention.
Figure 148:
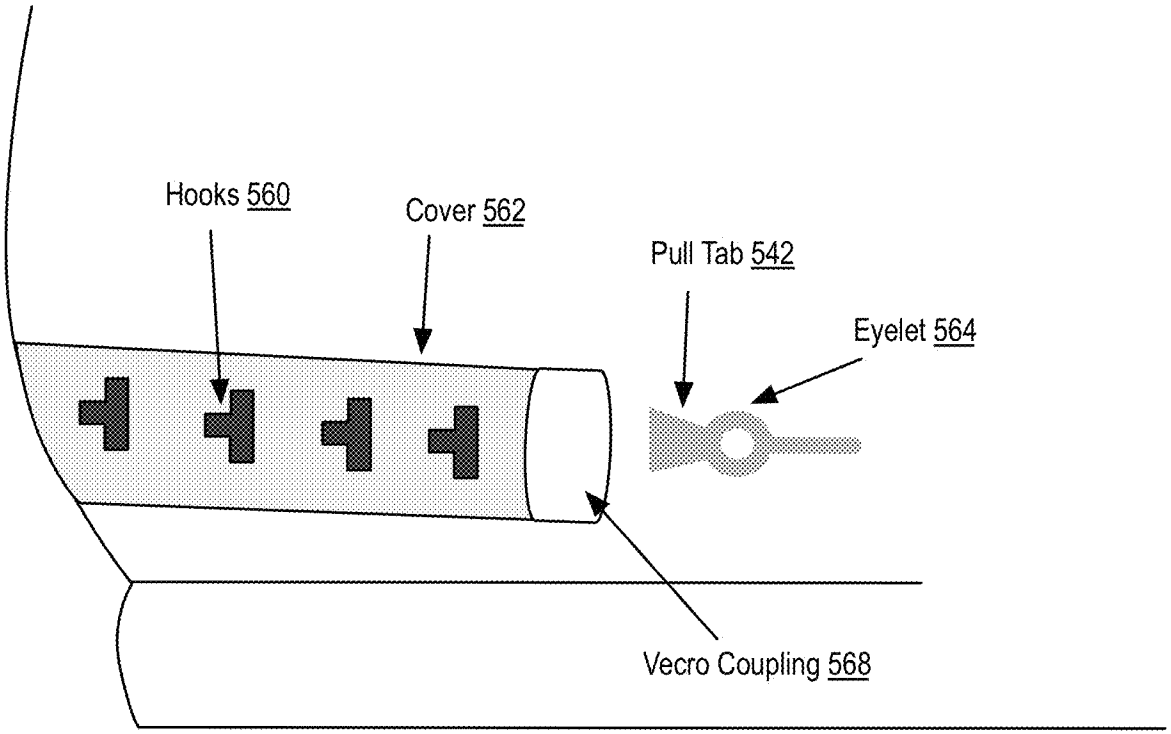
FIG. 148 illustrates a side view diagram of another embodiment of a fitting mechanism for a shoe that includes an athletic positioning shape in accordance with the present invention.

FIGS. 147 and 148 illustrate side view diagrams of another embodiment of a shoe that includes an athletic positioning insole/sole assembly, an upper shoe, one or more tightening sections 532, and one or more securing mechanisms 526. The securing mechanism 526(*s*) includes an anchoring mechanism 548, a first set of hoops 560, a second set of hoops 546, a shoelace 544 (which are shown in FIG. 147), and a hook section (which is shown in FIG. 148).

The first set of hoops 550 (which may be eyelets, holes with grommets, etc.) is secured to the tightening section 532 and the second set of hoops 546 is secured to the sole or outersole and is horizontal offset from the first set of hoops. The shoelace 544 is woven through the sets of hooks and is anchored at one by the anchoring mechanism 548 (e.g., stitching, riveting, gluing, etc.) to the sole, outersole, or the toe box cover. The shoelace 544, which may have some to no elasticity, includes a holding tab 540 and a hook 560 (or eyelet 564) at its other end. The hook section 560 (FIG. 148) includes a plurality of hooks 560 arranged in a pattern (e.g., linearly aligned, aligned in an upward angle, aligned in a downward angle, equally spaced, unequally spaced, etc.) and includes a cover with a Velcro 568 (or other) securing tab.

In use, the wearer provides slack to the shoelace 544 such that the tightening section 532 can be opened enough to enable the wearer to insert his/her foot into the shoe. In this position, the first set of hoops 546 is vertically offset from the second set of hoops 550. Once the foot is in the shoe, the wearer pulls the shoelace 544 via the holding tab 542, which causes the first set of hoops 546 to be pulled downward towards the second set of hoops 550. This motion causes the tightening section 532 to tighten around the foot. Once the wearer has achieved the desired snug fit, he/she couples the eyelet 564 of the shoelace 544 on one of the hooks 560 (FIG. 148) to maintain the present fit of the shoe. The wearer then secures the hook cover 562 over the hooks 560. To remove the shoe, the wearer performs the process in reverse.

Figure 149:
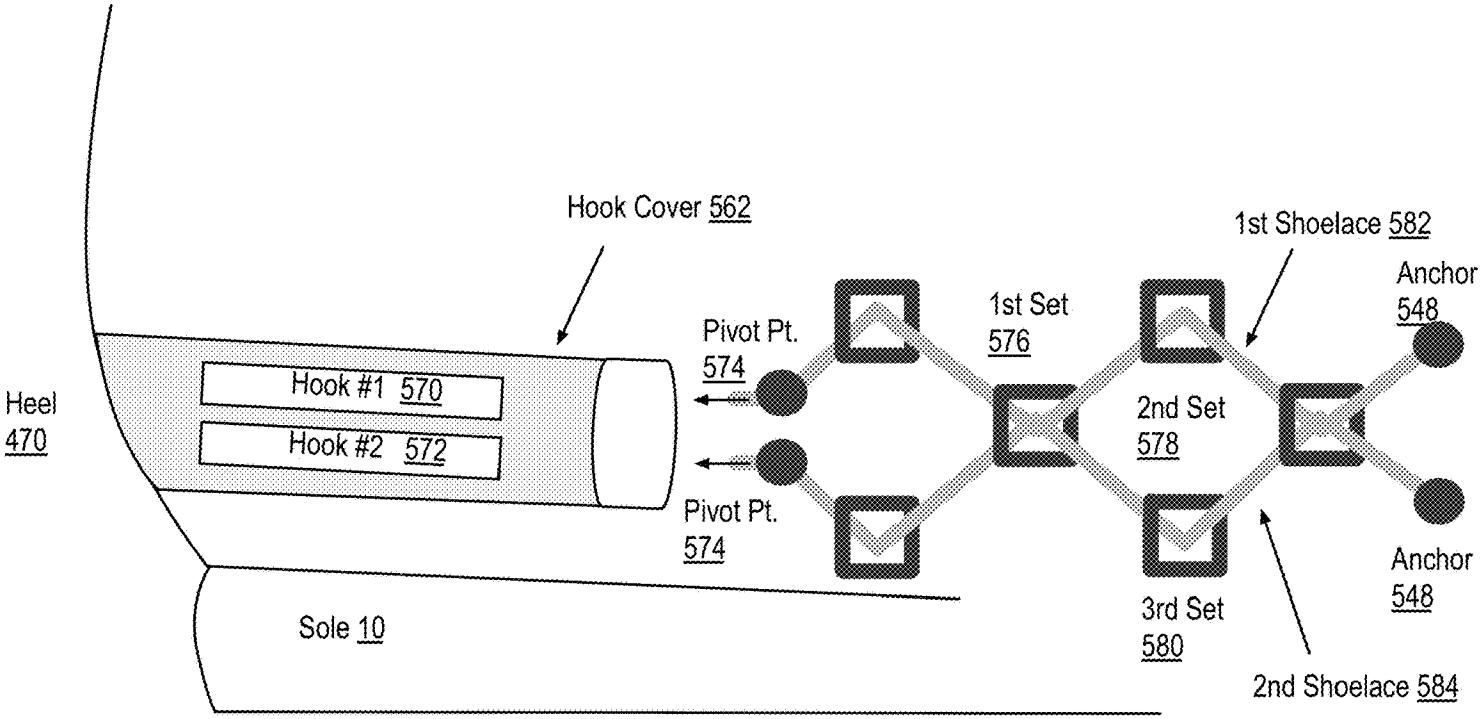
FIG. 149 illustrates a side view diagram of another embodiment of a fitting mechanism for a shoe that includes an athletic positioning shape in accordance with the present invention.

FIG. 149 illustrates a side view diagram of another embodiment of shoe that includes an athletic positioning insole/sole assembly, an upper shoe, one or more tightening sections 532, and one or more securing mechanisms 526. The securing mechanism(s) 526 includes anchoring mechanisms 548, a first set of hoops 576, a second set of hoops 578, a third set of hoops 580, a first shoelace 582, a second shoelace 584, a first hook section 570, and a second hook section 572.

The first set of hoops 576 (which may be eyelets, holes with grommets, etc.) is secured to the tightening section 532; the second set of hoops 578 is free floating; and the third set of hoops 580 is secured to the sole or outersole. The first shoelace 582 is woven through the first 570 and second sets of hooks 572 and is anchored at one by the first anchoring mechanism 548 to the sole, outersole, or the toe box cover. The second shoelace 584 is woven through the second 578 and third sets of hooks 580 and is anchored at one by the second anchoring mechanism 548 to the sole, outersole, or the toe box cover.

Each of the shoelaces, which may have some to no elasticity, includes a holding tab and a hook 564 (or eyelet) at its other end. Each of the hook sections 560 includes a plurality of hooks arranged in a pattern (e.g., linearly aligned, aligned in an upward angle, aligned in a downward angle, equally spaced, unequally spaced, etc.). A shoe may further include a cover that covers the hook sections.

In use, the wearer provides slack to the shoelaces such that the tightening section 532 can be opened enough to enable the wearer to insert his/her foot into the shoe. In this position, the first set of hoops 576 is vertically offset from the second set of hoops, 578 which are vertically offset from the third set of hoops 580. Once the foot is in the shoe, the wearer pulls the second shoelace 584 via the holding tab, which causes the second set of hoops 578 to be pulled downward towards the third set of hoops 580. The wearer then pulls (or pulls contemporaneously) the first shoe via its holding tab, which causes the first set of hoops 576 to be pulled downward toward the second 578 and third set of hoops 580. These motions cause the tightening section to tighten around the foot. Once the wearer has achieved the desired snug fit, he/she couples the eyelets of the shoelaces on hooks 570 of the respective hook sections to maintain the present fit of the shoe. The wearer then secures the hook cover 562 over the hook sections. To remove the shoe, the wearer performs the process in reverse.

Figure 150:
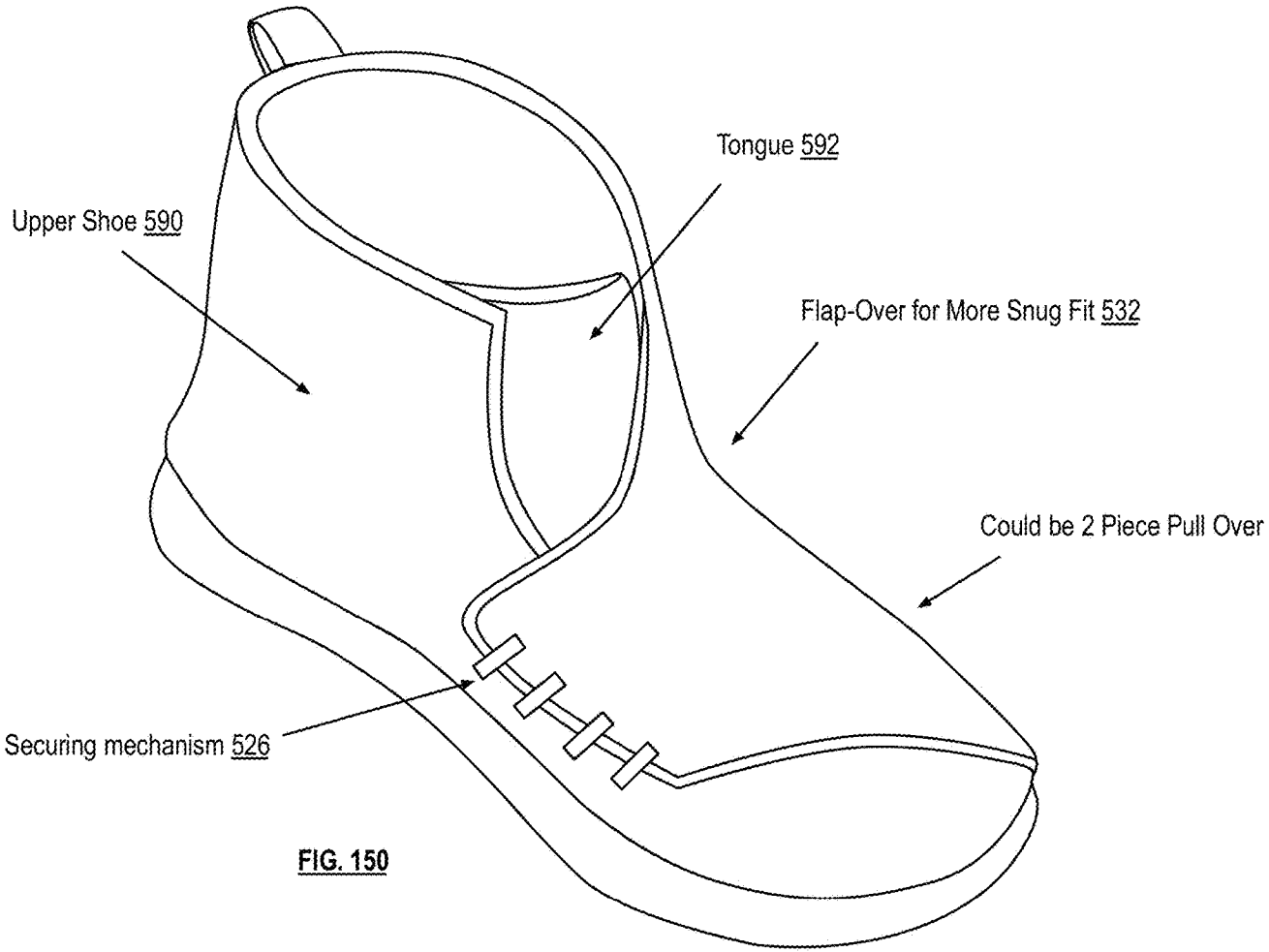
FIG. 150 illustrates an isometric view diagram of another embodiment of a fitting mechanism for a shoe that includes an athletic positioning shape in accordance with the present invention.

FIG. 150 illustrates an isometric view diagram of another embodiment of shoe that includes an athletic positioning insole/sole assembly, an upper shoe 590, one or more tightening sections 532, and one or more securing mechanisms 526. The securing mechanism 526 may be any one or a combination of the securing mechanisms previously discussed. The tightening section 532 is shown as being an integral part of the upper shoe 590 to include one or more flaps 532 that pull over the top of the shoe towards the instep. The upper shoe 590 is further shown to include a tongue 592.

In use, the wearer unsecures the pull over flap (s) 532 from the securing mechanisms 526 or loosens the pull over flaps 532 from the securing mechanisms 526 depending on the type of the securing mechanism. In this condition, the wearer inserts his/her foot into the shoe and positions the tongue 592, if needed. Once the foot is inserted into the shoe, the wearer pulls the pull over flap(s) 532 and secures it/them using the securing mechanisms 526.

A shoe (sport, dress, casual, etc.) may be implemented using one or more of the concepts presented with reference to the preceding figures. For instance, a shoe may include a combination of concepts discussed with reference to different figures even if the discussion of one figure did not specifically mentioned that the concept(s) it is presenting can be combined with one or more concepts discussed with reference to another figure. In addition, one or more of the concepts presented with reference to one or more of the figures may be used in a stand alone athletic positioning insole, a standalone athletic positioning attachment, a standalone training aid, and/or in a combination thereof. Further, the concepts presented in the preceding figures may be diagramed for left footwear (e.g., sole, insole, bottom, sock, shoe, etc.) or right footwear. Regardless of which footed footwear is illustrated, the concepts apply equally to left footed footwear and to right footed footwear. Still further, a sole/insole assembly (i.e., a sole and an insole that individually or collectively have an athletic positioning shape) may be incorporated into any type of shoe along with other shoe parts (e.g., an outersole (e.g., a sport specific bottom), a upper shoe, a toe cover, etc.).

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc., described with reference to one or more of the embodiments discussed herein. Further, from figure to figure, the embodiments may incorporate the same or similarly named functions, steps, modules, etc., that may use the same or different reference numbers and, as such, the functions, steps, modules, etc., may be the same or similar functions, steps, modules, etc., or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. An apparatus comprises:

a heel platform section having a width and a length, wherein the width is from an inner edge of the apparatus to an outer edge of the apparatus and the length is from a rear edge of the apparatus to a first intersection line, wherein the heel section has substantially zero slope from the inner edge of the apparatus to the outer edge of the apparatus;

a mid-foot section juxtaposed to the heel platform section along the first intersection line, wherein the mid-foot section includes a first slope from a second intersection line to the first intersection line along a first line of the mid-foot section, a second slope from the second intersection line to the first intersection line along a second line of the mid-foot section, and a third slope from the second line of the mid-foot section to the first line of the mid-foot section, wherein the first slope is greater than the second slope, and wherein the third slope has a first variable angle based on a difference between the first slope and the second slope; and a toe section juxtaposed to the mid-foot section along the second intersection line, wherein toe section includes a fourth slope from a front edge of the apparatus to the second intersection line along a third line of the toe section, a fifth slope along a fourth line of the toe section from the front edge of the apparatus to the second intersection line, and a sixth slope from the third line of the toe section to the fourth line of the toe section, wherein the fourth slope is greater than the fifth slope, wherein the sixth slope has a variable angle based on a difference between the fourth slope and the fifth slope, and wherein, when the apparatus is worn, the first through sixth slopes cause imbalanced weight bearing forces with more of the weight bearing forces being at a ball-of-foot and big toe area than in other areas of the toe and mid-foot sections.

2. The apparatus of claim 1 further comprises:

the first line of the mid-foot section and the third line of the toe section are aligned and are spaced a first width value from an inner edge of the apparatus; and the second line of the mid-foot section and the fourth line of the toe section are aligned and are along an outer edge of the apparatus.

3. The apparatus of claim 1 further comprises:

the first line of the mid-foot section and the third line of the toe section are aligned and are spaced a first width value from an inner edge of the apparatus;

the second line of the mid-foot section and the fourth line of the toe section are aligned and are spaced a second width value from an outer edge of the apparatus; and an angled edge platform from the aligned second line of the mid-foot section and the fourth line of the toe section to the outer edge of the apparatus.

4. The apparatus of claim 1 further comprises:

the first line of the mid-foot section is along an inner edge of the apparatus; and the third line of the toe section is spaced a width value from the inner edge of the apparatus.

5. The apparatus of claim 1 further comprises:

the first slope along the first line of the mid-foot section is equal to or greater than the fourth slope along the third line of the toe section; and the second slope along the second line of the mid-foot section is equal to or greater than the fifth slope along the fourth line of the toe section.

6. The apparatus of claim 1 further comprises:

the first slope along the first line of the mid-foot section is equal to or less than the fourth slope along the third line of the toe section; and the second slope along the second line of the mid-foot section is equal to or less than the fifth slope along the fourth line of the toe section.

7. The apparatus of claim 1 further comprises:

the first line of the mid-foot section is at a first angle with respect to an inner edge of the apparatus; and the third line of the toe section is at a second angle with respect to the inner edge of the apparatus.

8. The apparatus of claim 1 further comprises:

the mid-foot section and at least a portion of the toe section forming an angled support platform that has a gradient contoured shape.

9. A shoe comprises:

an upper section; and a sole coupled to the upper section, wherein the sole includes:

a specific bottom; and an athletic positioning sole section having:

a heel platform section having a width and a length, wherein the width is from an inner edge of the athletic positioning sole section to an outer edge of the athletic positioning sole section and the length is from a rear edge of the shoe to a first intersection line, wherein the heel section has substantially zero slope from the inner edge of the athletic positioning sole section to the outer edge of the athletic positioning sole section;

a mid-foot section juxtaposed to the heel platform section along the first intersection line, wherein the mid-foot section includes a first slope from a second intersection line to the first intersection line along a first line of the mid-foot section, a second slope from the second intersection line to the first intersection line along a second line of the mid-foot section, and a third slope from the second line of the mid-foot section to the first line of the mid-foot section, wherein the first slope is greater than the second slope, and wherein the third slope has a first variable angle based on a difference between the first slope and the second slope; and a toe section juxtaposed to the mid-foot section along the second intersection line, wherein toe section includes a fourth slope from a front edge of the athletic positioning sole section to the second intersection line along a third line of the toe section, a fifth slope along a fourth line of the toe section from the front edge of the athletic positioning sole section to the second intersection line, and a sixth slope from the third line of the toe section to the fourth line of the toe section, wherein the fourth slope is greater than the fifth slope, wherein the sixth slope has a variable angle based on a difference between the fourth slope and the fifth slope, and wherein, when the shoe is worn, the first through sixth slopes cause imbalanced weight bearing forces with more of the weight bearing forces being at a ball-of-foot and big toe area than in other areas of the toe and mid-foot sections.

10. The shoe of claim 9 further comprises:

the first line of the mid-foot section and the third line of the toe section are aligned and are spaced a first width value from an inner edge of the athletic positioning sole section; and the second line of the mid-foot section and the fourth line of the toe section are aligned and are along an outer edge of the athletic positioning sole section.

11. The shoe of claim 9 further comprises:

the first line of the mid-foot section and the third line of the toe section are aligned and are spaced a first width value from an inner edge of the athletic positioning sole section;

the second line of the mid-foot section and the fourth line of the toe section are aligned and are spaced a second width value from an outer edge of the athletic positioning sole section; and an angled edge platform from the aligned second line of the mid-foot section and the fourth line of the toe section to the outer edge of the athletic positioning sole section.

12. The shoe of claim 9 further comprises:

the first line of the mid-foot section is along an inner edge of the athletic positioning sole section; and the third line of the toe section is spaced a width value from the inner edge of the athletic positioning sole section.

13. The shoe of claim 9 further comprises:

the first slope along the first line of the mid-foot section is equal to or greater than the fourth slope along the third line of the toe section; and the second slope along the second line of the mid-foot section is equal to or greater than the fifth slope along the fourth line of the toe section.

14. The shoe of claim 9 further comprises:

the first slope along the first line of the mid-foot section is equal to or less than the fourth slope along the third line of the toe section; and the second slope along the second line of the mid-foot section is equal to or less than the fifth slope along the fourth line of the toe section.

15. The shoe of claim 9 further comprises:

the first line of the mid-foot section is at a first angle with respect to an inner edge of the athletic positioning sole section; and the third line of the toe section is at a second angle with respect to the inner edge of the athletic positioning sole section.

16. The shoe of claim 9 further comprises:

the mid-foot section and at least a portion of the toe section forming an angled support platform that has a gradient contoured shape.

* * * * *